US012018894B2

(12) United States Patent
Li et al.

(10) Patent No.: US 12,018,894 B2
(45) Date of Patent: Jun. 25, 2024

(54) ON-DEMAND SWEATING-BOOSTED AIR COOLED HEAT-PIPE CONDENSERS

(71) Applicant: University of South Carolina, Columbia, SC (US)

(72) Inventors: Chen Li, Chapin, SC (US); Jamil Khan, Columbia, SC (US); Xinyu Huang, Columbia, SC (US); Tanvir Farouk, Irmo, SC (US); Raikan Dawas, Cayce, SC (US); Wei Chang, Columbia, SC (US); Pengtao Wang, Columbia, SC (US); Mohammad Alwazzan, Columbia, SC (US); Guanghan Huang, Columbia, SC (US)

(73) Assignee: University of South Carolina, Columbia, SC (US)

( * ) Notice: Subject to any disclaimer, the term of this patent is extended or adjusted under 35 U.S.C. 154(b) by 91 days.

(21) Appl. No.: 16/824,777

(22) Filed: Mar. 20, 2020

(65) Prior Publication Data

US 2020/0370840 A1 Nov. 26, 2020

Related U.S. Application Data

(60) Provisional application No. 62/850,009, filed on May 20, 2019.

(51) Int. Cl.

| | |
|---|---|
| ***F28D 15/00*** | (2006.01) |
| ***F28B 1/06*** | (2006.01) |
| ***F28D 15/02*** | (2006.01) |
| ***F28D 15/04*** | (2006.01) |

(52) U.S. Cl.

CPC ..... *F28D 15/046* (2013.01); *F28B 1/06* (2013.01); *F28D 15/0275* (2013.01); *F28D 15/0283* (2013.01); *F28D 15/043* (2013.01)

(58) Field of Classification Search

CPC ..... F28D 15/046; F28D 15/0275; F28D 15/0283; F28D 15/043; F28B 1/06; F28B 5/00; F28F 13/182; F28F 21/02; F28F 21/085; F28F 21/086; F28F 21/087; F28F 21/089; F28F 2215/00; F28F 2245/02; F28F 2245/08; F28F 2255/20

See application file for complete search history.

(56) References Cited

U.S. PATENT DOCUMENTS 4,033,406 A * 7/1977 Basiulis ..... F28D 15/06 165/274
4,149,588 A * 4/1979 Waters ..... F28D 15/0266 165/110
4,226,282 A * 10/1980 Kunsagi ..... F28D 15/0275 165/110
4,311,733 A * 1/1982 Inoue ..... C23C 18/1648 427/230
4,379,485 A * 4/1983 Fisher, Jr. ..... F28B 1/00 261/153
4,381,817 A * 5/1983 Brigida ..... F28D 15/0275 165/110
5,651,414 A * 7/1997 Suzuki ..... F28D 15/0275 165/104.33

(Continued)

*Primary Examiner* — Travis Ruby
(74) *Attorney, Agent, or Firm* — Burr & Forman LLP; Douglas L. Lineberry

(57) ABSTRACT

Sweating-boosted air cooled heat-pipe condensers employing a nanowick micro fin structure to form a sweating boosted heat dissipation system, wherein the nanowicks may be layered.

5 Claims, 51 Drawing Sheets

(56) References Cited

U.S. PATENT DOCUMENTS

| | | | | |
|---|---|---|---|---|
| 6,241,009 | B1 * | 6/2001 | Rush | F28B 1/06 165/113 |
| 6,571,864 | B1 * | 6/2003 | Yoon | F28F 13/18 165/133 |
| 7,874,347 | B2 * | 1/2011 | Chen | F28F 19/02 165/104.21 |
| 8,157,512 | B2 * | 4/2012 | Zhang | F02C 7/143 165/104.13 |
| 10,605,541 | B1 * | 3/2020 | Zheng | F28D 20/028 |
| 10,809,006 | B1 * | 10/2020 | Shah | F28B 11/00 |
| 2005/0126766 | A1 * | 6/2005 | Lee | B82Y 10/00 165/185 |
| 2005/0238810 | A1 * | 10/2005 | Scaringe | F28F 13/185 427/249.1 |
| 2008/0128116 | A1 * | 6/2008 | Dangelo | F28D 15/046 165/104.21 |
| 2011/0100605 | A1 * | 5/2011 | Zheng | F28D 15/0275 165/104.26 |
| 2011/0171373 | A1 * | 7/2011 | Lee | C09K 5/14 977/773 |
| 2015/0000874 | A1 * | 1/2015 | Veilleux, Jr. | F28D 15/0275 165/104.21 |
| 2015/0048526 | A1 * | 2/2015 | Kim | B01D 5/0003 427/435 |
| 2017/0227305 | A1 * | 8/2017 | Yamada | F28F 13/187 |
| 2017/0356691 | A1 * | 12/2017 | Willis | F28F 21/086 |

* cited by examiner

Table 1: Cooling system data comparison for a 500MW Coal Fired Steam Power Plant with a heat load of 732MW and a steam flow rate of 315 kg/s. (Ambient Air at 25°C)

| | | Heat Pipe Air Cooling Condenser | ACC |
|---|---|---|---|
| Air Side Temperature [°C] | | 25 | 25 |
| Steam Side Temperature [°C] | | 35 | 46 |
| ITD [C] | | 10 | 21 |
| Footprint [$m^2$] | | 4318 (52%↓) | 8919 |
| | No. of heat pipes/tubes | 80,000 | 24,000 |
| | Length of Heat pipe/tube [m] | 6 | 12.2 |
| | No. of Cells | 120 | 60 |
| | Cell Dimension [m x m] | 6 x 6 | 12.2 x 12.2 |
| Air Side | Area [$m^2$] | 709,530 (68%↓) | 2220,000 |
| | HTC [$W/m^2K$] | 250 (733%↑) | 30 |
| Steam Side | Area [$m^2$] | 19,949 (64%↓) | 55,800 |
| | HTC [$W/m^2K$] | 25,000 (67%↑) | 15,000 |
| | Pressure Drop [Pa] | 1 0 | 250 |
| Fan | Diameter [m] | 6 | 10 |
| | No. of fans | 120 | 60 |
| | Fan Power [kW] | 4318 (51%↓) | 8919 |
| Water usage | For dripping system [kg/s] | 211 (33% of cooling tower water usage) | 0 |
| | * additional once through cooling [kg/s], hot days only. | | 0 |
| System Cost (MM$) | | 30 - 50 (67%↓) | 90 |

FIG. 2

Partial Hydrophilic and Partial Hydrophobic CNTs

| Parameters / Elements | Heat Transfer Coefficient $h_{DEC} = \frac{\dot{m}_l h_{fg}}{\Delta T A_{fin}} + h_{air} + h_v$ | | Pressure Drop $\Delta P \sim \frac{\rho U^2_{air}}{2}$ |
|---|---|---|---|
| | $h_{air}$ (W/m²K) | $h_{evp}$ (W/m²K) | $U_{air}$ (m/s) |
| Existing number | ~50 | N/A | 3 |
| Proposed number | ~50 | ~250 | ~2 |
| Component improvement | 1X | 4X | 2.25X |
| Net improvement | 5X | | 6.25X |

FIG. 6

$Rc_1e_7$ thermal resistance (TR) in the evaporator; $Rw_2e_7$ TR of wicks in the evaporator; Re, TR from the evaporation process; $Rv_1p$, TR in the vapor flow; Rc, TR from the condensation process; $Rw_2c$, TR of wicks in the condenser; and $Rc_2c$, TR in the condenser container.

| | Prototype | Model |
|---|---|---|
| Geometry | | |
| Fan size | 6 m | 0.5 m |
| Heat pipe length | 6 m | 0.5 m |
| Heat pipe diameter | 63.5 mm | 5.3 mm |
| No. of heat pipes | 667 | 57 |
| Fin diameter | 103.5 mm | 15.33 mm |
| No. of fins | 420 (each end) | 90 (each side) |
| Pressure vessel size (L × D × H) | 1m × 4m × 4m | 0.83 m × 0.5m × 0.5 m |
| Working Condition | | |
| Steam pressure | 10. 565 kPa | 10. 565 kPa |
| Steam quality | 0.93 | 0. 93 |
| Steam flow rate | 2. 625 kg/s | 0.159 kg/s |
| Inlet air temperature | 20 (°C) | 20 (°C) |
| Fan flow rate | 227.6 kg/s | 0.13 kg/s |
| Heat load | 6105.7 (kW) | 3.7 kW |

FIG. 26

| Parameters | Values |
|---|---|
| Length of the evaporator section | 150 mm |
| Length of the condenser section | 250 mm |
| Total length of a heat pipe | 470 mm |
| Distance between thermocouples on the condenser section | 70 mm |
| Distance between thermocouples on the evaporator section | 50 mm |
| Length | 490 mm |
| Inner diameter | 12.7 mm |
| Outside diameter | 28.0 mm |
| Groove depth | 0.28 mm |
| Number of grooves | 75 |

FIG. 28

| Variables | Uncertainties |
|---|---|
| Length/Diameter (L) | 0.1 mm |
| Wall temperature ($T_W$) | 0.5 K |
| Air temperature ($T_{air}$) | 0.6 K |
| Air velocity ($U_{air}$) | 0.2 m/s |
| Volume of condensate ($\dot{Q}_{cw}$) | 0.3 ml/min |
| Water dripping rate | 0.02 ml/min |
| Heat load ($\Phi$) | 15.0 W |
| Overall thermal resistance ($R_{tot}$) | 0.01 K/W |

FIG. 31

| | Air cooling condition | |
|---|---|---|
| | Dry | Sweating-boosted |
| Air velocity (m/s) | 1.0, 1.5, 2.0, 2.5, 3.0 | 0.5, 1.0 |
| Input power of steam generator (W) | 1000, 1200, 1500, 1800, 2000, 2200, 2500 | 3000, 3500 |
| Water dripping rate (ml/min) | --- | 30, 40, 50, 60, 70 |

FIG. 33

Uncertainties of key parameters.

| Name of variables | Uncertainties |
|---|---|
| Length/diameter ( L ) | 0.1 mm |
| Wall temperature ( $T_w$ ) | 0.5 K |
| Air temperature ( $T_\infty$ ) | 0.6 K |
| Air velocity ($U_\infty$) | 0.2 m/s |
| Water dripping rate | 0.02 ml/min |
| Hot water flow rate | 30 ml/min |
| Thermal load ( Φ ) | 16.9 W |
| Effective HTC ( h ) | 3.2 $W/m^2K$ |
| Total thermal resistance ( $R_{tot}$ ) | 0.15 K/W |

FIG. 41

ON-DEMAND SWEATING-BOOSTED AIR COOLED HEAT-PIPE CONDENSERS

This invention was made with government support under grant CBET1357920 awarded by the National Science Foundation. The government has certain rights in the invention.

BACKGROUND OF INVENTION

1) Field of the Invention

The present invention relates to sweating-boosted air cooled heat-pipe condensers for reducing water usage of air cooled condensers.

2) Description of Related Art

To enable a green economy, the U.S. federal government requires 2% annual reduction of water usage for industrial, domestic, commercial, and agricultural applications. This imposes challenges on power industries, which account for 41% of total freshwater withdrawals and consumed approximately 143,000 million gallons freshwater per day in 2005.

Air cooled condensers (ACC) can drastically reduce water use, but have up to 10% power production penalty. Additionally, air is a poor heat transfer fluid as compared to water used in water cooled condensers (WCC). As a result, large surface areas are required. For example, 11 kilometer long condenser tubes with ~10 fins per inch are required per MW of power generator output, which results in a large footprint and costly ACC.

The most critical element in reducing the size, and hence footprint and capital cost of ACC, is to drastically enhance the air cooling rate. However, for ACC applications, it is extremely challenging to triple or even double the state-of-the-practice heat transfer coefficient (HTC, 20-50 $W/m^2 \cdot K$) of air cooling through augmenting heat transfer surface areas in a cost-effective way.

Prior art air cooling devices include: (a) Force Air Convection; (b) Heat Pipe Heat Exchangers; and (c) Dropwise Condensation.

For Force Air Convection, the existing ACC is primarily limited by air-side HTC. Because of the low thermal conductivity, forced air convection heat transfer can be enhanced by reducing the thickness of boundary layers and augmenting heat transfer areas in a passive or an active method.

Enhanced structures or materials are usually used in passive methods. For example, porous media such as metal foam can assist heat dissipation. A. Bhattacharya and R. L. Mahajan demonstrated a finned metal foam heat sink with HTC of 1169 $W/m^2 \cdot K$. The surface of the cooling ducts or fins can be roughened by a milling process, shaping process or fixing uniformly-spaced parallel square ribs orthogonal to the air flow. The major drawback of the rough surfaces is the high example, adding cross-ribs. Moreover, wavy fins and serpentine channels can induce spatial periodic growth and disruption of symmetric pairs of counter-rotating helical vortices at the cross-sectional area. The thermal boundary layer is therefore periodically interrupted by induced helical vortices.

A study focused on low Re number ($10<Re<1000$) regime showed that the HTC was significantly enhanced. However, most of the developed enhanced structures have a penalty of high pressure drop. A V-shaped corrugated carbon foam heat sink can achieve 3280 $W/m^2 \cdot K$ with reduced flow resistance compared to solid carbon foam. However, the potential high cost may prevent its applications on large scale facilities like power plants.

Active methods use external actuators or other forces (e.g. electrical fields) to enhance heat transfer. In a recent study, HTC was enhanced by applying ionic wind to modulate boundary layers. The HTC was enhanced up to 200% above those obtained from bulk flow. Similar electrohydrodynamic (EHD) technique was combined with wavy channels to enhance HTC. Wire electrodes were placed inside the channel to generate electric fields and disturb the boundary layers. However, these techniques require strong electric fields and may not be suitable for large-scale facilities because they require ultrahigh voltage (1750 V for 5 m long duct) to ionize air flow by ionic generation devices. As an additional method, impinging jets are widely used in the local enhancement of heat removal. Arrays of jets are impinged on the hot surfaces to manage thermal energy and cool down the system. A self-oscillating-impinging jet was introduced by adding two communication ports with oscillation frequencies ranging from 20 Hz to 100 Hz. The oscillations enhance convection heat transfer up to 70% compared to stationary cases. However, this technique consumes considerable amounts of energy to power the jets. A vibrating piezoelectric bimorph has been employed to generate acoustic streaming and enhance heat transfer. Also, synthetic jets could generate jet vectoring and experimentally enhanced heat transfer for forced air cooling. However, those jets are fabricated by MEMS technologies and designed for electronics cooling. It would be extremely challenging and costly to integrate millions of small jets on large heat sinks in ACC for power plants. A recent study by J. M. Allison et. al demonstrated the enhancement of convective heat transfer through a finned heat sink using interdigitated impeller blades. Again, it would be challenging and costly to apply small blades in ACC for power plants.

Heat Pipe Heat Exchangers are a passive two-phase device with extremely high thermal conductivity because of the utility of phase transition. The liquid evaporates at the hot end and travels to the condenser at the cold end as vapor. Then, the condensed liquid returns to the hot end by capillary action or gravity to repeat the cycle. The effective thermal conductivity of a heat pipe can be two or three orders of magnitude higher than that of pure copper. The heat pipe is widely used in electronic cooling, thermal control of spacecraft, and energy recovery and storage since it can effectively transport large amount of heat between two solid interfaces over large distances with a small temperature difference.

Although the heat pipe heat exchanger has been widely used in energy sector such as solar energy storage and geothermal heat extraction, the heat pipe has not yet been integrated into condensers at power plants. The existing studies show that the forced convective heat transfer could be significantly enhanced by applying heat pipe heat exchangers. The heat transfer coefficients in the evaporator and condenser zones is 103 to 105 $W/m^2 \cdot K$ and the thermal resistance of the heat pipe can be reduced to 0.01-0.03 K/W. The high efficiency, large capacity and temperature variation of heat pipe indicates that the heat pipe could be a good candidate for heat exchanging during power production. Moreover, heat pipes are highly reliable and maintenance-free.

Because of these promising features, cost-effective heat pipes are suitable for low heat flux applications such as ACC in the power plant. The price of commercially available finned heat pipes is cost-effective and has been massively and successfully used to protect the roadbed of more than 2000 km long railway and highway in China.

Dropwise Condensation has drawn considerable attentions during the past few decades. This is due to the significant high heat transfer performance of dropwise condensation compared to the filmwise condensation. In general, an effective dropwise condensation mechanism can be achieved when the condensate can be removed quickly preventing the low thermal conductivity of the large liquid drops to accumulate on the surface. This rapid removal mechanism can be achieved by using nonwetting superhydrophobic surfaces. Such mechanism is demonstrated by different techniques and investigated throughout numerous experimental research studies, such as through texture geometry and surface energy. An example of the surface texture is the microscopically textured slippery surface soaked with lubricating liquid that is used to increase the rate of drop shedding and to promote dropwise mode condensation. Nanostructures or micro-/nanostructure coatings have been used to reach superhydrophobicity promoting dropwise condensation. Such as the knife-like nanostructured surface or two-tier roughness consist of nanotube deposited on micropillars, both are used to promote droplets jumping mechanism independent of any external force; this is due the droplets coalescence and the release of the excess surface energy. Other studies demonstrated techniques to promote dropwise condensation using multiscale texture to enable both the superhydrophobicity for droplets removal, and the wettability for droplets nucleation, such as the hierarchical nanograssed micropyramid architecture and micromachined pillars with nanotexture. Multiscale texture surfaces may exhibit a significant heat transfer performance, however it can be extremely difficult and expensive to fabricate. Superhydrophobic nanostructure-only surfaces such as self-assembled mono layers coating of n-octadecyl mercaptan and stearic acid, can also significantly enhance condensation heat transfer performance by stimulating superhydrophobic surfaces.

The "Water-Energy Nexus" towards a green economy is challenged by freshwater withdrawn and usage. U.S. federal government requires a 2% annual reduction of freshwater use for industrial, domestic, commercial, and agriculture applications, which imposes challenges to power industries. Power plants account for about 50% of total withdrawn freshwater in the US and Western Europe, and almost 84% of these in China. Over 90% of this water is withdrawn in heat rejection by water-cooled condensers (WCCs) in the US. The global water crisis significantly constrains the available freshwater for WCCs, which makes the air-cooled condensers (ACCs) more competitive, especially in water-stressed regions, such as California and Texas. However, only 1% of US thermal power plants utilize ACCs due to their disadvantages: 3-5 times higher capital and operation costs than WCCs. The performance penalty is from low energetic efficiency, only 41.2% of WCCs, and comes from the operating conditions, such as ambient temperature and winds. These drawbacks technically result from air low thermal conductivity.

The forced convective cooling within ACCs can be enhanced by reducing the thickness of boundary layers and/or augmenting heat transfer areas passively or actively. The passive approaches use enhanced structures/materials, such as porous metal foams, cross-ribs wavy fins, vortex generators, and chaotic mixing. The active methods use external actuators or other forces, such as vibrating piezoelectric bimorph, synthetic jets, electrohydrodynamic forces, and acoustic streaming. Major drawbacks of these methods are high-pressure drop and potentially high costs for large scale applications. Therefore, these enhancements have not been fully characterized in ACCs. The application of ACCs needs emerging heat transfer enhancement technologies with net-zero water dissipation.

However, maintaining a long-lasting dropwise mode of condensation is extremely challenging and hinders many experimental techniques. For instance, when the self-assembled mono layers coating operated at high temperature it gradually turns to filmwise condensation due the weak electrostatic attraction of hydrogen bonding between the coating and the metal surface. Furthermore, by considering the manufacturability, these coating methods are not sufficient for coating large or arbitrary areas. Moreover, applying thick organic coating could increase the heat transfer resistance due to its low thermal conductivity.

What is needed in the art is highly efficient phase change heat transfer to substantially enhance the HTC in the air side of ACC.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 2 shows Table 1, which provides cooling system data comparison for a 500 MW Coal Fired Steam Power Plant with a heat load of 732 MW and a steam flow rate of 315 kg/s.

FIG. 6 shows performance enhancements provided by a sweating-boosted air cooled heat-pipe condenser of the current disclosure.

FIG. 26 shows dimensions for a lab scale condenser.

FIG. 28 shows a table of heat pipe parameters.

FIG. 31 shows a table displaying uncertainties of key parameters.

FIG. 33 shows a table displaying a summary of experimental parameters for the HPACC.

FIG. 41 shows a table of uncertainties of key parameters.

Figure 1:
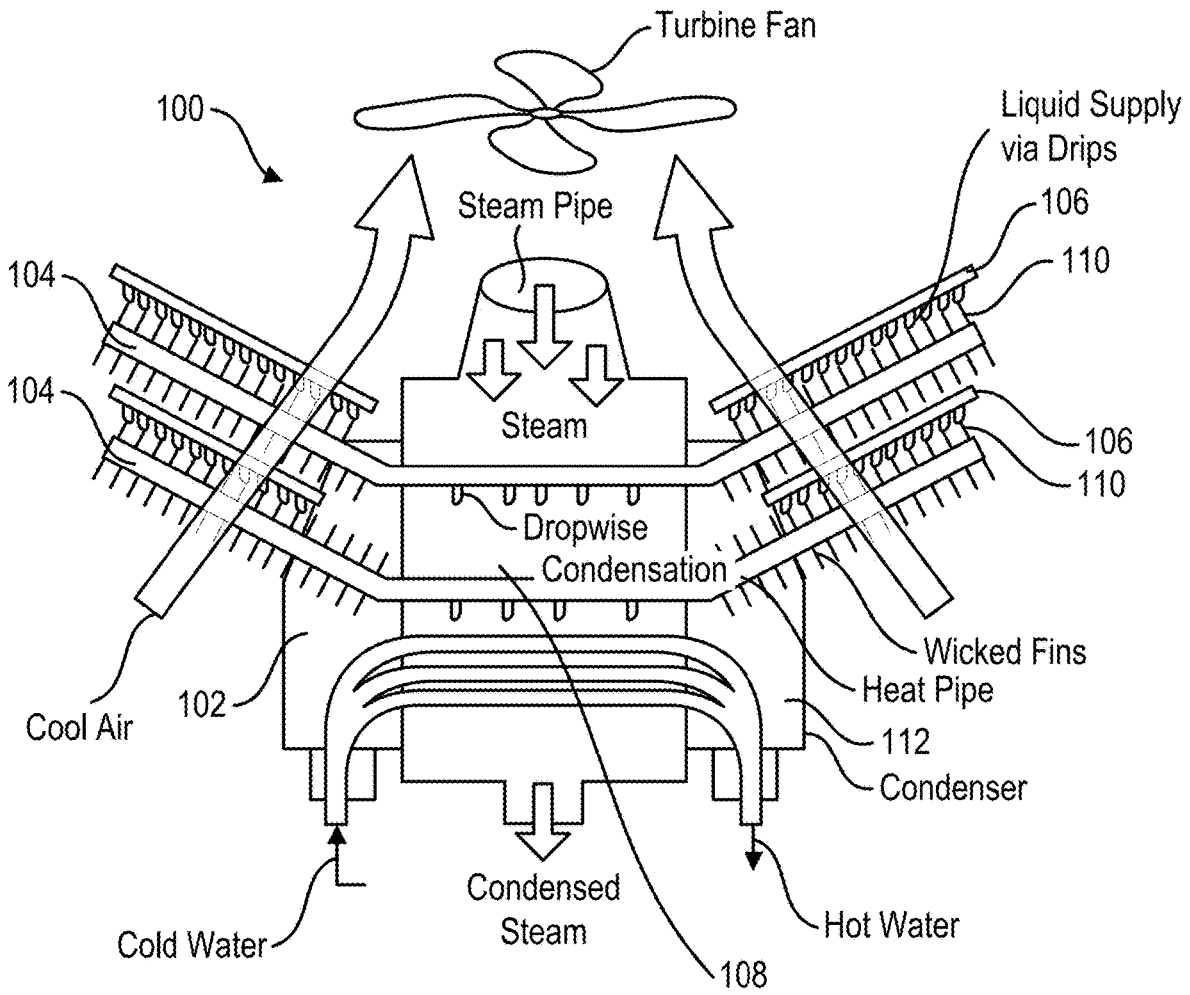
FIG. 1 shows a schematic of one embodiment of a sweating-boosted air cooled heat-pipe condenser of the current disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The current disclosure seeks to mimic the primary mechanism of mammals to effectively dissipate heat during physical exercise, sweating-boosted air cooling was devised to substantially enhance the HTC in the air side of ACC. The current disclosure has demonstrated an impressive 200

$W/m^2 \cdot K$ using sweating-boosted air cooling in a natural convection setting. In a further embodiment, the current disclosure provides a flow separation technique developed to enhance air convection.

The current disclosure was inspired by drip irrigation used in the agriculture sector to develop a local on-demand water dispensing technology to minimize water consumption. FIG. 1 shows a schematic of one embodiment of a sweating-boosted air cooled heat-pipe condenser 100 of the current disclosure. To further reduce the ACC size, as shown in FIG. 1, a heat-pipe condenser architecture 102 is proposed. Architecture 102 is similar to that of the most effective once-through cooling (OTC), but replaces water tubes with highly conductively heat pipes 104. While two heat pipes 104 are shown, more or less pipes are considered within this disclosure such as 3, 4, 5, 6, 7, or more pipes. Highly conductive heat pipes 104 comprise novel hybrid microscale wicks/fins 106 that can effectively manage the condensate temperature. Moreover, heat pipes 104 are highly reliable and maintenance-free as validated by electronic cooling and waste heat recovery applications. Additionally, the long-lasting dropwise condensation 108 can be enabled by (1) robust coatings, such as atomic layer deposition (ALD) NiO coatings, or (2) optimized hydrophilic-hydrophobic patterned surfaces which can achieve up to 200% higher condensation HTC compared to dropwise condensation on fully hydrophobic surfaces and hence will greatly enhance condenser 112 efficiency and reliability, and reduce condenser size.

The liquid spreading to wicks/fins 106 will be further enhanced by novel nanowick coatings 110 developed from partially hydrophilic coatings, such as for purposes of example only $TiO_2$ coatings and partially hydrophobic carbon nanotubes (CNTs). Most recently, we demonstrated that green Patina, which consists of an inner layer of cuprite ($Cu_2O$) and an outer layer of brochantite ($Cu_4So_4(OH)_6$) is more suitable for this application considering its cost and durability.

Nanowick technology has been demonstrated to generate extremely high capillary force to assure uniform liquid distribution and significantly enhance nucleate boiling. Per the current disclosure, in a preferred embodiment, $TiO_2$ coated CNTs are employed. This paring has attractive intrinsically self-cleaning features that result from their low surface energy, photoinduced superhydrophilic transition, and active interface in decomposing organic matters, as well as ability to destroy waterborne bacteria and viruses. Such a self-cleaning heat transfer surface is highly desirable in keeping designed HTC and preventing scaling/fouling for long-term operations of ACC for power plants.

The proposed novel condenser 112 can effectively maintain the initial temperature difference approximately 10° C. through carefully optimizing three key heat transfer processes: heat acquisition via long-lasting dropwise condensation, heat transport from steam to the air-side through heat pipes, and finally heat rejection by sweating-boosted air cooling. The proposed novel condenser 112 of the current disclosure can fully meet cooling needs. However, to improve the system robustness, additional water cooling loops with approximately 10% of cooling capacity may be included, particularly, to manage the temperature of condensed steam on the hottest days to stabilize turbine backpressure.

Figure 3:
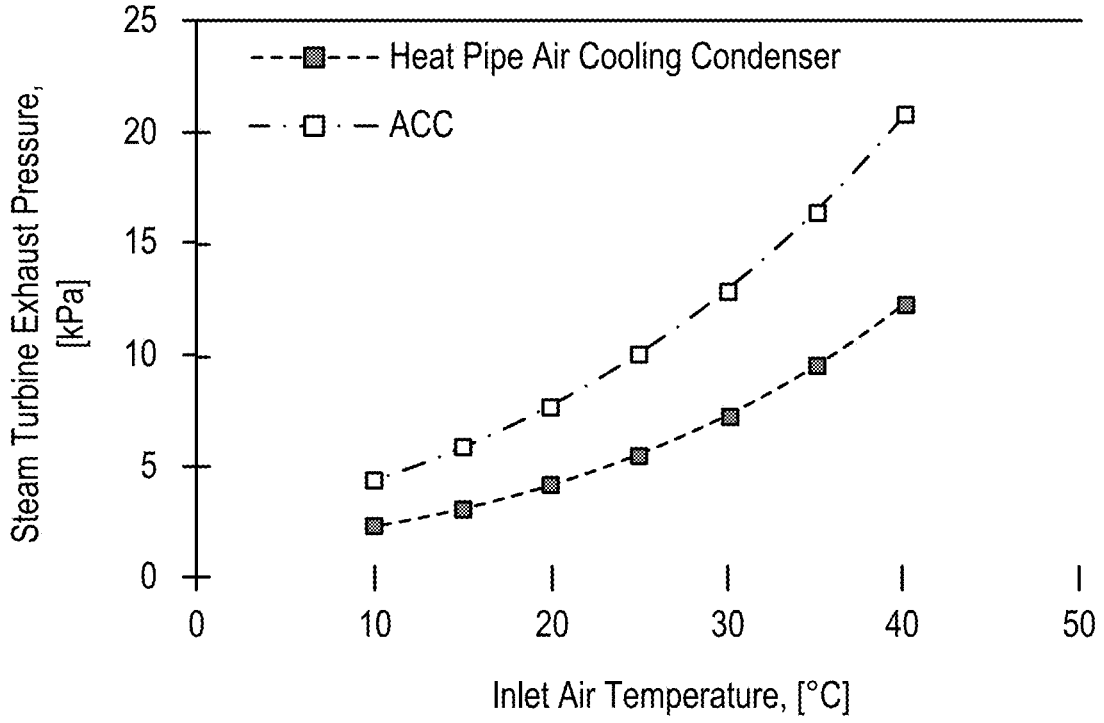
FIG. 3 shows predicted turbine exhaust pressure resulting from the proposed condenser versus ACC for a 500 MW Coal Fired Steam Power Plant with a heat load of 732 MW.

The current disclosure shows that, as summarized in Table 1, see FIG. 2, through the use of latent heat in an innovative way, the proposed condenser 112 can achieve significantly high overall heat transfer coefficient (HTC) and hence enable a drastic reduction of the ACC footprint (~52%) and potential capital cost (up to 67%). The water use is only 33% that of cooling tower technology. More importantly, as illustrated in FIG. 3, power production penalty on hot days can be minimized by effectively controlling the condensate temperature. As illustrated in FIG. 3, the proposed novel condenser can significantly reduce the exhaust pressure of steam turbine and hence manage the power production penalty compared to current ACC. The proposed novel condenser of the current disclosure could be one of the most suitable solutions to retrofit the popular OTC since they share a similar architecture.

For all cooling systems, performance, which is determined by the continuous and consistent capability to dissipate required waste heat to achieve the steam condensate temperature corresponding to the optimal turbine backpressure, is evaluated by the transport of maximum heat load as well as by the capability to operate over a broad range of environmental conditions. To achieve these goals, the current disclosure addressed five major research tasks: 1) designing and evaluating condensers in a virtual test bed (VTB) environment; 2) devising sweating-boosted air cooling; 3) developing high performance heat pipes as the core of the condensers; 4) enabling long lasting dropwise condensation for heat acquisition; and 5) benchmarking modeling in a lab scale condenser.

Task 1: Design and Evaluate the Proposed Condensers in a VTB. VTB is a computational environment for modeling, dynamic simulation, and virtual-prototyping of large-scale, multi-disciplined systems. It allows proof-testing of new designs prior to hardware construction. It supports system-level simulations in power generation system, power electronics system, thermal system, heating, ventilation, and air conditioning (HVAC) system, etc. The goal of this task is to evaluate system level impact, i.e. impact on the entire power plant, of the proposed heat pipe based air cooled condensers.

VTB is fully capable of simulating the thermal cycles of power plants and a combined cycle for power generation was successfully modeled and simulated in VTB. That cycle combines a Solid Oxide Fuel Cell power generation system with a gas turbine power generation system. The start-up behavior, part-load performance and other working conditions were able to be simulated. Thermal models were developed to simulate HVAC systems. Some of those thermal models, such as the evaporator or condenser model, can be readily incorporated into the current disclosure's design to the entire system. In addition, VTB directly employs the NIST refrigerant data base, totally, 76 refrigerants are available for simulations. The thermodynamic and transport properties of the refrigerant can be accurately computed in VTB. This feature is important for modeling a two-phase heat exchanger at a system level and for heat pipes.

The current disclosure utilized VTB simulation capability to design and optimize the proposed condenser of the current disclosure together with a steam power plant. To implement this specific simulation, a generic steam turbine model and a validated air cooled condenser model were be developed. By connecting all the needed components, i.e., turbines, condensers, evaporator, regenerators, pumps, pipes, valves, etc., together in the VTB environment, the combined system can be simulated. This virtual-prototyping system can be used to perform case studies, to facilitate evaluation of working refrigerants, to evaluate component performance, and to optimize the size of the heat exchangers to generate an optimum cost-effective design for the air cooled condenser.

To further improve the efficiency of power plants and provide an extra route to manage the fluctuation of back pressure caused by high ambient temperature, a secondary Organic Rankine Cycle (ORC) was considered to recover waste heat and tested in VTB. Approximately, 4% (1st order estimate) more power may be obtained at an annual average air ambient temperature of 25° C. for ACC. The payback is estimated to be approximately five years. Several working fluids such as R245fa and R134a were be systematically examined. The performance of the secondary ORC will also be evaluated with the proposed novel hybrid condenser design.

Task 2: Develop Sweating-Boosted Air Cooling. As discussed supra, solid fin heat sink is the most popular air-cooling technology because of its economics and moderate performance. High fin-density foam and porous fin technologies have much larger surface areas than solid fin heat sink, which makes it possible to approach very high cooling performance. The drawback of such heat sinks is their high flow resistance. In fact, it is well known that there is no net gain if only surface area is increased. Thus, significant improvements cannot be met by just increasing heat transfer area.

Figure 4:
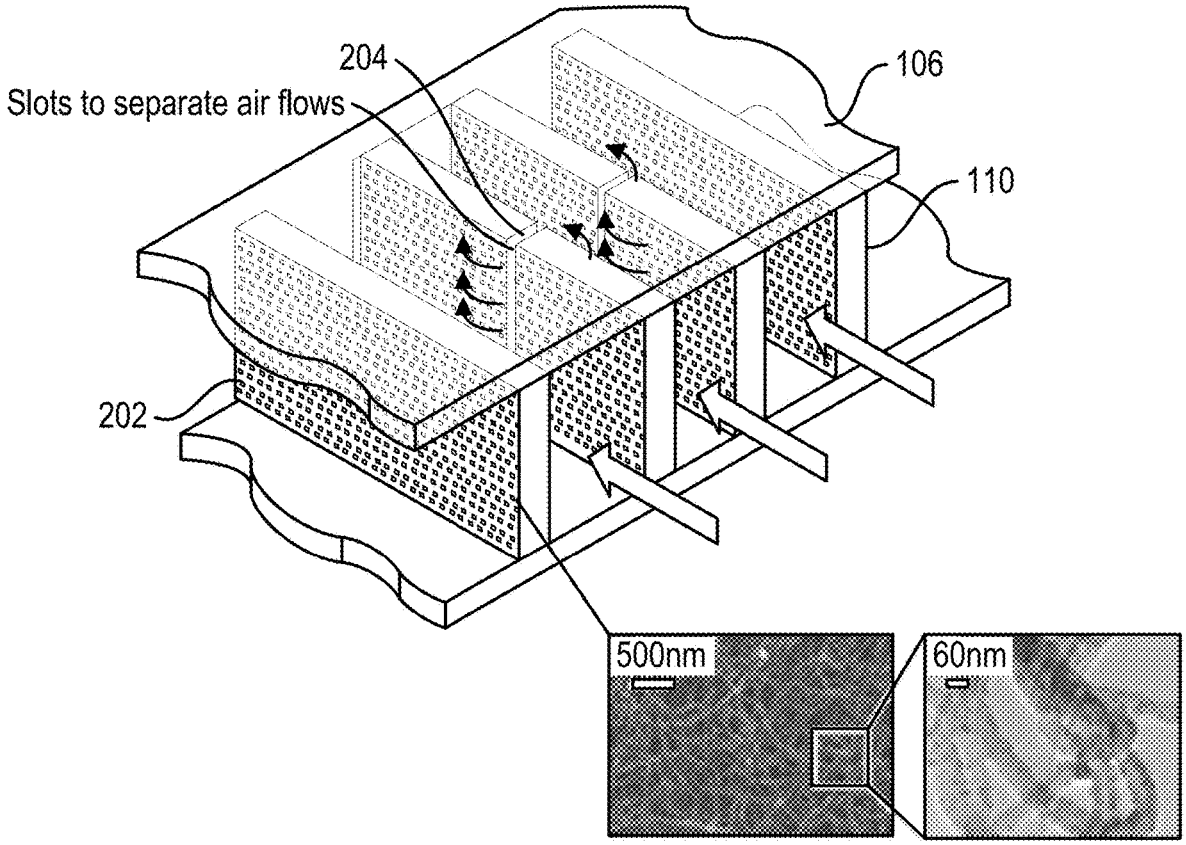
FIG. 4 shows nanowicks developed from partially hydrophilic and hydrophobic carbon nano tubes (CNTs) will be integrated on fins.

By using latent heat, the current disclosure presents an opportunity to break such a no-gain situation. As illustrated in FIG. 4, a novel sweating-boosted air cooling strategy by integrating nanowicks 202, drip water delivery system and flow separation technique, see air slots 204, is proposed. The enhanced air cooling is from the introduced evaporation and flow separation technique. In order to develop efficient and durable air cooling surfaces by inducing evaporation and manage scaling, nanowicks developed from partially hydrophilic and hydrophobic carbon nanotubes (CNTs) will be integrated on fins 106, see FIG. 4. Convection enhancement and pressure drop management can be well balanced by separating air flows, see FIGS. 4 and 5. The major projected enhancements are summarized in Table 2, see FIG. 6.

Figure 7:
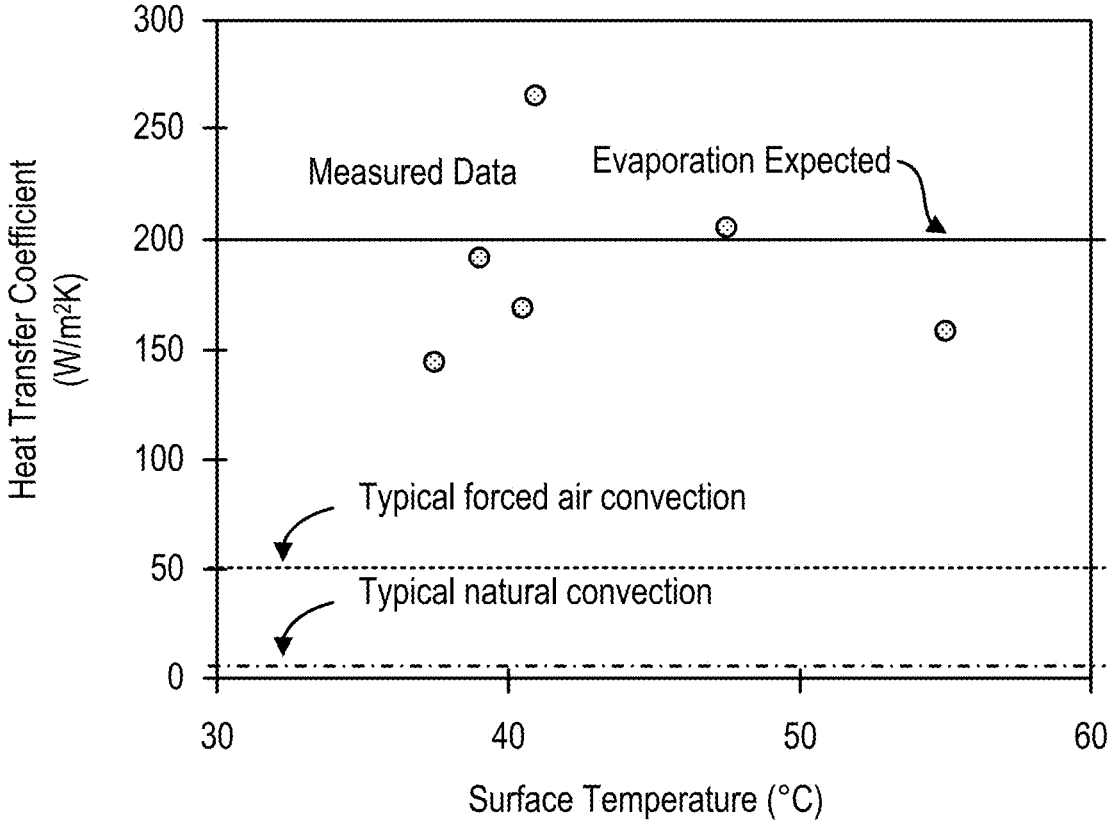
FIG. 7 shows a preliminary experiment of sweating-boosted air cooling using a hot plate.
Figure 8:
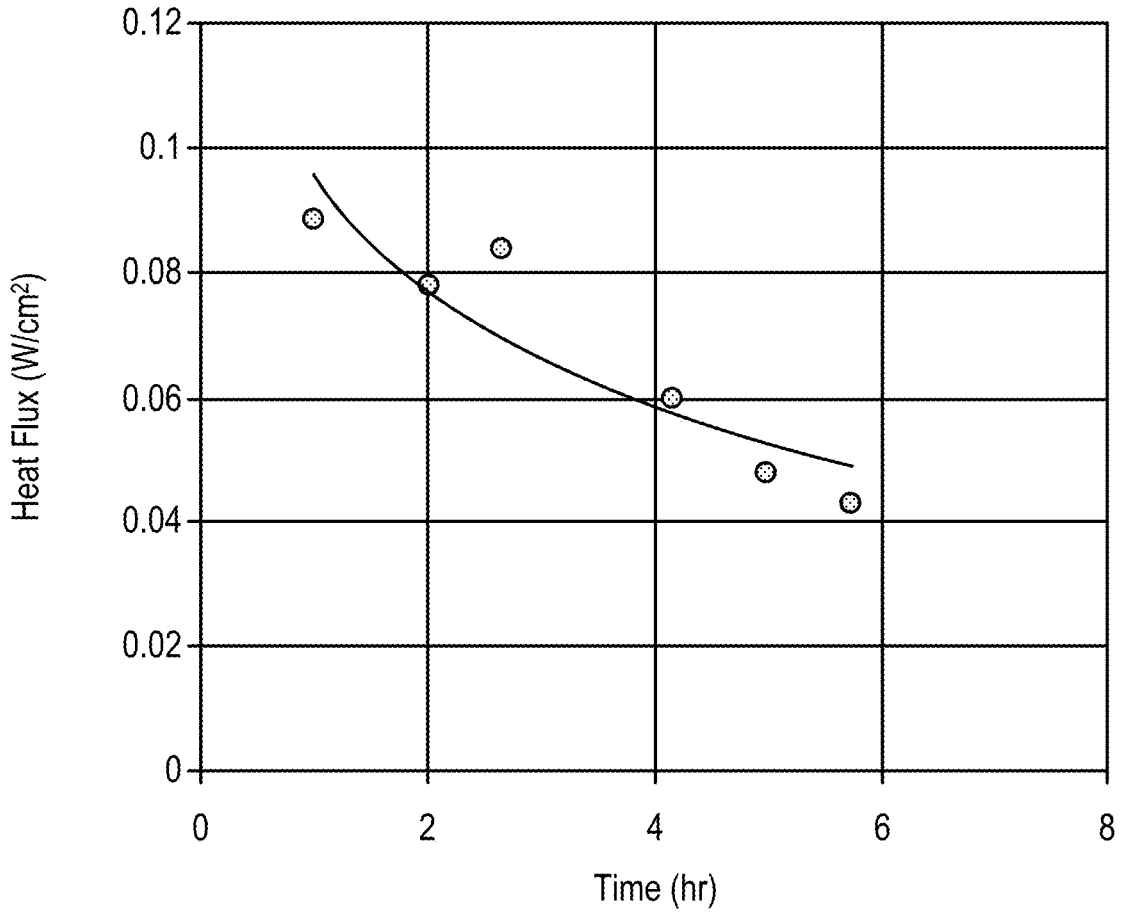
FIG. 8 shows a duration test of sweating-boosted air cooling.

Sweating-boosted cooling. Sweating is a primary mechanism of mammals to effectively dissipate heat during physical exercise. The current disclosure demonstrated a 200 $W/m^2K$ evaporation heat transfer in a natural convection setting. As shown in FIG. 7, it has an approximately four times improvement from forced air convective heat transfer. It should be noted that the effective evaporation heat transfer lasted for over 6 hours w.r.t. a 0.04 $W/cm^2$ heat flux without any additional water supply, see FIG. 8, which means a huge reduction in water consumption.

Figure 9:
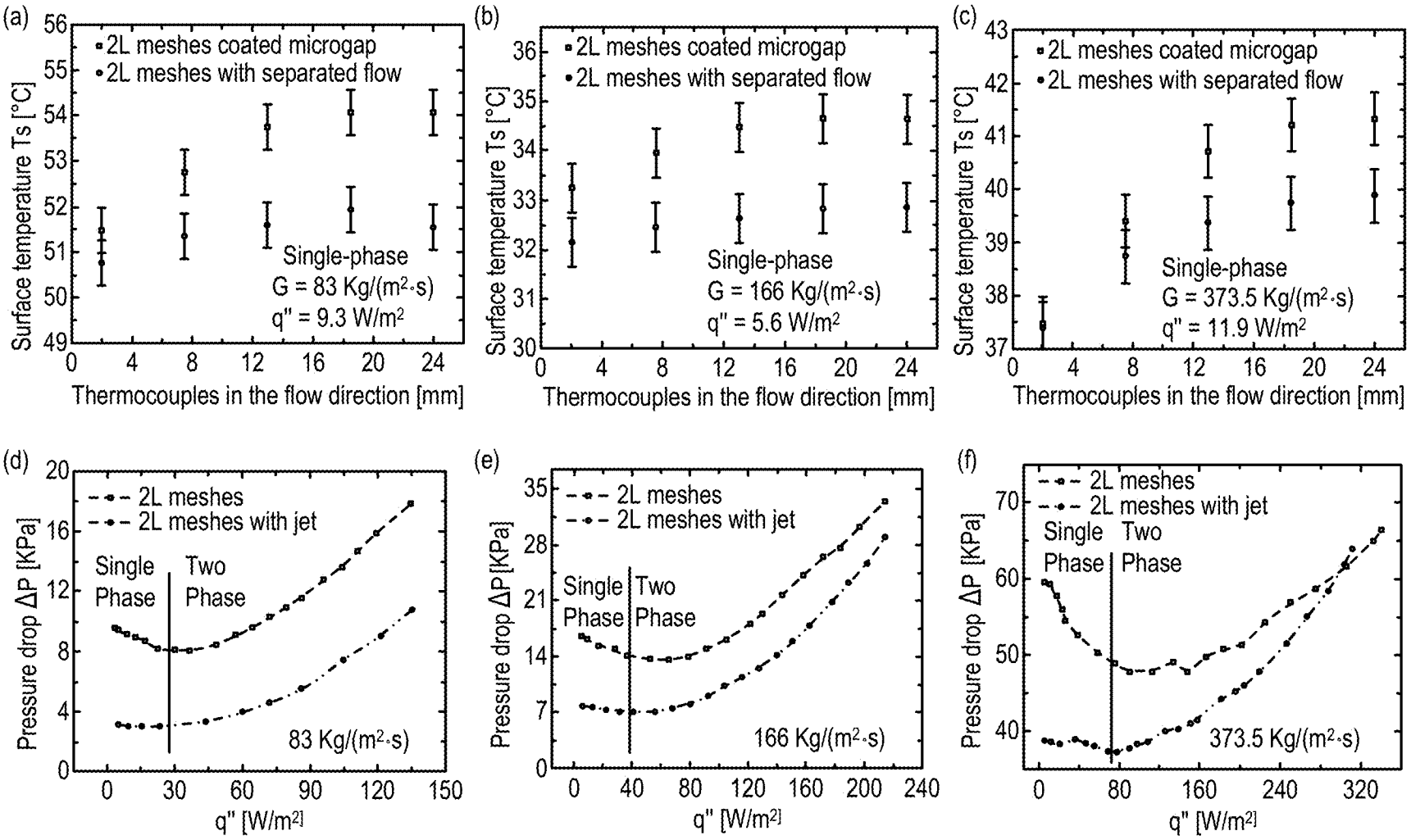
FIG. 9 shows graphs demonstrating that flow separation can significantly enhance single-phase convection with a reduced pressure drop.

Enhance air convection by flow separation technique. FIG. 9 shows flow separation can significantly enhance single-phase convection with a reduced pressure drop. The most effective way is to enhance single-phase convection heat transfer is to reduce the thickness of boundary layers. This can be achieved using finned surfaces and porous media; however, these techniques usually result in high flow resistance. As shown in in FIG. 9, single-phase convection can be significantly enhanced, see FIG. 9, graphs A-C, by separating flows via a nozzle on the top wall in a microgap, more importantly, with more than 50% reduction in the pressure drop, see FIG. 9, graphs d-f. This enhancement is due to: 1) the effective disruption of boundary layer growth; and 2) the effective reduction of flow distance.

Water supply by drip irrigation. To improve water use efficiency and reduce environmental impact, nozzles similar to that developed for drip irrigation are used to supply water for evaporation on the fins of the current disclosure. The modern development of drip irrigation, which started in Great Britain during World War II and continued in Israel and other countries, has the potential to use scarce water resources most efficiently to produce vegetables. Drip irrigation has the ability to apply low volumes of water to plant roots and enhance irrigation uniformity. The recent success of drip irrigation is due to the development of low cost plastic tubing, tapes, and clog-free emitters.

Although current cooling towers consume significantly less water than previous systems, they still use large volume of water due to evaporation because of overspray and drift loss. Additionally, water treatment and scaling/deposition are challenging issues. The promise of drip irrigation in reducing water consumption provides a validated solution to enable an economic and controllable water supply mechanism to fins. This innovative liquid supply mechanism has great potential to address the requirements faced in ACC: 1) high HTC in the air side; and 2) minimum use of water. Equally important, the scaling/deposition issues can be addressed by the self-cleaning feature of CNT-nanowicks in combination of water chemistry control and suitable operation and maintenance procedures.

Figure 10:
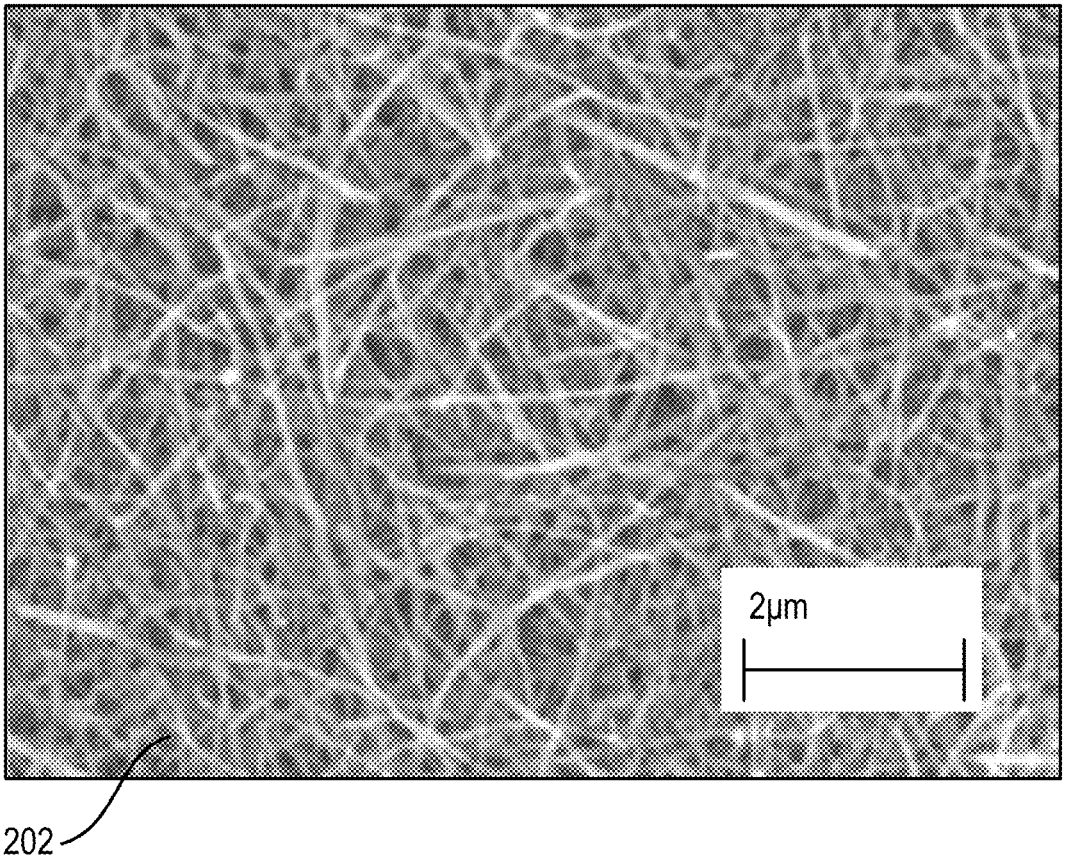
FIG. 10 shows an electron microscope image of a top surface of a CNT coating produced by EPD from an aqueous suspension.
Figure 11:
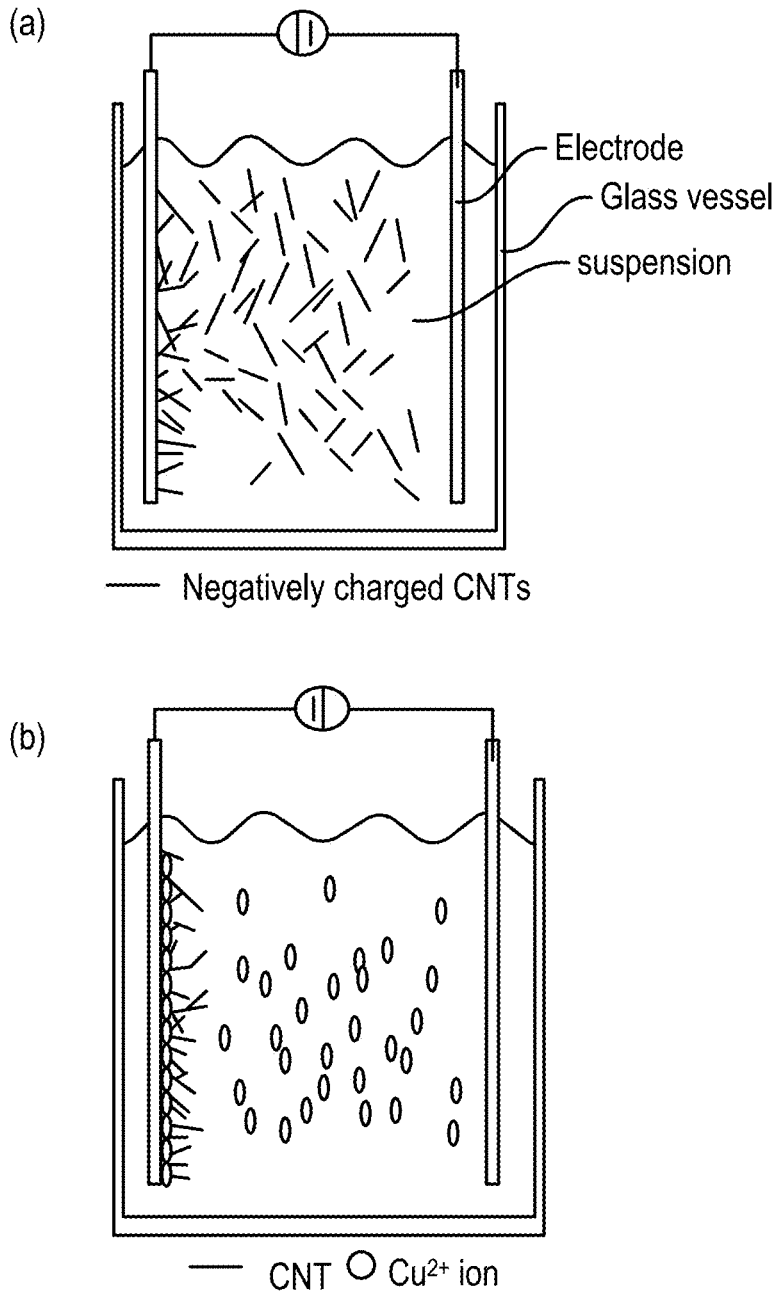
FIG. 11 shows electrophoretic coating of a CNT followed by copper electroplating.

Task 2.1: E-coated Nanowicks. After establishing the critical function of the nanostructured coating for evaporation cooling, the current disclosure focuses on improving the mechanical robustness, reliability, and stability of the coating by optimization of a scalable manufacturing process, which is critical for industrial applications. The nanostructure coating may be manufactured using an electrophoretic deposition (EPD) process, see FIGS. 10 and 11. This proposed low-cost fabrication method is amenable to coat convoluted surfaces (e.g., inside and outside surfaces of boiler tubes), and can be applied to modify existing heat recovery systems or to develop new products.

Advantage of EPD coated nanowick. The current disclosure uses an electrophoretic deposition method as the primary route to coat nanowicks. EPD is a mature scalable industrial coating process, where charged colloidal particles suspended in a solvent migrate and deposit onto an electrode under an applied electric field. The electrically conductive substrate, typically metal, will naturally serve as an electrode for EPD. EPD has been shown to be a convenient method to fabricate coatings of carbon nanotubes and graphene with desired thickness and great macroscopic homogeneity, FIG. 10. EPD, when used to apply thin-film primers and one-coat finish to metallic substrates, is often referred to as Electrocoating or E-coat. It is the current method of choice in automotive industries for applying base coat to car frames. The ink is typically water based. The overall process consists of four main steps: (1) surface cleaning and pretreating, (2) electrocoating, (3) rinsing, and (4) curing/baking. The EPD process may be either anodic or cathodic, depending on the charge applied to the substrate. The cathodic EPD deposits ink onto negatively charged substrates, it reduces metal dissolution from the substrate, offering better corrosion resistance. The EPD coating produces very even coatings and can coat highly complex surfaces.

One-step water-to-vapor conversion on the cooling fin will inevitably result in concentration of salt and other corrosive matter on the surface of the fin. Neither aluminum nor copper fin can survive direct salt exposure without corrosion. In order to implement the proposed cooling method, the fin coating has to provide adequate corrosion protection to the underlying fin. The E-coated nanowick will also help breakdown the organic species without residue or sludge, by taking advantage of the excellent of photocatalytic activity of high surface area $TiO_2$. The hydroxyl radicals are particularly effective in decomposing organic matters. $TiO_2$ photocatalysts can also effectively destroy waterborne bacteria and viruses, thus disinfecting contaminated water and resisting fouling.

Proposed EPD coating procedure. To support both water wicking and corrosion-protection function, the current disclosure deposited a coating with two layers. Both layers will be applied on the metal substrate using the E-coating process. The first deposited layer will be a thin (~10 micron) and dense polyurethane (PU) based organic corrosion protection coating. A small fraction of CNT (1 wt %) will be added to this layer to improve scratch resistance, to increase thermal conductivity, and to impart electronic conductivity which facilitates the follow-on EPD coating. After coating the first layer and before drying and baking, a second layer of $TiO_2$ functionalized CNT with a small fraction of polymer resin (PU) will be deposited to form a porous layer that promotes the wicking function. The dual-layer coating will be cured in one baking/curing step to promote intimate bonding. The hydrophilic-hydrophobic properties of the top layer may be adjusted by tailoring the amount of $TiO_2$ coating on the CNT.

Subtasks A. Preparation of $TiO_2$ coated CNT. $TiO_2$ functionalized CNT will be prepared using the following procedure. Multi-wall CNTs will first be treated in a concentrated mix of equal volumes for nitric and sulfuric acid to functionalize their surface with oxygen anion groups and remove impurities. Then oxidized CNT will be washed before dispersion in a sol-gel with metal alkoxides. Isopropanol (anhydrous) solvent will be mixed with solids and appropriate amounts of titanium (IV) isopropoxide and in some cases niobium (V) ethoxide under reflux at 80° C. for 2 hours. Then de-ionized water will be added slowly. The hydrolysis, condensation, and oxide growth reactions will be controlled using procedures known to those of skill in the art. After solvent evaporation, the $TiO_2$ coated CNT will be calcined in $N_2$ at 450° C. for 2 hours to induce ordering and phase transformation. The loadings of metal oxide can be controlled by varying ratio of carbon to titanium [C:Ti], e.g., [10:1] and [100:1], including ranges within these ratios, such as 10:10; 10:20, 10:30, 10:40, 10:50, 10:60, 10:70, 10:80, 10:90, 90:10, 80:10, 70:10, 60:10, 50:10, 40:10, 30:10, 20:10, etc. In addition, doping of $TiO_2$ will attempt to vary the band gap of the oxide in order to enhance the photocatalytic activity under typical sun lighting. Specifically, addition of 10% Nb donor doped $TiO_2$ ($Ti_{0.9}Nb_{0.1}O_{2-x}$) will be studied.

Subtask B. Cathodic EPD coating. Before coating, the metal substrate will be cleaned and acid etched, followed by a chromate or phosphate surface treatment. Commercially available waterborne PU resin dispersion from BASF company (CATHOGUARD 500) and amine functionalized multi-wall carbon nanotube (positively charged) will be used in the initial study. The dispersion stability of CNT in water based solvent will be first investigated, if necessary surfactant will be applied to help disperse CNT in water. The stable pH range and the zeta potential of the ink will be quantified. The CATHOGUARD and CNT dispersion will be ultrasonically mixed before cathodic EPD. The coated substrate will be rinsed before applying the second EPD layer. The second layer coating will be carried out in a separate EPD bath that consists of $TiO_2$-CNT dispersion mixed with a small fraction of PU resin. To facilitate cathodic EPD, the surface charge on the $TiO_2$-CNT will be adjusted to positive by adding salt comprising a divalent cation (e.g. Mg2+). For both coating steps, the time and applied voltage will be controlled to achieve a desired coating thickness. The finished coating will be rinsed with DI water, dried and baked in a vacuum oven to cure the PU resin.

Task 2.2: Modeling of sweating evaporation. The heat and sweat transport in nanowicks with phase changes is a complex process since it involves non-isothermal, multi-phase and multi-component fluid flow phenomena. The phase change, condensation/evaporation and nanowick capillary action play important roles in governing sweating cooling. Even though, mathematical modeling for heat and moisture transfer in textile materials has been extensively studied, the heat and sweat transport in partially hydrophilic and partially hydrophobic nanoporous materials has not been investigated. The challenge is from: 1) the complex water distribution that is determined by both of the phase change and surface wettability; and 2) nonlinear, coupled and degenerate parabolic partial differential equations (PDEs) that govern transport processes.

To enable modeling, the hydrophilic and hydrophobic areas inside nanowick layers were assumed co-continuous and homogeneous. The heat and mass transport can be described by continuum-level conservation equations. The density of gas mixture is determined by the vapor density and air density. The velocity of the gas mixture, which is a function of the permeability, relative permeability, and local pressure gradient, is given by Darcy's law. The phase-change rate is defined by the Hertz-Knudsen equation. The evaporation rate depends on the liquid water stored in nanowicks. The absorption process in a wet environment is described by an evolutionary equation and is dependent on the water content and relative humidity. The maximal absorption at saturation can be experimentally determined. Both equilibrium and non-equilibrium thermodynamics model for phase and mass transfer will be studied. Both Dirichlet boundary condition (saturation condition for a given relative humidity) and Robin-type boundary condition (absorption smaller than saturation) will be examined in the evolutionary equation to better reveal sweating processes on $TiO_2$-coated CNTs.

Task 2.3: Design and characterization of novel fins. The current disclosure used numerical simulations to design its fin structures. The important parameters such as the number, location and size of slots are numerically determined. Simulation of single-phase laminar flow is mature and has been well established. In general the air flow rate in air cooling typically operates in the turbulent regime. Therefore, depending on the flow regime, i.e. laminar or turbulent, necessary physics is needed to be included. For turbulent flows a Large Eddy Simulation (LES) framework will be employed. However one of the challenges in LES modeling is the consideration of an appropriate wall model. (i.e. the wall layers are not numerically resolved but modeled). Accurate LES wall models for the single phase flow turbulent flow past fins will be developed and also compared against Direct Numerical Simulations (DNS) of near wall structures. A lab scale wind tunnel will be modified to experimentally characterize convection and used to improve fin design. The wicked fins with sweating cooling will be systematically characterized in the wind tunnel.

Task 3: Realization of Long-Lasting Dropwise Condensation. As discussed supra, dropwise condensation may be achieved on nano-structured surfaces. However, these surfaces are not suitable for applications on large surfaces because of the cost and limited service time. In this proposed program, nickel (Ni) alloy will be created by APS to enhance dropwise condensation and reliability of condensers. Several existing studies have demonstrated that dropwise condensation on Ni alloy can reach 30 $kW/m^2 \cdot K$, which is at least double the-state-of-the-practice. In this task, the effect of thickness and density of Ni coatings on dropwise condensation will be systematically studied to achieve the best optimization of heat transfer and surface robustness.

Figure 12:
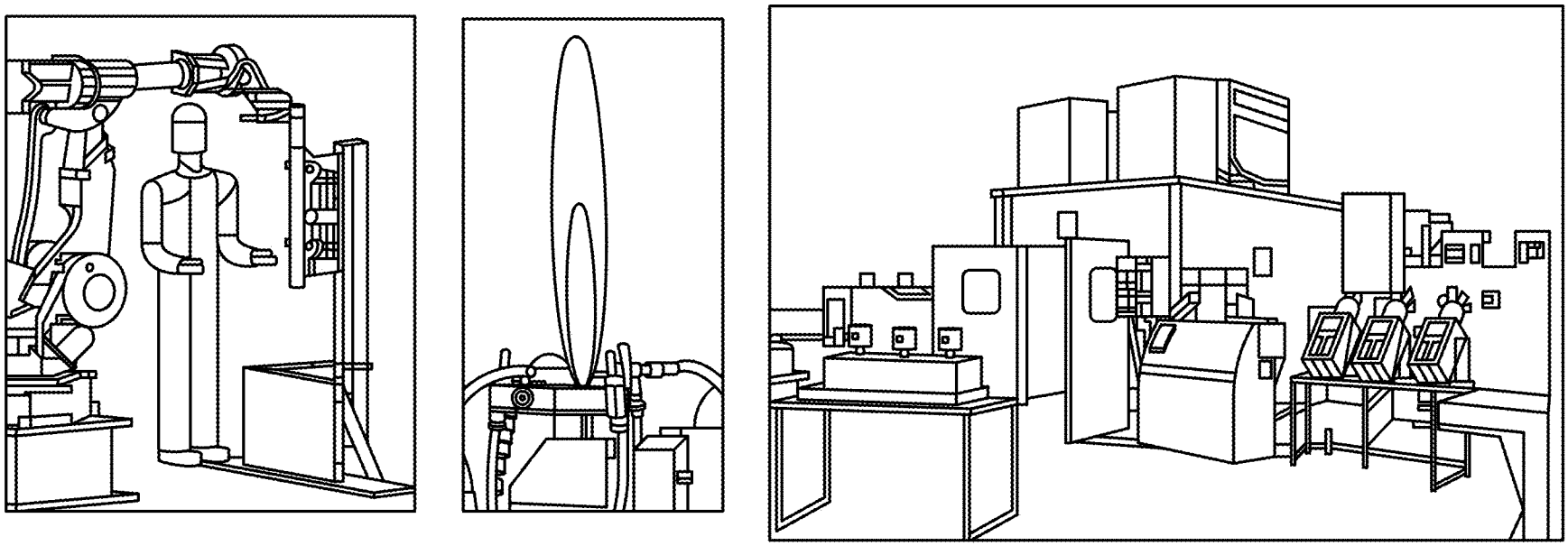
FIG. 12 shows a schematic of a robotic APS system and spray booth.

Task 3.1: Fabrication of robust dropwise condensation surfaces. Atmospheric plasma spray (APS) is a process of spraying molten or heat softened materials onto a surface to provide a coating. Material in the form of powder is injected into a very-high-temperature plasma flame where it is rapidly heated and accelerated to a high velocity. The hot material impacts on the substrate surface and rapidly cools to form a coating. If the APS gun is mounted on a robotic arm, a large surface area can be coated by programming the traveling pattern. FIG. 12 shows a schematic and photos of a robotic APS system and spray booth. The resultant APS coatings have the characteristics of robustness, strong adhesion and excellent wear-resistance. Therefore, APS has been widely used to manufacture thermal barrier coatings for the turbine industry.

The current disclosure uses APS coating technology to fabricate a thin layer of Ni on the external surface of a Cu cooling tube as a means of promoting long-lasting dropwise condensation. Ni metal is known to be an excellent material for condensing water vapor without forming a heat-transfer resistant vapor-phase boundary layer on the surface. Thin coatings produced by conventional coating methods such as electroplating usually have a short service life in harsh conditions like steam flow in power plants. APS is expected to produce high quality robust Ni coatings for extended service life.

Per the current disclosure, two properties of the coating are deemed critical to dropwise condensation HTC and duration: the thickness and density of Ni coatings. There exists a balance between these two properties in which heat-transfer performance and service life can be best optimized. Therefore, the current disclosure provides a series of Cu based coupon samples with a different combination of thickness and density. This parametric study can be easily conducted by adjusting the process parameters of APS, including the number of passes, plume temperature and particle velocity. The fabricated coupon samples will then subject to measurements of heat-transfer coefficient and duration.

Task 3.2: Characterize dropwise condensation. The condensation experiments will be conducted on the test setup shown in FIG. 13. The experimental study will be performed inside a $10 \times 15 \times 15$ $cm^3$ closed chamber at atmospheric pressure. The aluminum test chamber's walls are heated to prevent condensation on the inner side of the chamber during the experiment using four cartridge heaters, which are mounted at the four lower corners of the chamber and controlled by a proportional-integral-derivative (PID) temperature controller. The PID temperature controller will also be used to accurately control the water temperature to generate steam. Both the water and the vapor temperatures are measured using T-type thermocouples.

Figure 13:
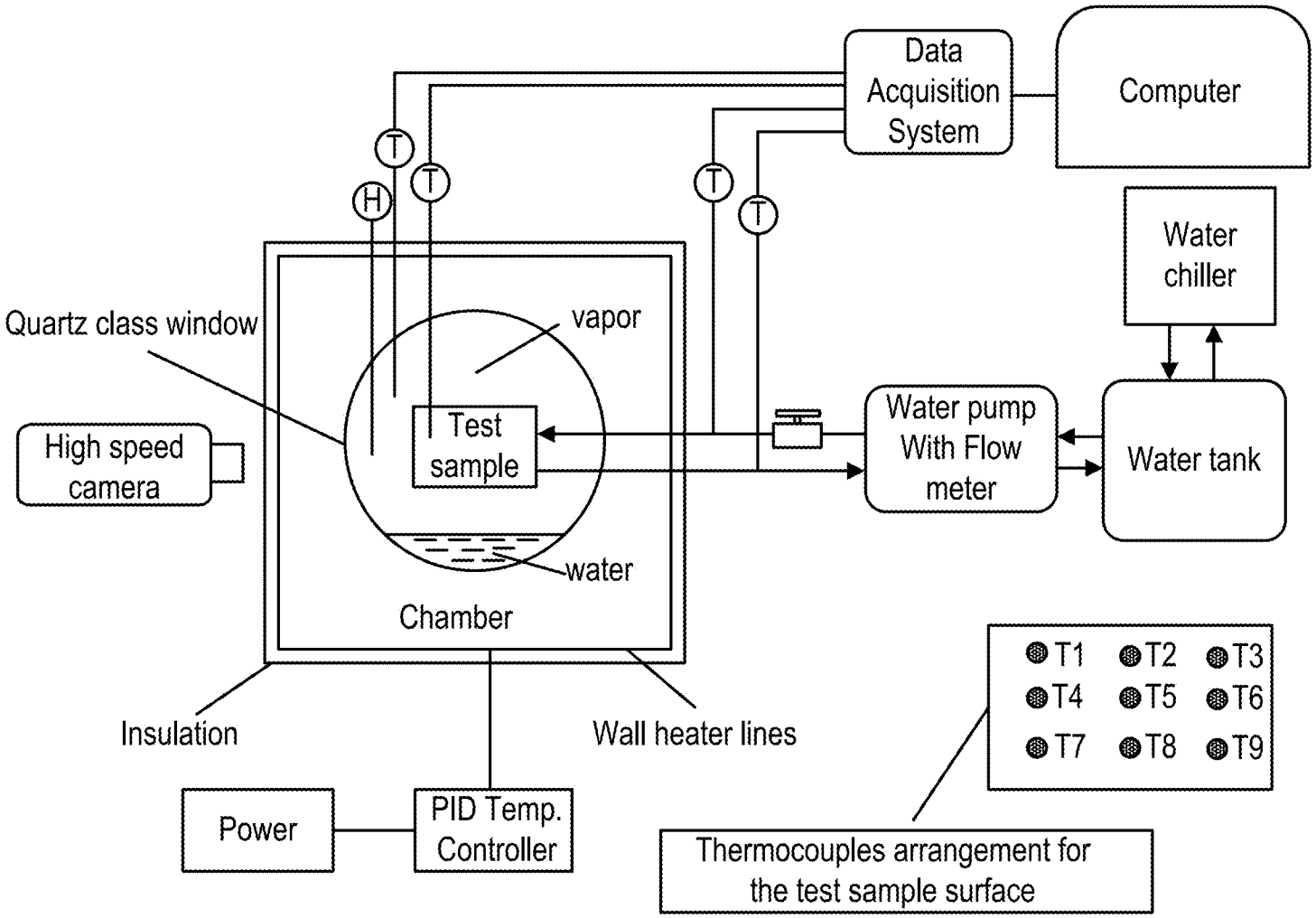
FIG. 13 shows a condensation experiment setup of the current disclosure.
Figure 14:
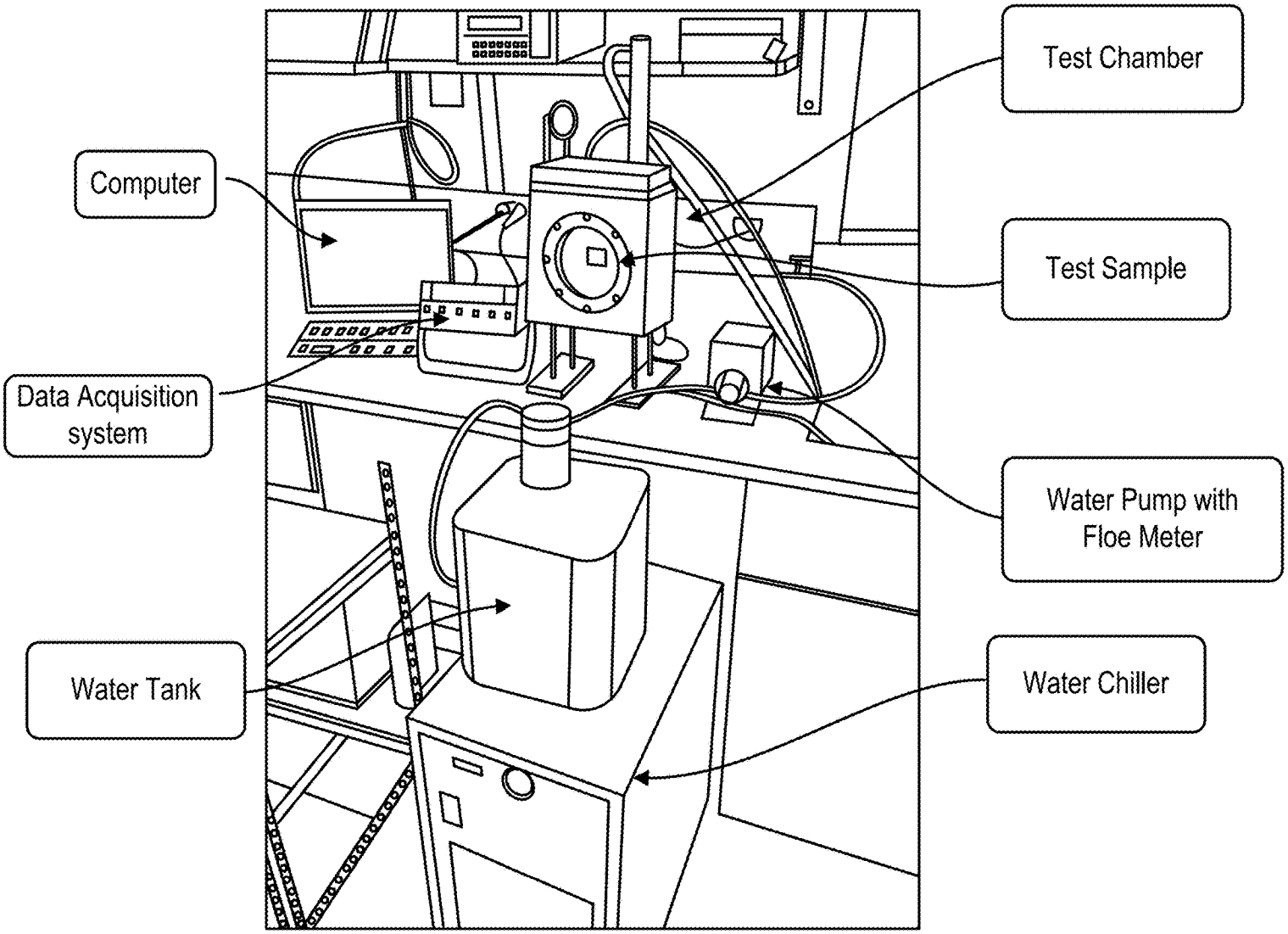
FIG. 14 shows a schematic and test rig for condensation experimentation.

The test sample will be placed vertically inside the chamber above the water level and facing the chamber's glass window allowing for visualization. A high speed camera (Phantom V 7.3) and infinity K2/SC long distance micro port body (VRI-INFINITY-K2SC) will be used to capture the drop dynamics. The copper sample that consists of a condensation surface side and a cooling side, shown in the FIG. 13, will be placed in high temperature polycarbonate plastic housing. The cooling side is cooled by chilled water (NASLAB CFT-33). The flow rate can be adjusted by a micro-pump (ISMATIC GA-X23.CFS.B). Using the micro-pump and the water chiller both the desired coolant flow and temperature can be maintained. On the condensation surface, nine thermocouples will be arranged and embedded beneath the surface to measure the surface temperature distribution, as shown in FIG. 13. The sample housing inlet and outlet cooling water temperatures will be measured using K-type thermocouples. With the cooling water inlet and outlet measured temperatures that allow determining the heat transfer rate on the cooling side, the working heat flux can be calculated. FIG. 14 shows a schematic and test rig of the current disclosure.

Figure 15:
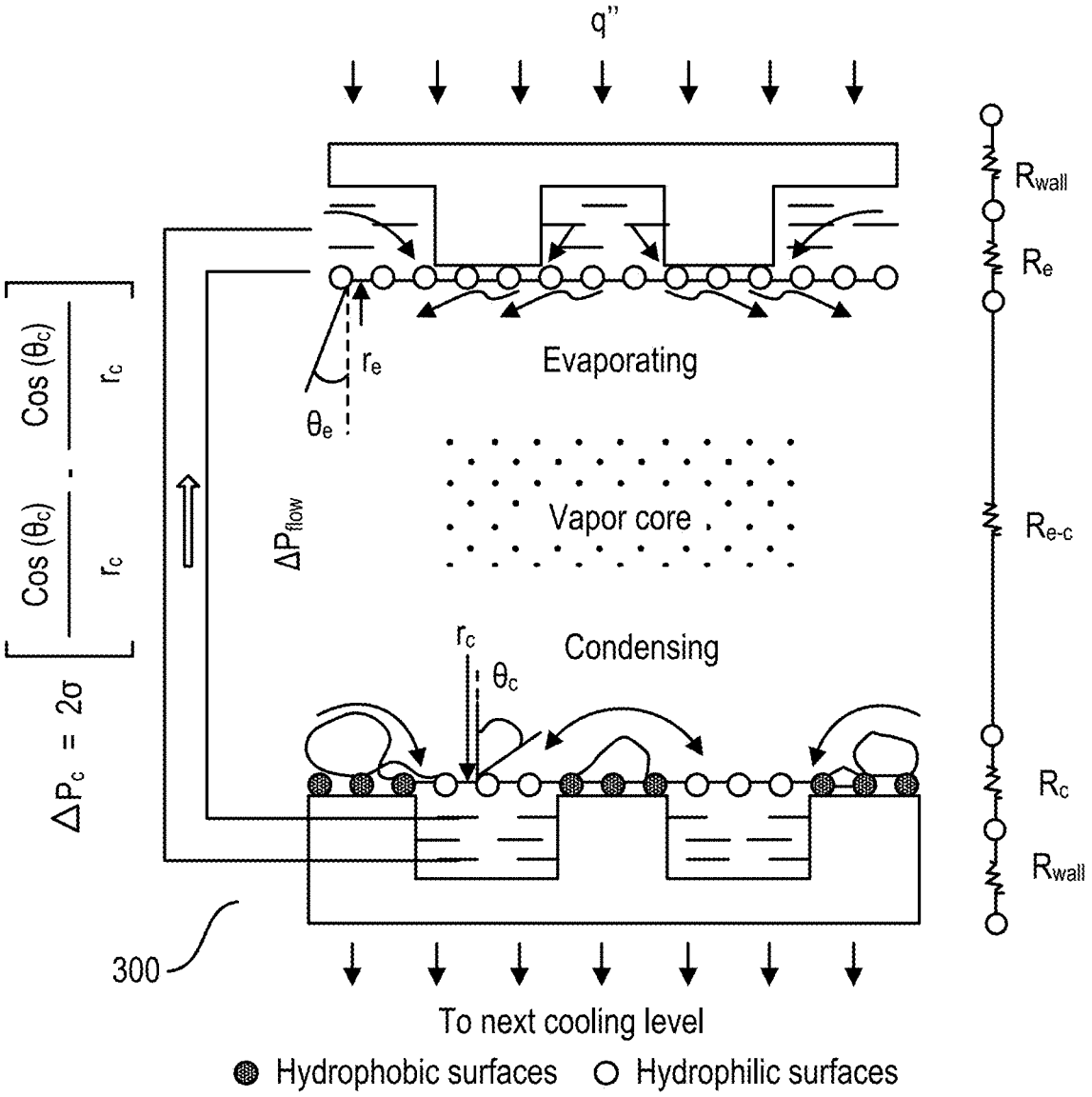
FIG. 15 shows a high performance heat pipe of the current disclosure.

Task 4: Develop High Performance Heat Pipe. The hybrid microscale wicking structure 300, FIG. 15, will be developed to enable high performance heat pipes with high effective thermal conductivity because of: a) ultrahigh heat transfer coefficients in evaporation and condensation, b) low flow resistance, and c) high capillary pressure to sustain operation in a long working distance environment.

Figure 16:
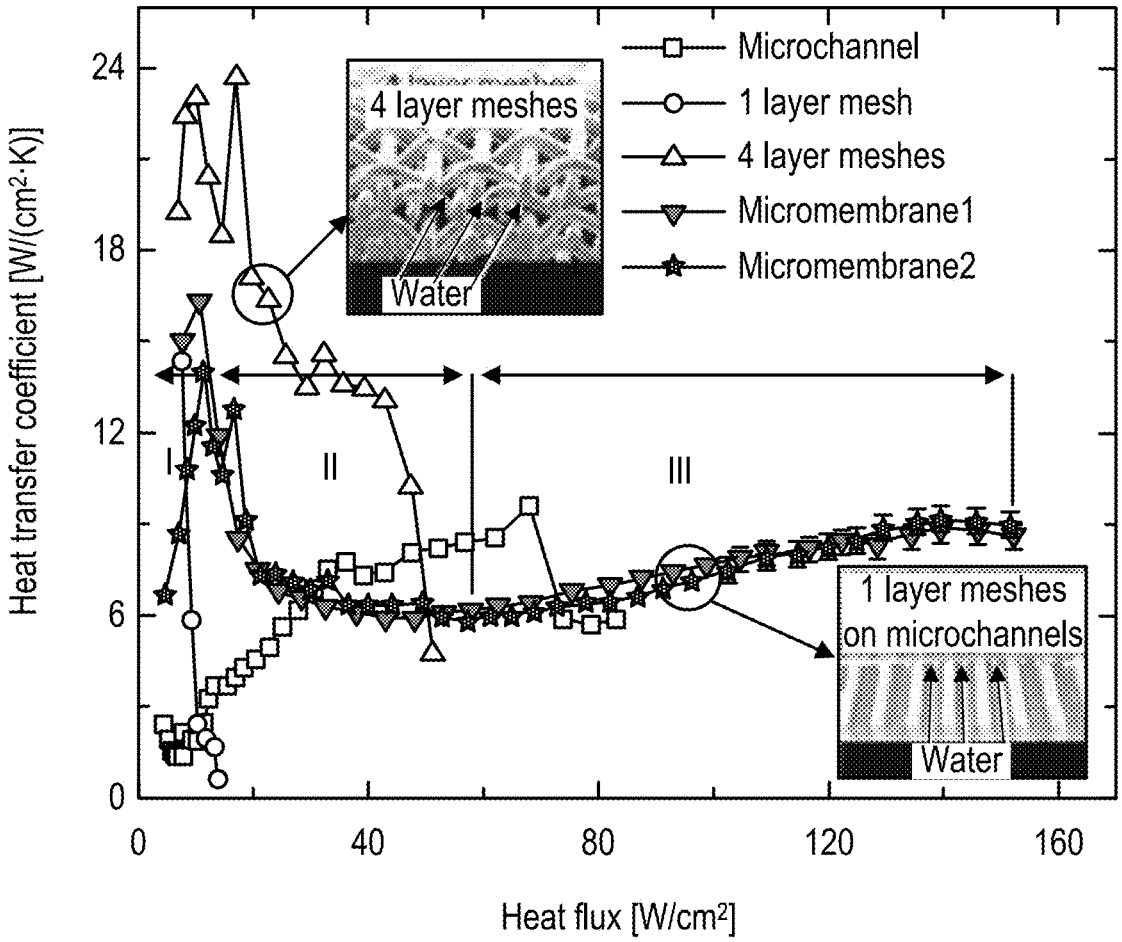
FIG. 16 shows evaporation heat transfer on hybrid wicks.
Figure 17:
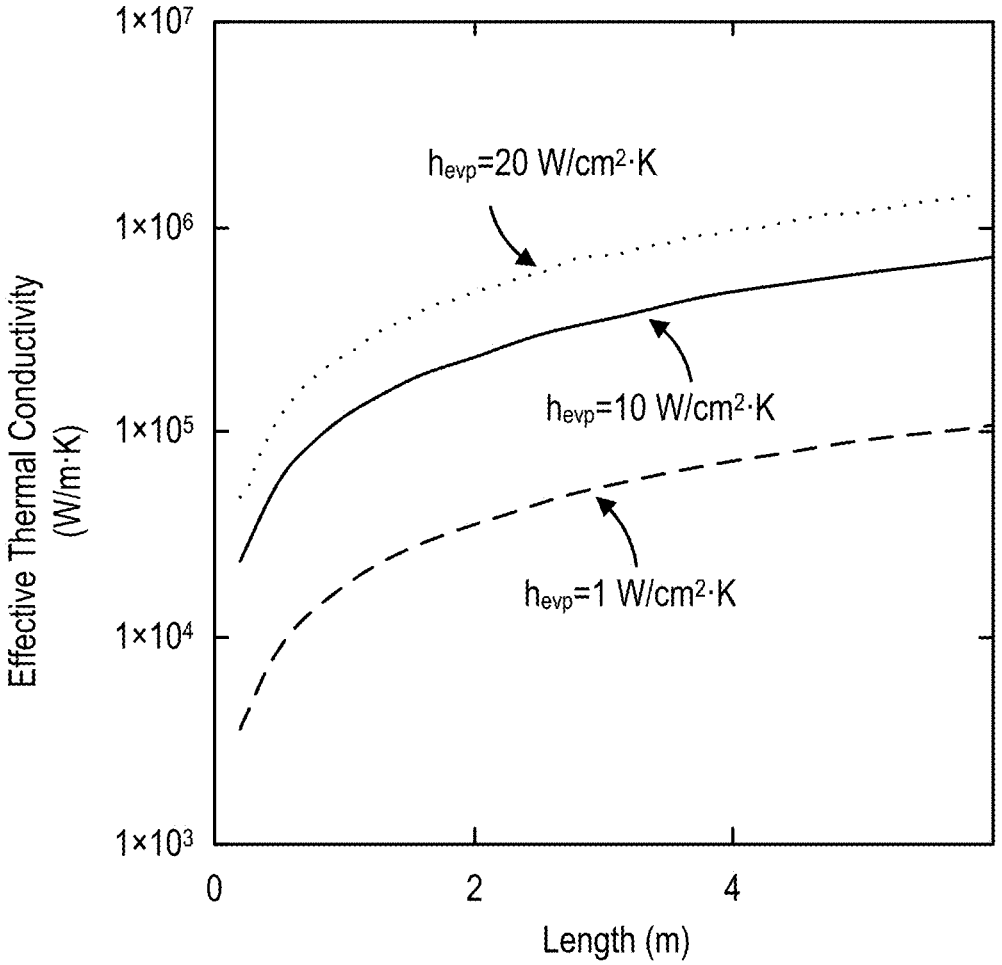
FIG. 17 shows predicted effective thermal conductivity of high performance heat pipes of the current disclosure.

Heat pipe performance was found to be greatly enhanced by applying modulated wick because of enhanced axial capillary liquid flows and extra evaporation surface area resulting from the cross-sectional area. Preliminary results show that the evaporation HTC on hybrid wicking structures can reach 15 $W/cm^2 \cdot K$, FIG. 16, at low heat flux regions. From a preliminary heat pipe modeling, the effective thermal conductivity of a 6-m long heat pipe with a diameter of 30 mm can approach 1000 $kW/m \cdot K$, FIG. 17, which means a thermal resistance as low as $5.6 \times 10^{-5}$ K/W. Based on the predicted thermal resistance, the proposed heat pipe technology could transport 10 kW heat over 6 meters with a temperature difference less than 1° C., which is highly desired to reduce ITD down to 10° C.

Figure 18:
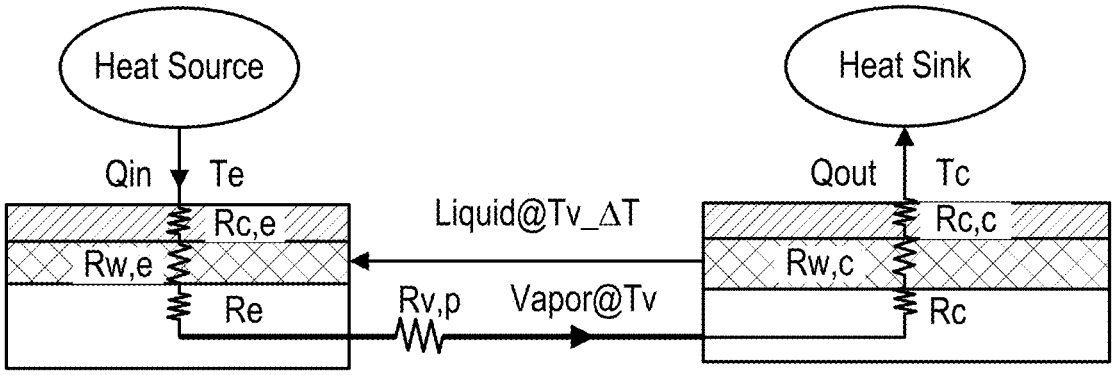
FIG. 18 shows a one-dimensional heat transfer model of a heat pipe with vapor generated from a hybrid evaporator and moved to a condenser through the vapor core.

Task 4.1: Modeling, fabrication, and characterization of heat pipes. The performance of a heat pipe is primarily governed by evaporation or condensation processes. The system's performance is also affected by many trade-off considerations. To articulate the governing physics, as shown in FIG. 18, the current disclosure has developed a heat transfer model to understand these factors and derive a first design to meet the end-of-program goals defined. FIG. 18 shows the one-dimensional heat transfer model, which is the first model ever developed for such a complicated system. From this model, the current disclosure may design and analyze the proposed higher performance heat pipes with an emphasis on the effective thermal conductivity.

Figure 19:
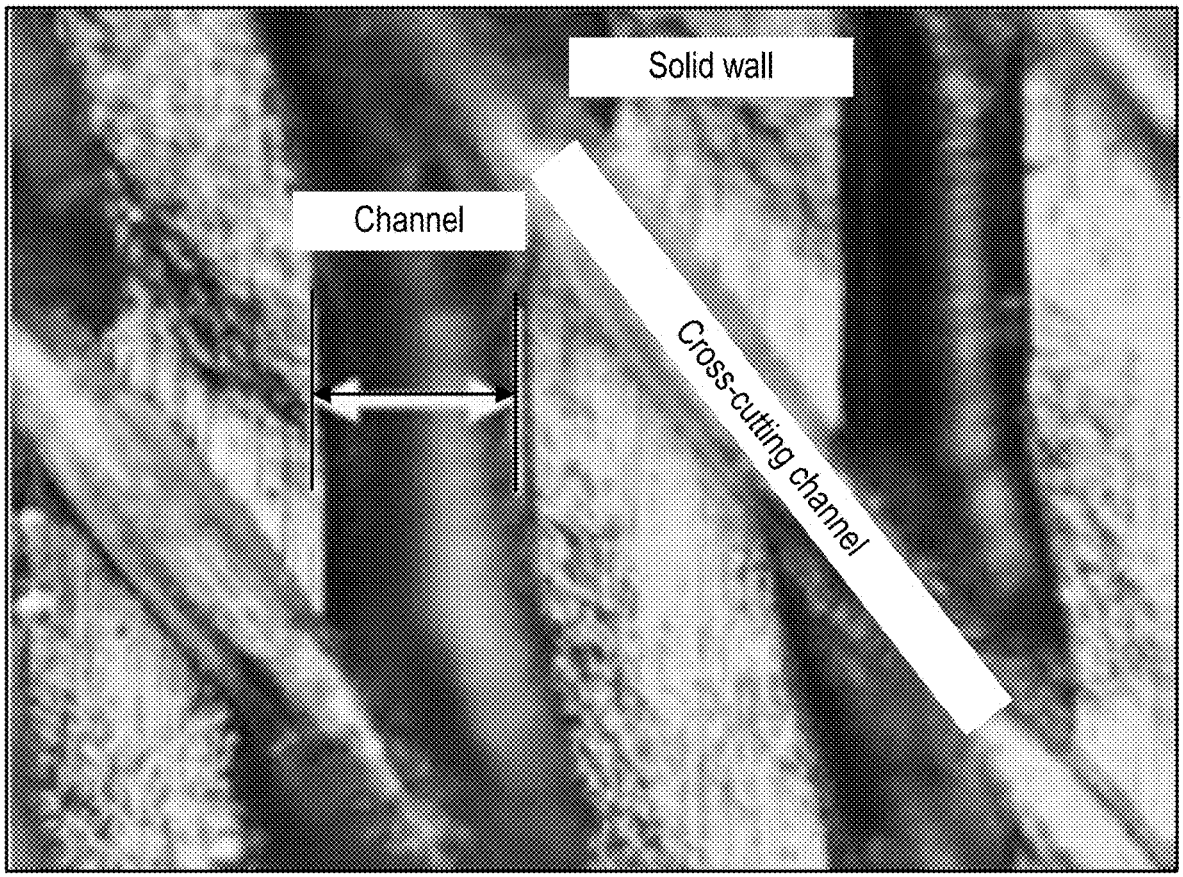
FIG. 19 shows commercially available grooved tubes.
Figure 20:
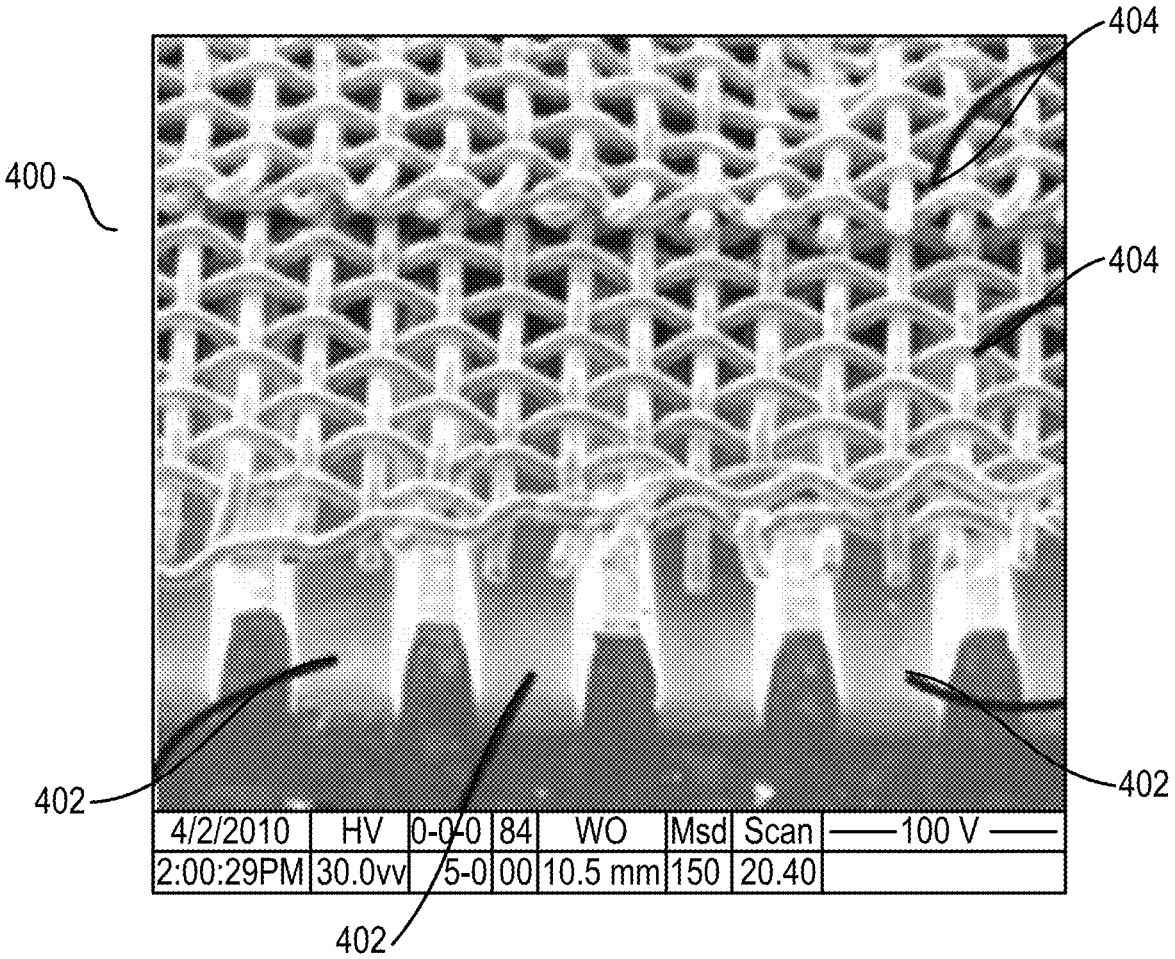
FIG. 20 shows a hybrid surface for capillary evaporation.
Figure 21:
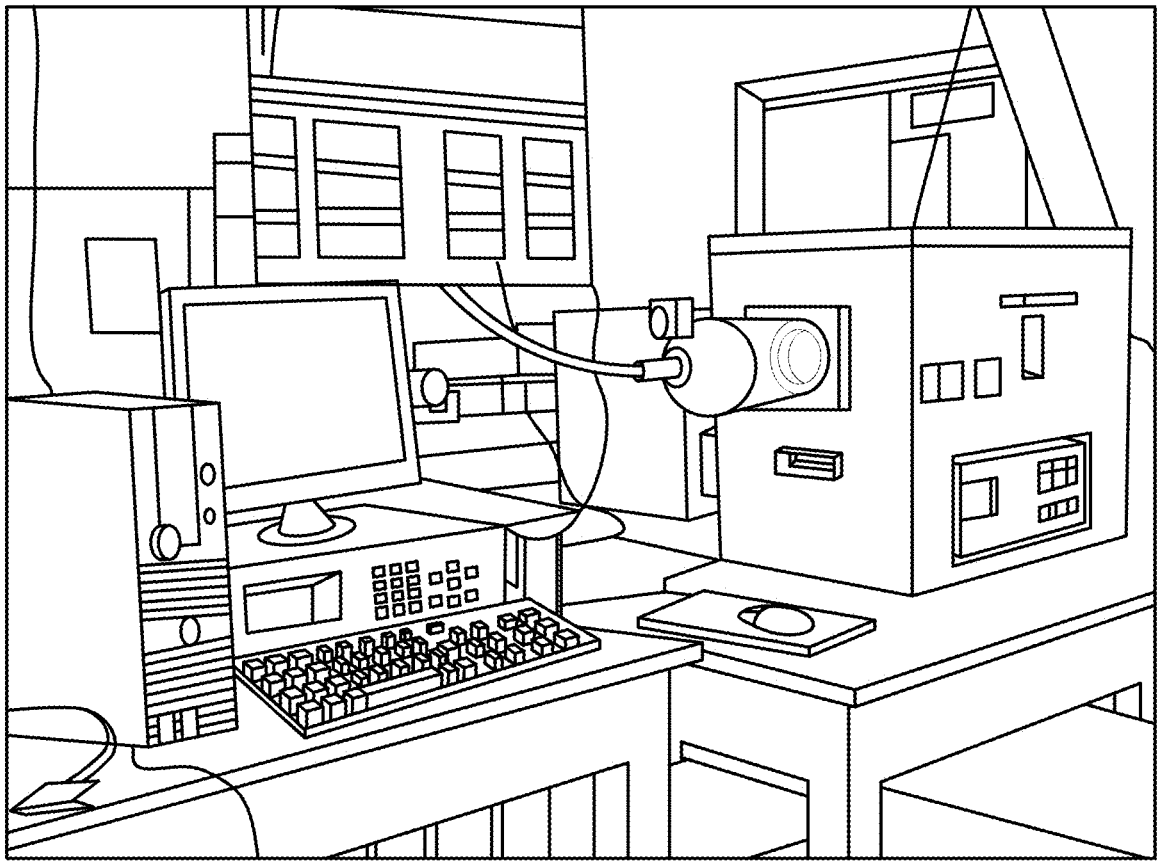
FIG. 21 shows a high temperature furnace.

Heat Pipe Effective Thermal Conductivity=function of (size of wick's opening, size of grooves, size of pipes, contact angles of heat transfer surfaces, wick's thermal conductivity and thickness, and vapor core thickness). FIG. 19 shows commercially available grooved tubes. The wicking structures 400 of the current disclosure, composed of copper microgrooves 402 and multi-layer micromeshes 404, see FIG. 20, will be sintered at 1000° C. in the high temperature furnace, see FIG. 21, with stainless steel (SS) molds and inert gases atmosphere. The high temperature sintering process is used to insure good contact conditions between wires and mesh as well as between mesh and microchannels.

Figure 22:
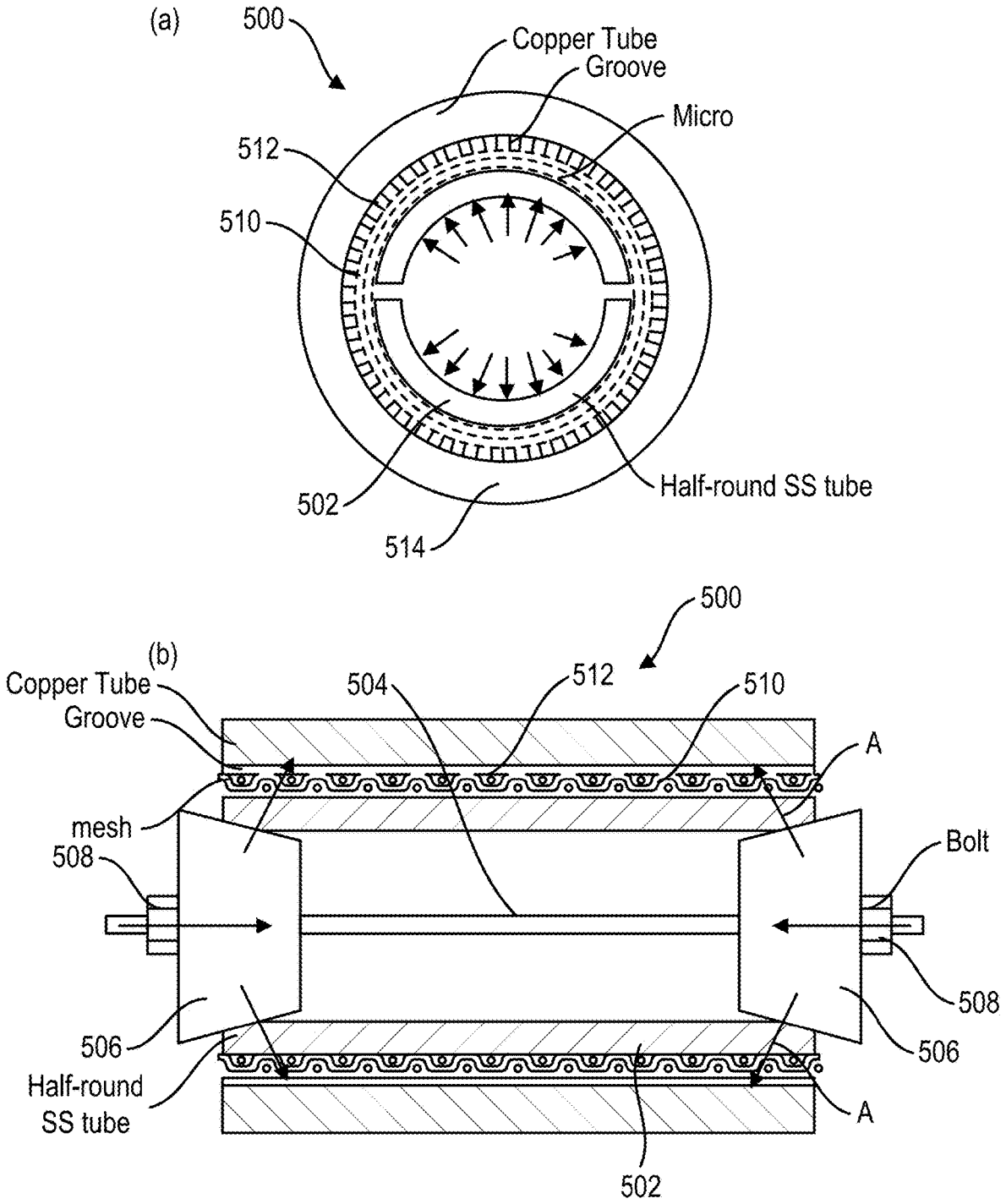
FIG. 22 shows an SS module used to form highly conductive hybrid wicks of the current disclosure.

As shown in FIG. 22, the SS modules 500 have seven components, including a pair of half-round tubes 502, an axle 504, a pair of circular truncated cones 506, and two bolts 508. The tightening forces applied on bolts 508 can press half-round tubes 502 so that the micromesh 510 can be firmly attached to grooved walls 512 to achieve highly conductive hybrid wicks 514. The forces could be adjusted to optimize the fabrication process by twisting the bolts.

FIG. 22 shows a schematic of sintering wicks/highly conductive hybrid wicks 514 for heat pipes in cross-sectional view with arrows A in the direction of the forces and the heat pipes in side view.

The wicking structures will be well cleaned to assure an oxide and organic waste free before the liquid charging. The cleaning process can keep the hydrophilic property of the wick and therefore increase the capillary pumping ability. The 10% solution of $H_2SO_4$ will first be charged into the heat pipe to remove most of organic wastes with the assistance of a stirrer. Then acetone will be charged into heat pipe for secondary cleaning. It takes five times to assure an oxide and organic waste free wicking structure. Once rinsed thoroughly, the heat pipe will be then placed in a vacuum furnace at 100° C. for 30 minutes to remove the residual water in the wicking structure.

Figure 23:
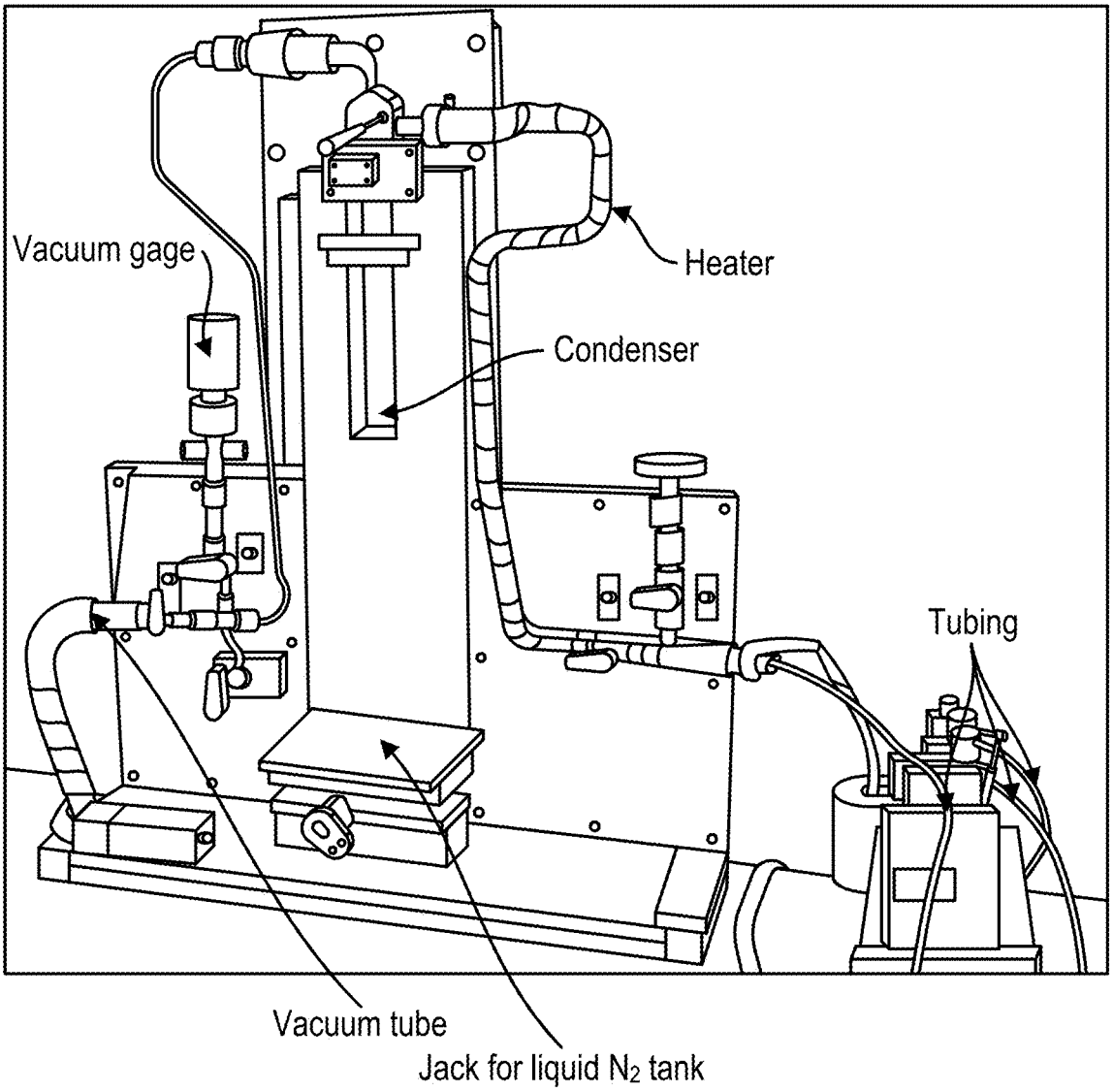
FIG. 23 shows a heat charging system.

As shown in FIG. 23, the cleaned heat pipe will be charged in a precise heat pipe charging system. The heater is used to evaporate residual liquid in the loop and to maintain the designed vacuum in the charging system. A vacuum gage is used to monitor the real-time vacuum in the system. The heat pipe will be vacuumed before charging working fluid. The extra gaseous acetone will be pumped out and condense by a liquid nitrogen until the heat pipe is properly charged. The charged heat pipe will be then sealed by a plier (HY-SERIES HYDRAULIC PINCH-OFF JAW, Custom Products & Service).

Figure 24:
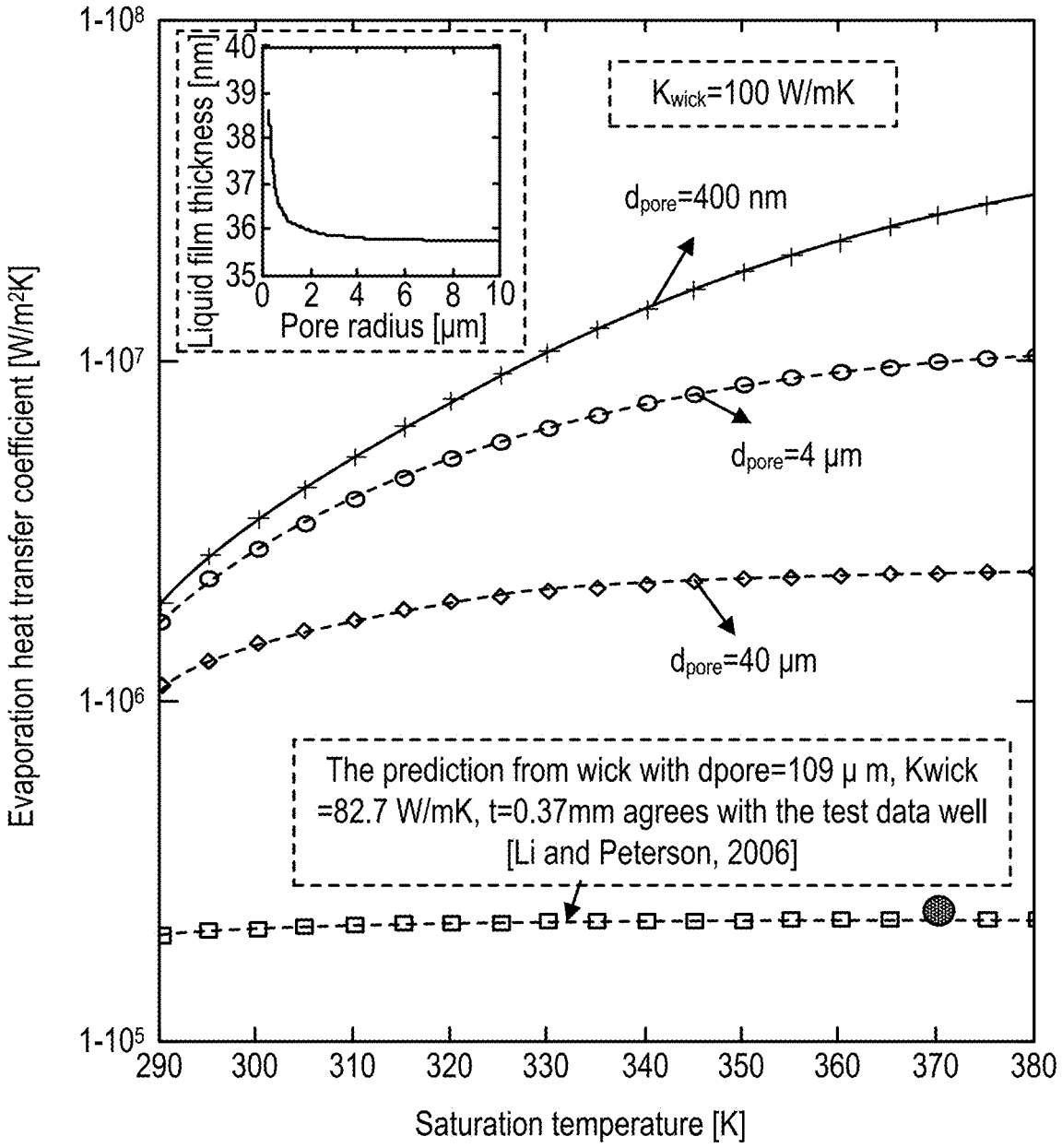
FIG. 24 shows a graph of the effect of pore size on the capillary evaporation heat transfer coefficient as a function of the operation temperature of heat pipes between 15 and 100° C.

Task 4.2: Modeling and characterization of hybrid wicking structures. As shown in the FIG. 24, the smaller the pore size, the higher the evaporation heat transfer coefficients would be. However, there is a limitation; boiling becomes unstable when the pore size approaches that of the vapor nucleation sites (~100 nm). FIG. 24 indicates that wicking structures with subscale pores would result in extremely high evaporation heat transfer coefficient. The size of the heat pipe evaporator is governed by the chamber of steam condenser; it cannot be changed to any desired level. On the other hand, there is more freedom to change the area of the heat pipe condenser area, i.e., air cooling area, to accommodate the ACC performance needs. Therefore, the analysis of the current disclosure focuses on the evaporator. In a heat pipe, the liquid is supplied by the capillary force difference between the evaporator and condenser. In order to obtain sufficient capillary pressure to assure a steady liquid supply over a long working distance, a refined microscale wick structure is necessary. FIG. 24 demonstrates that the wick structures should be smaller than 40 um to enable high evaporation HTC higher than 15 $W/cm^2 \cdot K$ and generate enough capillary pressure for the wick structure to remain operational.

Figure 25:
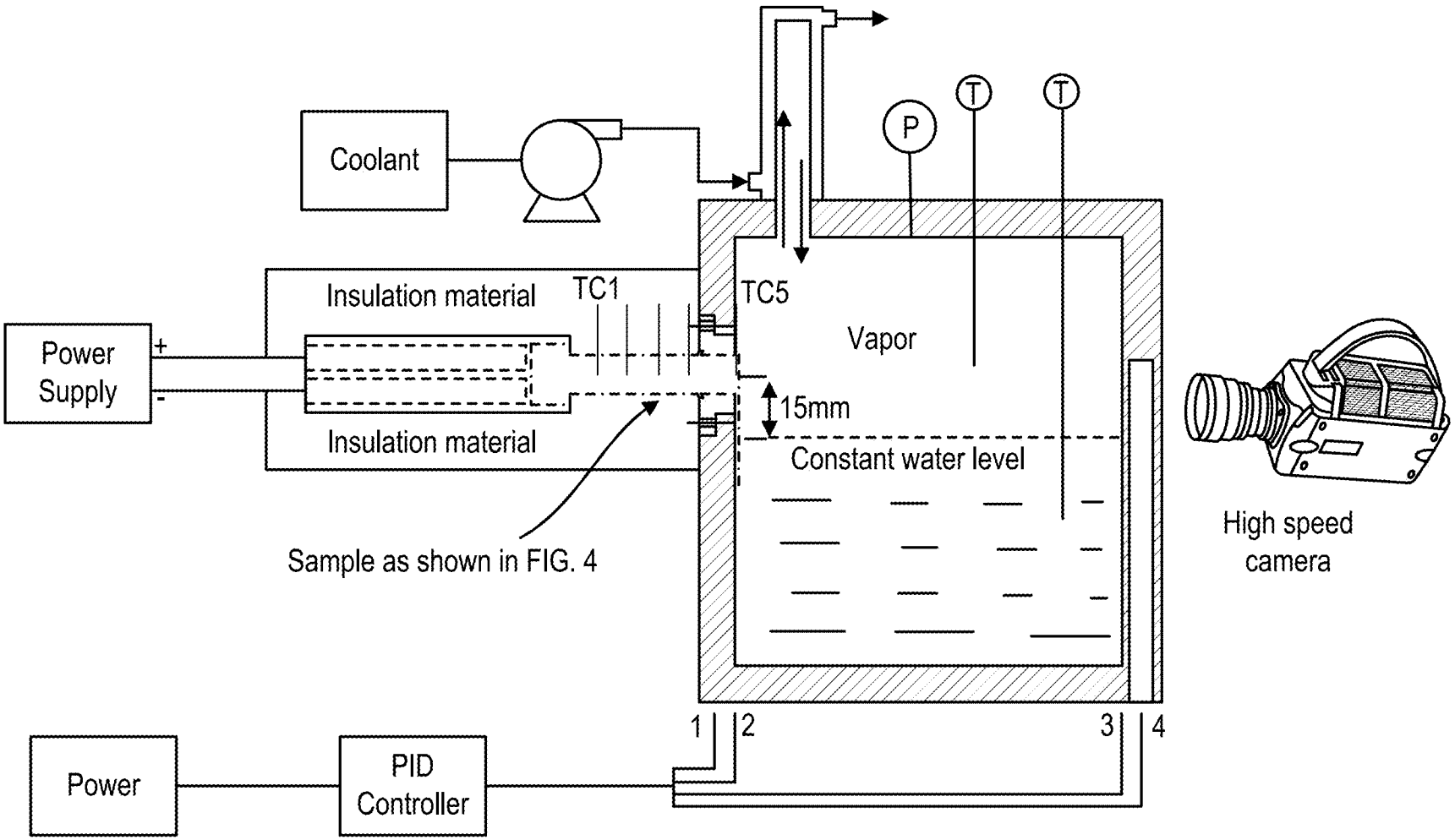
FIG. 25 shows a test setup for an evaporation study.

The evaporation study will be conducted in the established test setup as shown in FIG. 25. The 10×15×15 $cm^3$ test chamber is made from aluminum. One side of the chamber is covered by a piece of quartz glass as a visualization window. The other side is designed for sample installation. External lighting was provided for visualization studies. Four cartridge heaters are mounted at the four corners of the aluminum chamber to assure saturated working conditions. A proportional-integral-derivative (PID) temperature controller is used to accurately control the water temperature. A built-in compact condenser is designed to keep a constant water level by timely recycling the condensate. The vapor pressure and temperature inside the chamber are monitored by a pressure gauge and two T-type thermocouples, respectively.

Task 5: Build and Test a Lab Scale Condenser. To validate effectiveness of components and benchmark VTB modeling, a lab scale condenser will be built by scale down the proposed design. The major dimensions and metrics for measurement are shown in FIG. 26, as listed in Table 3. From fan similarity laws, the model flow rate can be determined. Thus the energy input into the model system can be known. From there, the model steam flow rate, number of heat pipes/fins can be determined based on energy conservation. The test results can be scaled down to prototype by keeping $Nu_p = Nu_m$, and $Re_p = Re_m$.

Air cooling is usually enhanced by augmenting heat transfer area. However, for ACC applications, it is extremely challenging to triple or even double the state-of-the practice heat transfer coefficient (HTC, 20-50 $W/m^2 \cdot K$) of air cooling via traditional methods in a cost-effective manner. The current disclosure has developed sweating-boosted air cooling enabled by nanowicks to enhance heat transfer in the air side. The proposed work in micro/nano two-phase heat transfer will greatly advance knowledge in cooling science and technology and modernize water, thermal management and energy technologies to achieve a greener economy.

The current disclosure's dry cooling technology is a cost-effective and energy-efficient solution to replace current water cooling tower for power plants without sacrificing electricity generation efficiency. This technology can be used to significantly improve HVAC and refrigerator efficiency by reducing the largest thermal resistance from air side. The current disclosure may have applications in the fields of HVAC, radiators, refrigeration or other industries using similar cooling structures.

Hybrid wet/dry cooled condensers (HCCs) are employed to compensate for the low efficiency of ACCs under elevated ambient temperatures. HCCs are built either by combining ACC and WCC in series or parallel, or by integrating ACCs with the evaporation process. Small amounts of water are sprayed as fine mists into the air and/or spread into wet pads to evaporatively cool the inlet air, or directly deluged over the heating surfaces of ACCs. The performance of HCCs is significantly improved by the evaporation process owing to the latent heat in vaporization, such as falling film evaporation. However, HCCs require high capital and operating cost for additional peripheral components. For example, the spray nozzles in HCCs need high feeding pressure, eliminating carryover water mist, and avoiding nozzle clogging.

HCCs represent promising alternatives to improve current ACCs with minor water consumption, but the size of HCCs is not sufficient compared to that of WCCs. To further reduce the size of ACCs, the current disclosure proposes a heat-pipe based ACC with a sweat-boosted process (HPACC-SB), shown in FIG. 1. HPACC-SB has similar architecture as the most effective once-through WCCs, but uses highly conductive heat pipes to replaces conventional water tubes. The proposed HPACC-SB is highlighted with two optimized heat transfer processes, i.e., the heat transportation from steam-side to air-side though heat pipes and the heat rejection by sweating-boosted cooling]. For a 500 MW coal-fired steam power plant, the proposed novel condenser can effectively maintain the steam-air temperature difference approximately 10° C., achieve significantly high overall heat transfer coefficient, and hence enable a drastic reduction of the ACC footprint (~52%) and potential capital cost (up to 67%). The water use is only 33% of that of conventional cooling tower technology. More importantly, the power production penalty on hot days can be minimized by effectively controlling the condensate temperature.

A Lab-Scale Heat-Pipe Air-Cooled Condenser (HPACC)

The heat pipe is a passive two-phase device with extremely high thermal conductivity owing to the utility of phase transition. The heat pipe heat exchanger has been widely used to effectively transport a large amount of heat in the energy sector, such as thermal management of electronics, latent heat thermal energy storage, and geothermal heat extraction, however, the heat pipe has not yet been integrated into steam condensers of power plants. The high efficiency, large capacity, and small temperature variation of heat pipes make it a suitable candidate to cool thermal power plants. Moreover, heat pipes are highly reliable and maintenance-free. Commercially available heat pipes are cost-effective and have been massively used to keep a stable temperature of large-width embankment in the permafrost regions. Existing studies show that forced-air convective heat transfer could be significantly enhanced by applying heat pipe heat exchangers in air conditioning systems. Because of these promising features, heat pipes could be promising in advancing ACCs technologies for thermal power plants.

Fabrication of Heat Pipes

Figure 27:
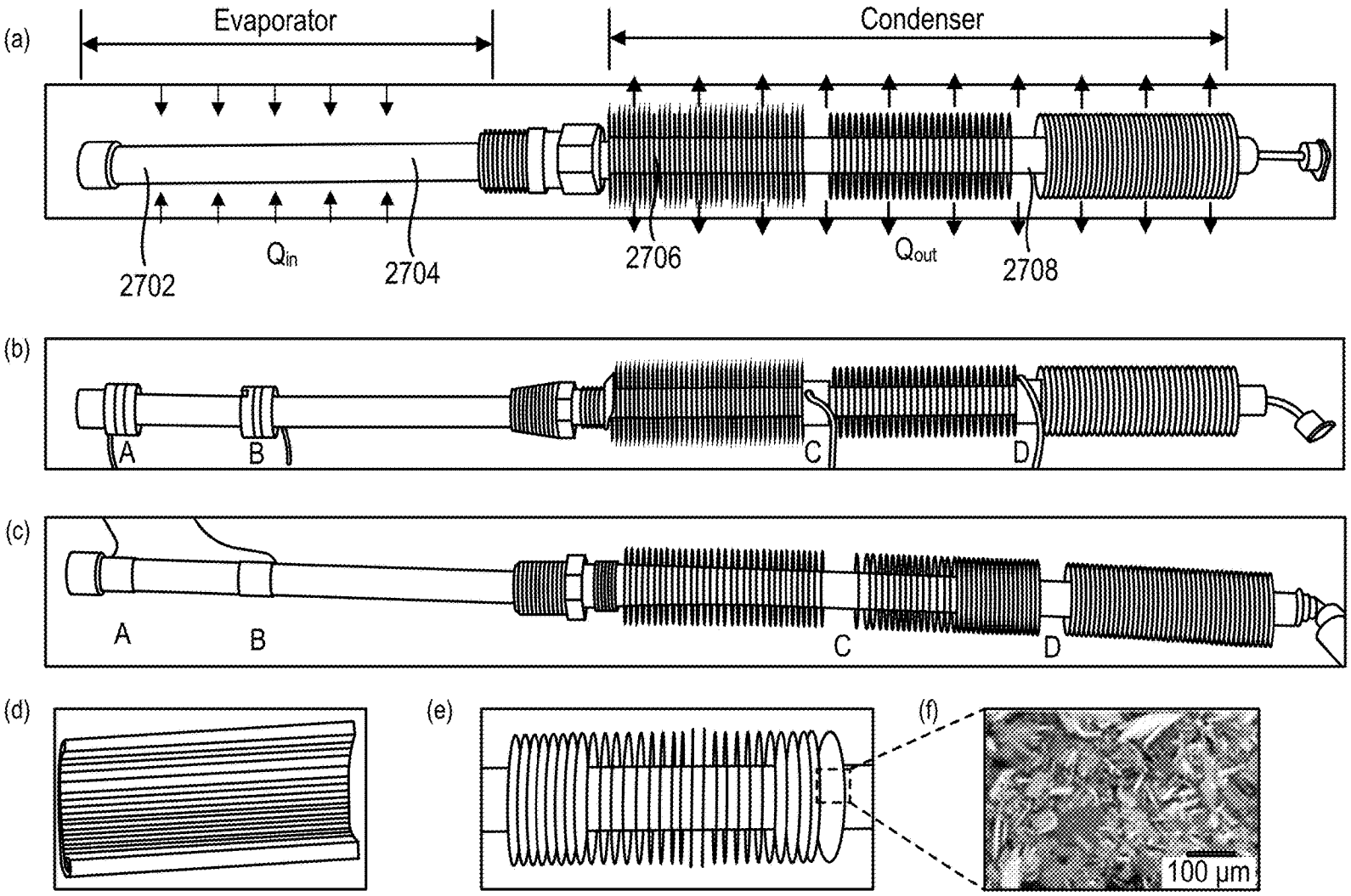
FIG. 27 shows heat pipes for air-cooled condensers of the current disclosure.

FIG. 27 shows heat pipes for air-cooled condensers of the current disclosure. FIG. 27 shows at: (a) The as-prepared heat pipe, (b) the heat pipe without, coating for conventional air cooling, (c) heat pipe with coatings for sweating-boosted air cooling, (d) the inner grooved surface in the evaporator section of heat pipes, (e) the optical and (f) SEM images of surface coatings with $Cu_2(OH)_3NO_3$ crystals. (In (b) and (c), A, B, C, and D are the locations of K-type thermocouples, respectively.)

Heat pipe 2700 is fabricated with an inner grooved copper tube 2702 for its evaporator section 2704, and a finned copper tube 2706 for its condenser section 2708, as shown in FIG. 27. All components of heat pipes are assembled by vacuum welding, and the ends of heat pipes are hermetically sealed. The heat pipe is charged with 4.5 ml deionized ultra-filtered water (#W2-4, Fisher Chemical) under a vacuum of 0.05 Torr. Five heat pipes are assembled as a lab-scale HPACC, and the related parameters are specified in the Table shown at FIG. 28. The thermal performance of heat pipes is characterized in a heat pipe testing rig as described in A. A. Abdulshaheed, P. Wang, G. Huang, C. Li, *High performance copper-water heat pipes with nanoengineered evaporator sections, International Journal of Heat and Mass Transfer,* 133 (2019) 474-486, which is hereby incorporated by reference, where the evaporator section is heated with heating plates, and the condenser section is cooled by circulating water (T=30° C.). The optimized inclination angle for the as-prepared heat pipes is determined to be 25°. The repeatability and durability tests showed there was no noticeable degradation in the effective thermal resistance of heat pipes within 90 days. The surface temperatures of the heat pipe are measured with four K-type surface thermocouples (#TL0225, Perfect-Prime), which are fixed and well insulated at the location A, B, C, and D, respectively, as illustrated at FIG. 27 at (b).

The copper would be oxidized when exposing to steam, which may introduce noticeable deterioration of steam condensation on the exposed surfaces of heat pipes. These surfaces are passivated by immersing in the hydroperoxide solution (10 wt. %) for 10 minutes.

Superwetting Wicks for the Sweating-Boosted Air Cooling (SBAC)

Previous research demonstrated that sweating-boosted air cooling (SBAC) could significantly enhance the air-side heat transfer coefficient (HTC). The superwetting wick structures play a critical role in significantly improving the SBAC owing to its capability in thinning liquid film. Copper hydroxyl nitrate (Cu-HDS/$NO_3$) wicks were directly synthesized on finned copper tubes for SBAC, see P. Wang, W. Chang, G. Huang, M. Alwazzan, B. Peng, T. Alam, C. Li, *Superwetting copper hydroxyl nitrate wicks for the sweating-boosted air cooling on finned tubes, International Journal of Heat and Mass Transfer,* 133 (2019) 677-685, which is hereby incorporated by reference. This structure exhibited a super-wicking capacity (wicking rate of 2.16 μl/s) in local water distribution. It enhanced the air cooling on a finned copper tube, typically increasing the effective HTC by 379.9% and reducing the overall thermal resistance by 76.1%. In this study, the fined surfaces of heat pipes, i.e., the condenser sections, are coated with Cu-HDS/$NO_3$ wicks via a three-step wet chemical oxidization process, see FIG. 27 at (e) and (f).

Experimental System and Data Processing

Figure 29:
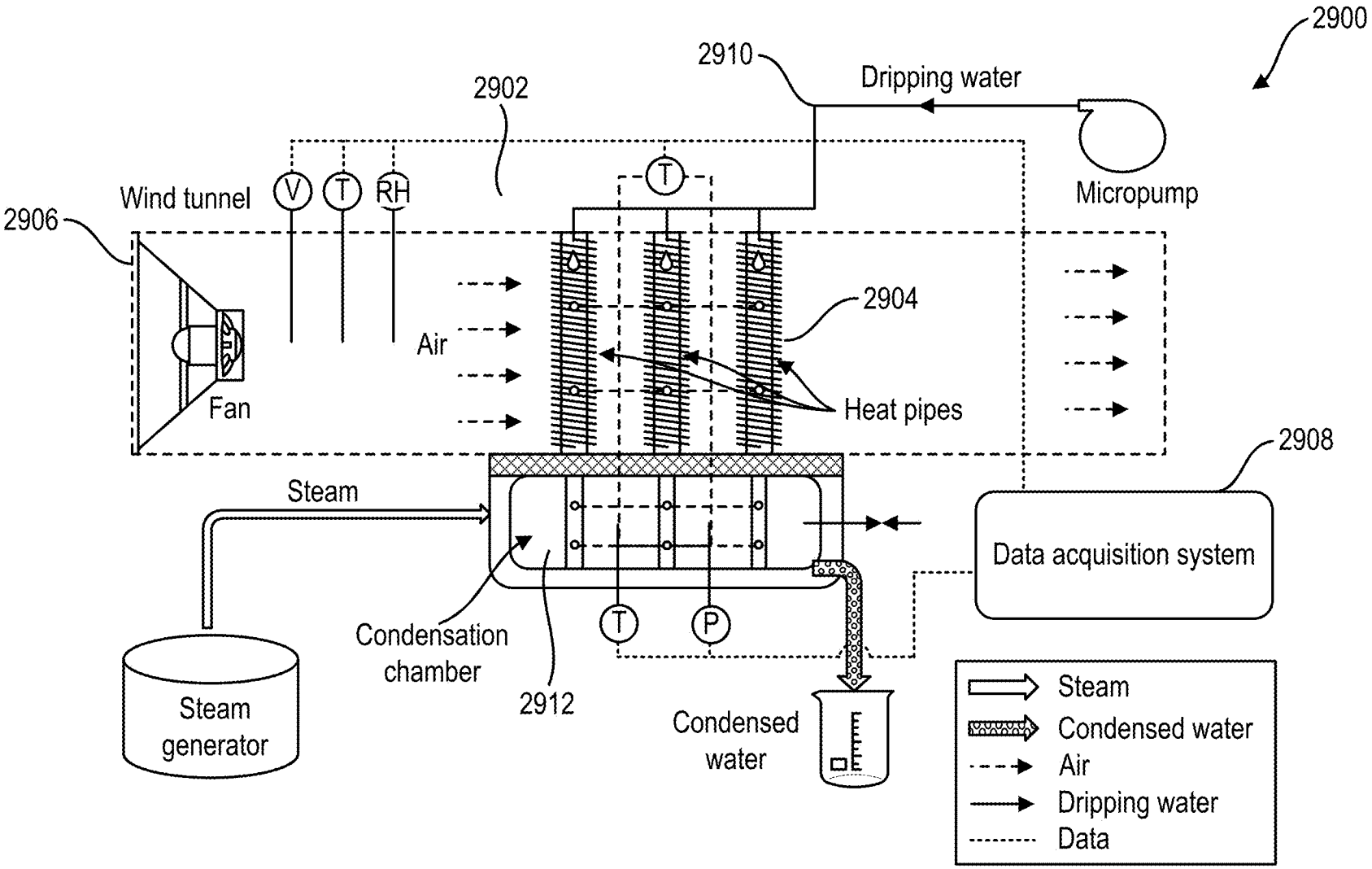
FIG. 29 shows a schematic experimental setup where measured instruments V, T, RH, and P represent the air velocity transmitter, thermocouples, relative humidity transmitter, and pressure transducer, respectively.

FIG. 29 shows a schematic experimental setup where measured instruments of V, T, RH, and P represent the air velocity transmitter, thermocouples, relative humidity transmitter, and pressure transducer, respectively.

Figure 30:
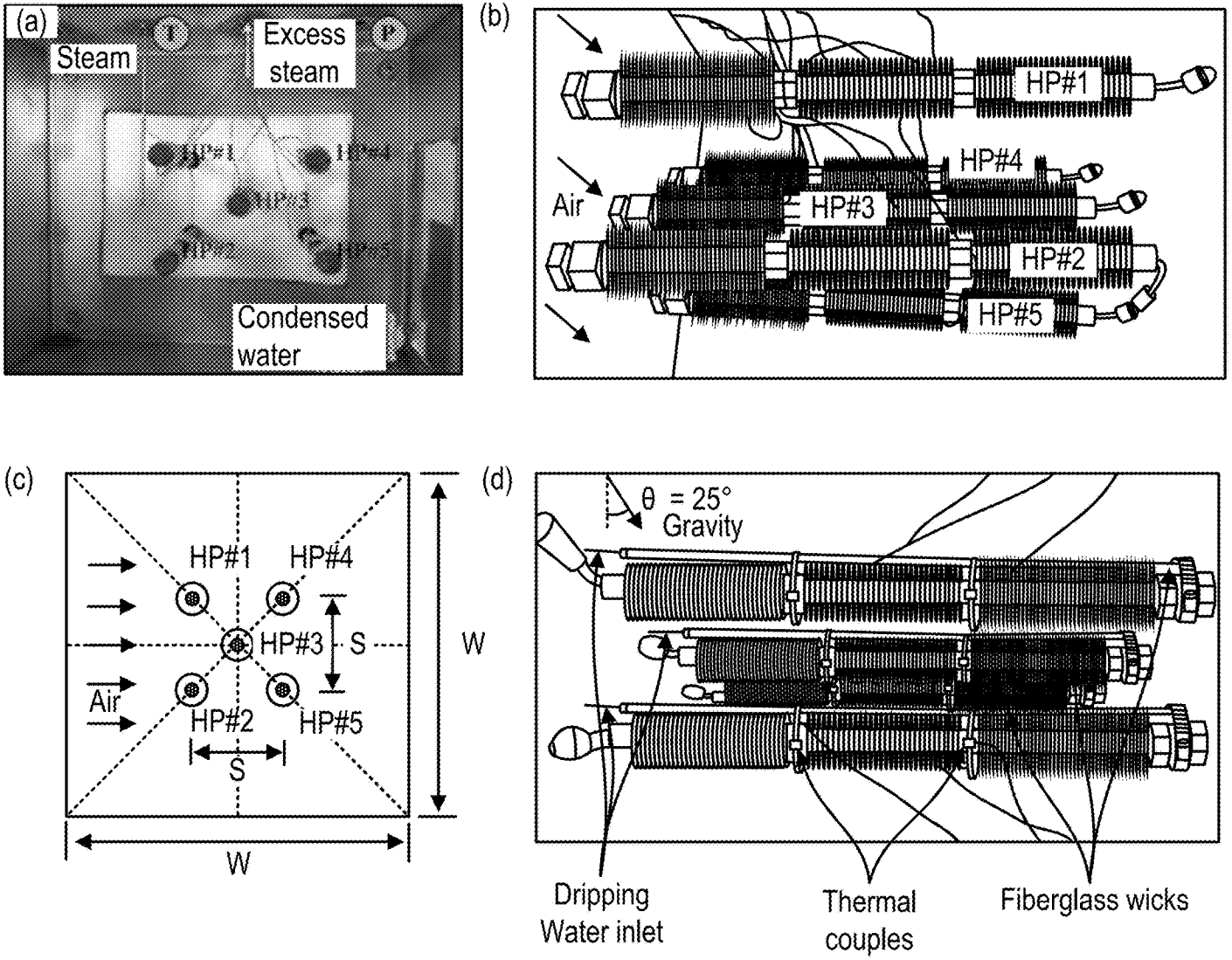
FIG. 30 shows a lab-scale heat pipe air-cooled condenser.

An experimental system 2900 consists of five main sections: (i) a lab-scale HPACC 2902, (ii) a vapor generating system 2904, (iii) a wind tunnel system 2906, (iv) a data acquisition system 2908, and (v) a water dripping system 2910 (enabled for the sweating-boost air cooling only), as shown in FIG. 29. The labscale HPACC is equipped with five heat pipes in a staggered array, as shown in FIG. 30 at (a). FIG. 30 shows the lab-scale heat pipe air-cooled condenser at (a) steam-side, (b) air-side, (c) layout of staggered array (S=80 mm, W=30 cm), and (d) air-side with water dripping system. The evaporator sections of heat pipes (i.e., the seam-side of HPACC) are assembled in condensation chamber 2912, while the condenser sections of heat pipes (i.e., the air-side of HPACC) are inserted into the duct of a wind tunnel. The saturated steam, produced with a steam generator, flows into the condensation chamber.

Parts of the saturated steam condenses due to the heat loss from the condensation chamber. Therefore, the working fluid in the condensation chamber is a mixture of liquid and vapor (mixed-liquid-vapor) at a low input power of the steam generator, and it can only be taken as the steam when the high input power of the steam generator is high enough. In the following discussion, the term "steam" is used for the working fluid in the condensation chamber may refer to "mixed-liquid-vapor" or "steam". The steam condenses and releases the heat on the exposed surfaces of heat pipes at atmospheric pressure. This heat is effectively transported via a phase-change process within heat pipes. Finally, this heat is spread over finned surfaces and taken away by air flows. This forced air convective heat transfer can be further enhanced by employing SBAC.

The temperature of steam in the condensation chamber is measured with a T-type thermocouple probe (#SCASS-125G-12, Omega). The pressure in the condensation chamber is kept at atmospheric pressure by venting the excess steam via a bypass, see FIG. 30 at (a). Heat loads for HPACC are controlled by adjusting the input power of the steam generator. The total effective heat loads dissipated by heat pipes are determined from the volume of condensate. The airflow within the duct of the wind tunnel, driven with a blowing fan, is controlled by a variable transformer (#3PN1010B, Variac). The air velocity is at a range of 0.5 to 4.0 m/s and measured with an air velocity transmitter (#FMA903R-V1, Omega). The temperature (21.0±0.5° C.) and relative humidity (55±3%) of inlet air are measured with an RH/Temp transmitter (#HX-94C, Omega). All the data are collected and recorded by a data acquisition system (34972A, Agilent) interfaced with a PC. For the SBAC process, distilled water is driven with dosing pumps (#GA-X21, Ismatec) and directly dripped on fiberglass wicks over finned surfaces coated with superwetting wick structures.

Data Processing and Uncertainty Analysis

The total heat loads for the experimental system consists of the effective heat loads directly released on the exposed surface of heat pipes, Φeff, and the heat loads released on the other surfaces, such as the walls of the condensation chamber, Φloss. The total heat load is given as $$\Phi_{total}=\Phi_{eff}+\Phi_{loss} \tag{1}$$

The effective heat load is dissipated by the HPACC is calculated as $$\Phi_{eff}=\psi\chi_{cal}\Phi_{total} \tag{2}$$

where χcal is the effectiveness factor for the condensation chamber, which determined by a calibration process. ψ is the correction factor for the filmwise condensation, owing to the difference in thermal condition between the calibration and experiments. χcal and ψ are discussed in detail in Calibration of the Experimental System.

The overall thermal resistance of HPACC of a heat pipe is defined as $$R_{HPACC}=\frac{1}{UA}=(T_{steam}-T_{air})/\Phi_{eff} \tag{3}$$

where Tsteam is the steam temperature in the condensation chamber, and Tair is the air temperature in the wind tunnel. It consists of three component-level thermal resistance of (i) steam-side condensation, (ii) thermal transportation within heat pipes, and (iii) air-side convective with/without evaporative cooling.

$$\frac{1}{UA}=\frac{1}{(UA)_{Steam}}+\frac{1}{(UA)_{HP}}+\frac{1}{(UA)_{Air}} \tag{4}$$

The component thermal resistance is predicted as the ratio of effective heat loads to the related temperature difference. For example, the thermal resistance of the heat pipe array is given as $$\frac{1}{(UA)_{HP}}=(\overline{T}_{HP,eva}-\overline{T}_{HP,cond})/\Phi_{eff} \tag{5}$$

where THP, eva and THP, cond are the averaged wall temperature on the steam-side and air-side of heat pipes. They are evaluated by averaging the readings of surface thermocouples on the i-th heat pipe and given as $$\overline{T}_{HP,eva}=\left\{\sum_{i=1}^{i=5}\left[(\overline{T}_{i,A}+\overline{T}_{i,B})/2\right]\right\}/5 \tag{6}$$

$$\overline{T}_{HP,cond}=\left\{\sum_{i=1}^{i=5}\left[(\overline{T}_{i,C}+\overline{T}_{i,D})/2\right]\right\}/5$$

where A, B, C, and D donate the locations of surface thermocouples on the single heat pipe, as shown in FIG. 27 at (b).

The uncertainties of measured parameters are estimated from the specifications of instruments; the uncertainties of derived parameters are calculated using the Kline and McClintock method, as listed in the table shown at FIG. 31.

Calibration of the Experimental System

A calibration experiment is conducted to account for the condensate on the surfaces other than the exposed surfaces of heat pipes. A copper tube with the same exposed surface area of heat pipe array is mounted within the condensation chamber. The heat released during condensate is carried along with turbulent water flow through the tube. The hot water, driven with a circulating water bath (RTE-4DD, Neslab), is used to simulate the thermal conditions for condensation. The inlet temperature of hot water is set about 1.0° C. above the condensation wall temperature of heat pipes under a given input power of the steam generator. The inlet/outlet temperatures and flow rates of hot water are measured with T-type thermocouples and a flow meter (FPR1504, Omega), respectively. The water flow rate is maintained at 7.5-9.0 L/min, corresponding to the Reynolds number ranging from 14,500 to 17,400.

The effective heat loads released on the exposed surface of the copper tube are taken by the internal flowing water, given as $$\Phi_{eff,cal}=\rho C_p\dot{Q}_{fw}(T_{fw,in}-T_{fw,out}) \tag{7}$$

where ρ, Cp, Qfw, Tfw, in, and Tfw, out are the density, the latent heat, the flow rate, the inlet and outlet temperature of cooling water, respectively. The uncertainty of heat loads in the calibration process is about 16.9 W.

The total heat loads for the condensation chamber, Φtot, is determined by the volume of condensate, Qcw, which is collected under a steady condition for 30 minutes.

$$\Phi_{tot,cal}=\rho\dot{Q}_{cw}h_{fg} \tag{8}$$

where ρ and hfg are the density and the latent heat of condensed water, respectively.

The effectiveness factor, χ, in Eq. (2) is estimated by the effective and total heat loads and given as $$\chi cal=\Phi_{eff,cal}/\Phi_{total,cal} \tag{9}$$

Figure 32A:
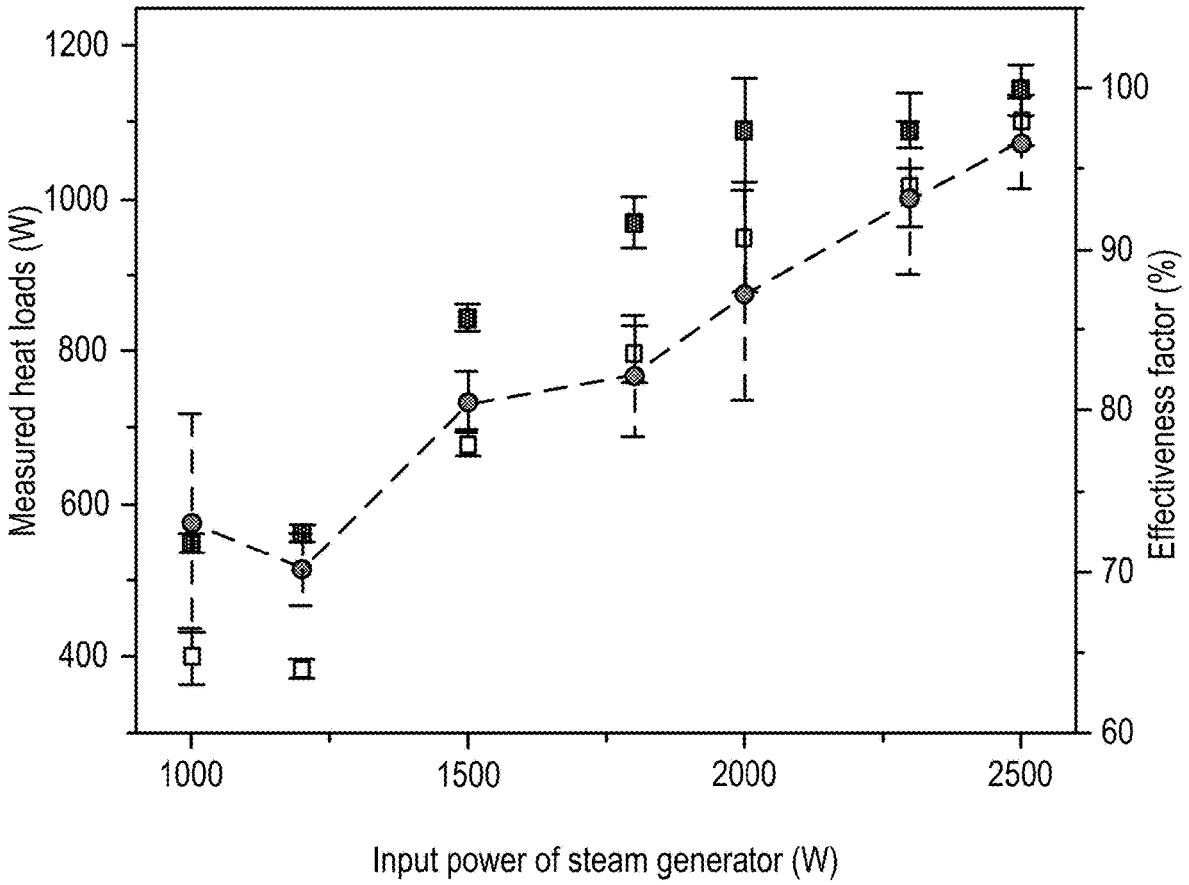
FIG. 32A shows effective heat loads for the experimental system—calibration for the effectiveness factors of condensation.

The total and effective heat released in the condensation chamber increase significantly with the increasing in the input power of steam generators (i.e., the amount of steam), especially when the input power exceeds 1,500 W. The effectiveness factor for the condensation increases almost linearly, shown in FIG. 32A, which indicates that the amount of condensate on the surfaces is constant.

The wall temperature of the condensation surface on heat pipes is closely related to the air-side cooling rates, i.e., higher air velocity results in lower wall temperature. The effects of wall temperature are corrected with the classical Nusselt model of filmwise condensation. The heat transfer coefficient of laminar film condensation on a horizontal tube is given as $$h_{fwc,cal}=0.728\left[\frac{(\rho_l-\rho_v)gh'_{fg}k_l^3}{Dv_l(T_{sat,cal}-T_{w,cal})}\right]^{1/4} \tag{10}$$

where ρl, ρv, kl, vl, and D are the liquid density, vapor density, liquid thermal conductivity, liquid dynamics viscosity, and the outer tube diameter, respectively. h'fg is the corrected latent heat of evaporation with consideration of sensible heat, given as $$h'_{fg}=h_{fg}[1+0.68(Cp_l(T_{sat}-T_w))/h_{fg}] \quad (11)$$

where hfg and Cpl are the latent heat of evaporation and the thermal capacity of liquid. The steam properties are evaluated at the steam temperature in the condensation chamber, Tsat. The liquid properties were evaluated at the film temperature, Tf, given as $$T_f=T_w+0.25(T_{sat}-T_w) \quad (12)$$

The correction factor for filmwise condensation, ψ, is introduced to account for the difference of thermal conditions from the experiments and calibration. It is given as $$\psi = \frac{h_{fwc,exp}(T_{sat,exp} - T_{w,exp})}{h_{fwc,cal}(T_{sat,cal} - T_{w,cal})} \quad (13)$$

Figure 32B:
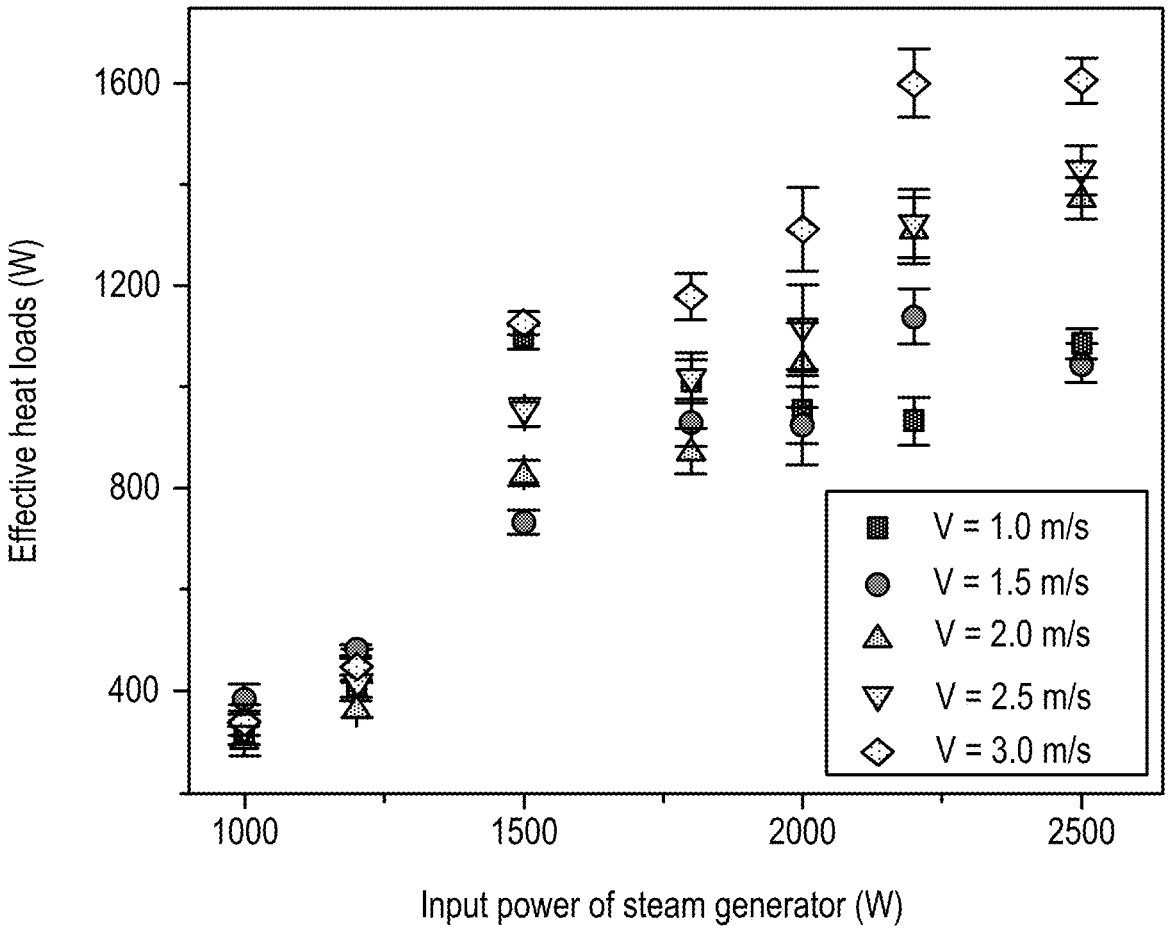
FIG. 32B shows effective heat loads for the experimental system—effective heat loads for the HPACC under dry cooling.

With the effectiveness factors of the condensation chamber, χcal in Eq. (9), and the correction factor for filmwise condensation, ψ in Eq. (13), the effective heat loads dissipated by the HPACC under dry cooling can be calculated using Eq. (2), as shown in FIG. 32B.

Thermal Performance of HPACC

Typically, the natural draft wet cooling towers in thermal power plants operate with an air velocity of 0.9-3.6 m/s and condensing temperature of 38.0-43.0° C. under vacuum. In this disclosure, the thermal performance of HPACC under dry cooling is carried out with air velocities between 1.0 and 3.0 m/s and a condensing temperature of 100° C. at atmospheric pressure. The effective heat load dissipated by HPACC is in a range of 327.11-1606.4 W with the input power of steam generator of 1,000-2,500 W. Lower air velocity and higher heat loads are used for the HPACC under sweating-boosted air cooling. The test conditions for the HPACC are listed in FIG. 33.

Dry Cooling

Figure 5:
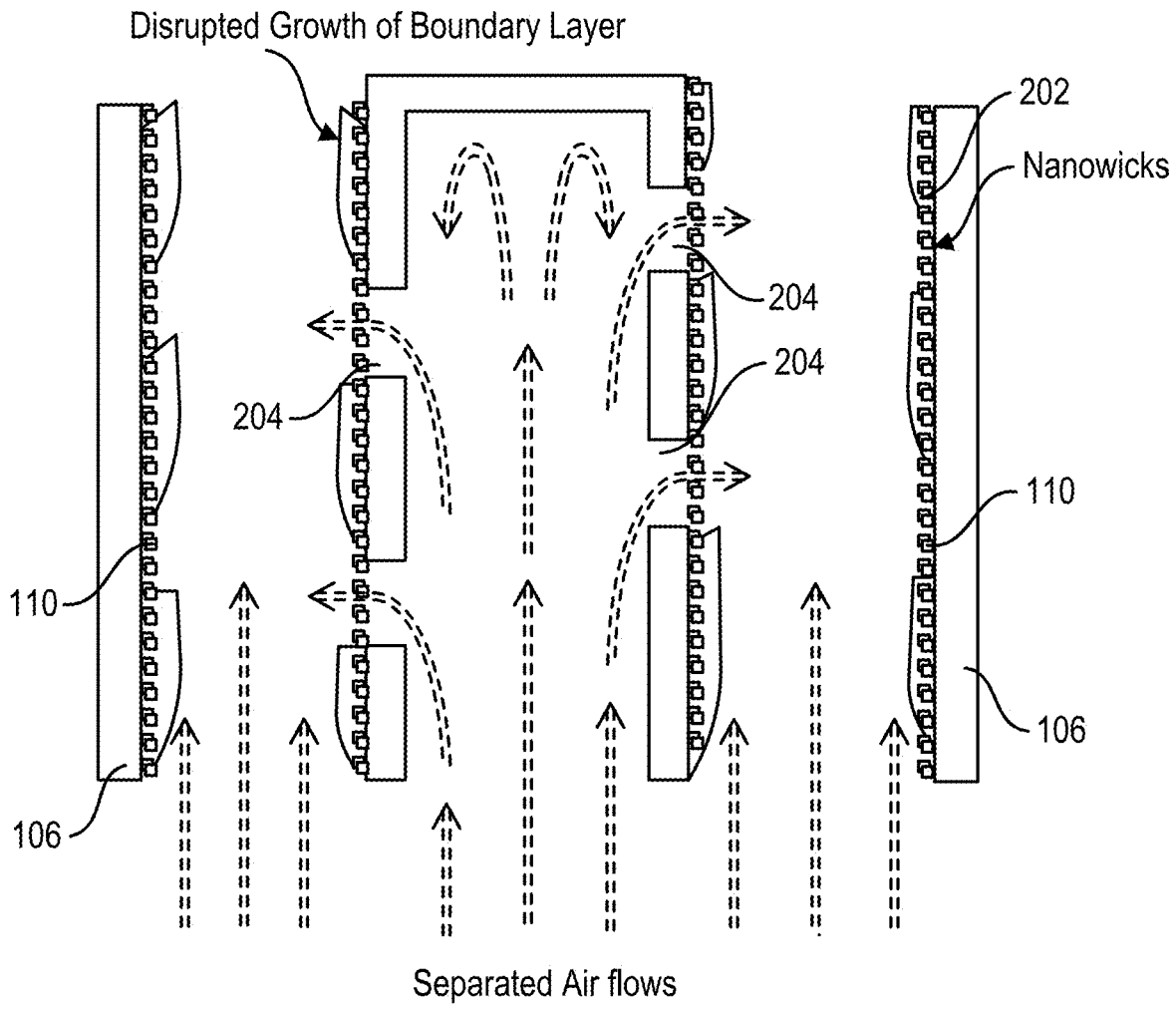
FIG. 5 shows a schematic of the air flow enhancement mechanism of the current disclosure.
Figure 34A:
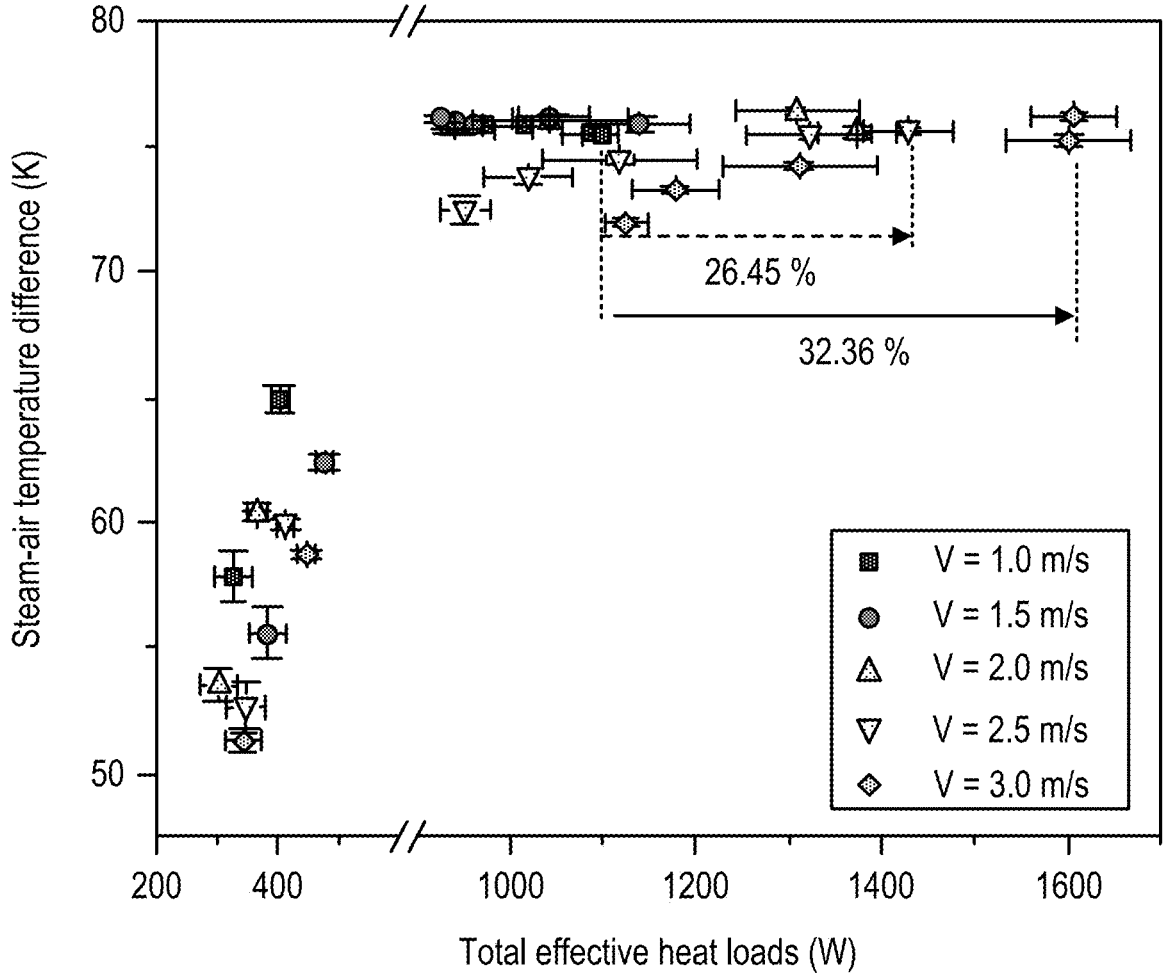
FIG. 34A shows thermal performance of HPACC under dry cooling steam-air temperature difference.

The effective heat loads of HPACC under dry cooling are closely related to the input power of the steam generator and air velocities, as shown in FIG. 5(*b*). At air velocity of 1.0 m/s, the effective heat loads significantly increase from 327.11 to 1098.0 W when the input power of steam generator rises from 1000 to 1500 W. Above 1500 W, the effective heat loads remain constant at low air velocity (i.e., 1.0-1.5 m/s), slightly increases to another relatively constant value at higher air velocity (i.e., 2.0 m/s), or continuously increases to the maximum value at 2.5 and 3.0 m/s. The temperature difference between steam and air has a similar trend to the heat loads, as shown in FIG. 34A. It increases substantially until a constant value of 75.8° C. is reached, which corresponds to a saturated steam temperature above 99.5° C. and an indoor air temperature of about 23.0° C. The measured temperature of steam and air under various working conditions in FIG. 34A can be found in the supplemental document.

Figure 34B:
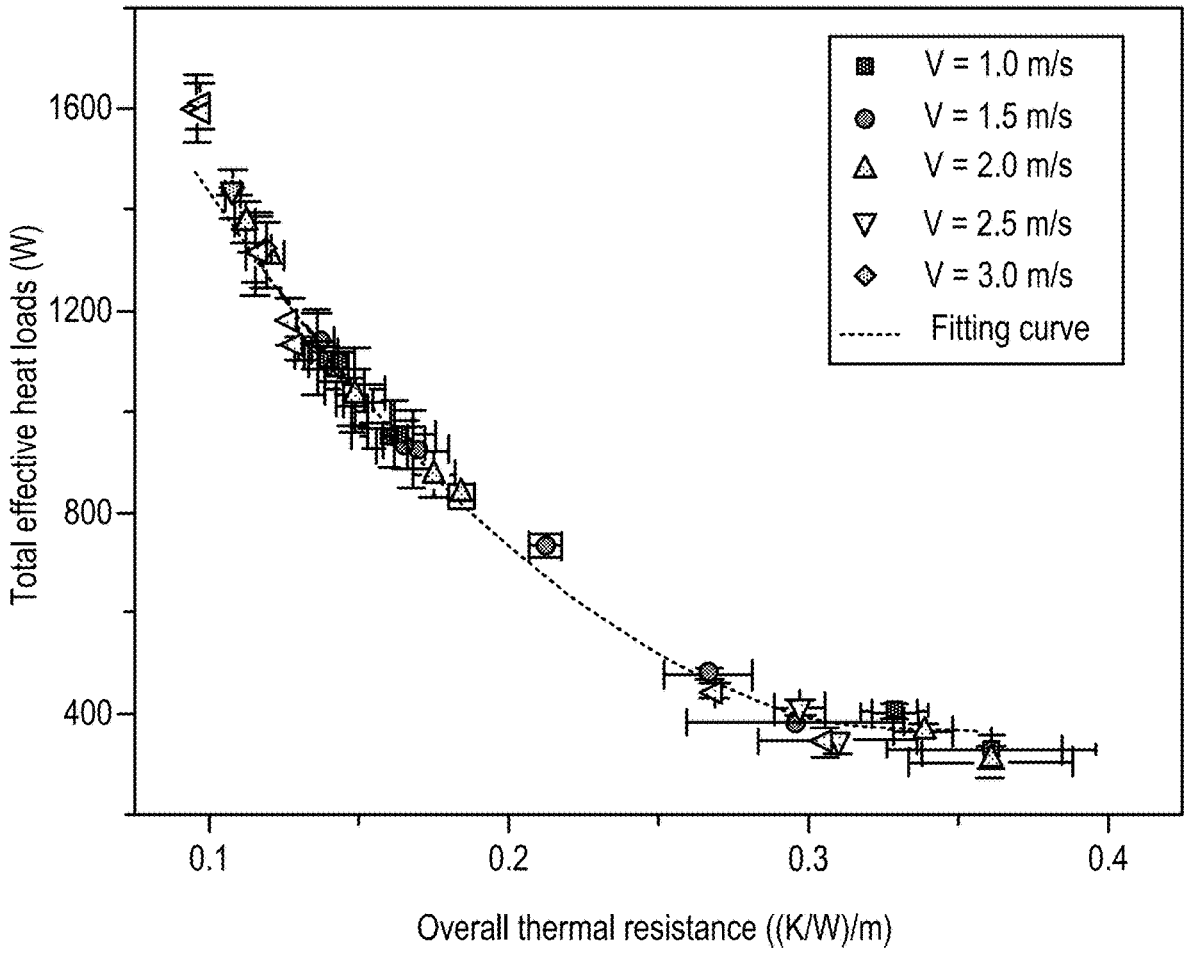
FIG. 34B shows thermal performance of HPACC under dry cooling overall thermal resistance.

FIG. 34B shows the air velocity significantly affects the condensation performance of HPACC under dry cooling. The thermal load at airflow rates of 2.0 and 3.0 m/s increased by 26.45% and 32.36%, respectively, compared to the air velocity of 1.0 m/s. The air-side HTC significantly increases owing to the increase in air velocities (i.e., the Reynolds number), as described by the Nusselt correlation for air cooling. A higher air-side HTC obviously reduces the wall/fins temperature, if assuming a constant temperature difference within the heat pipes, which results in a lower temperature of the surface where steam condensates. Therefore, more steam condensates at a higher air velocity, resulting in a reduced overall thermal resistance of HPACC.

The thermal performance of HPACC can be characterized by the dissipated heat loads (Eq. (2)) or the overall thermal resistance of HPACC (Eq. (4)). There is a quadratic polynomial relation between the total effective heat loads and the overall thermal resistance of HPACC, as shown in FIG. 34B. It is achieved by mathematically fitting the experimental data, and give as $$\Phi_{eff}=2500.1-12460\times R_{HPACC}+18161\times R_{HPACC}^2 \quad (14)$$

Lower air velocity leads to higher overall thermal resistance and smaller heat loads; however, the effects of air velocity are more obvious at these working conditions. The impact of air velocity continuously weakens at low overall thermal resistance, resulting in a significantly increasing of the heat loads. It indicates that the overall thermal resistance of HPACC has a minimum limit, which wings to the air/fin-side heat dissipation, referred to as "the heat sink conditions". In this research, the minimum value of overall thermal resistance of HPACC is 4.7439×10−2 K/W is achieved under the effective heat load of 1606.40 W with an air velocity of 3.0 m/s.

Figure 34C:
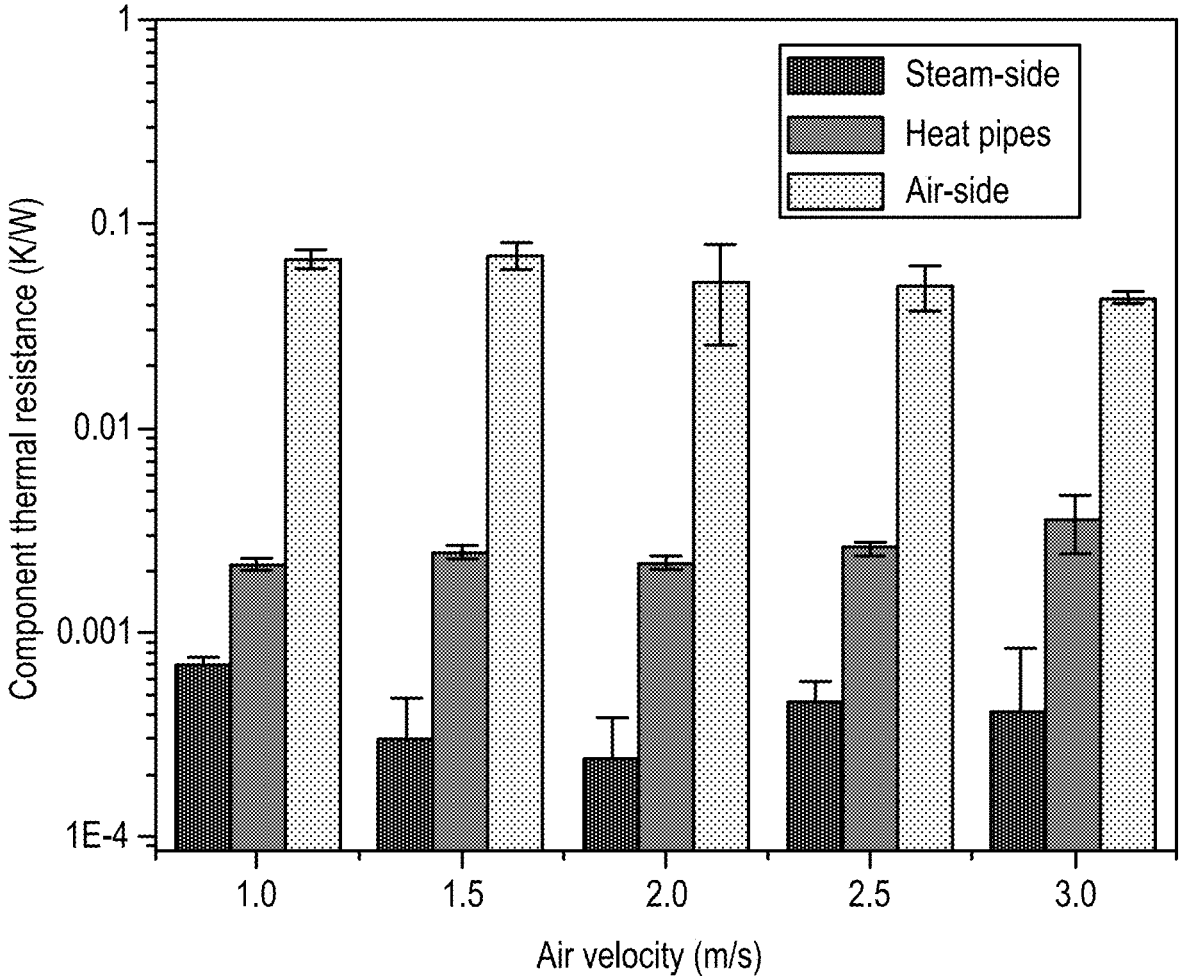
FIG. 34C shows thermal performance of HPACC under dry cooling component thermal resistance.

FIG. 34C shows the component level thermal resistance within HPACC under dry cooling. Under a given dry cooling condition, the air-side thermal resistance dominates the overall thermal resistance, which is about two orders higher than the steam-side thermal resistance. Within an increase in air velocity, the air-side thermal resistance slightly decreases, and the thermal resistance of heat pipes keeps constants with air velocity between 1.0 and 2.5 m/s. The highest thermal resistance of the heat pipe array is achieved at a velocity of 3.0 m/s, which may be due to the capacity limitation of heat pipes. The minimum steam-side thermal resistance is achieved at an air velocity of 2.0 m/s. It indicates the air-side cooling fully extracts the capacity of heat pipes and reduces the wall temperature of the condenser sections in heat pipes. However, the effects of air cooling are limited by the heat transfer capacity of heat pipes, i.e., the maximum heat transfer rate of the heat pipe. This results in a higher wall temperature for condensation, which deteriorates the condensation heat transfer.

Sweating-Boosted Air-Cooling (SBAC)

Figure 35A:
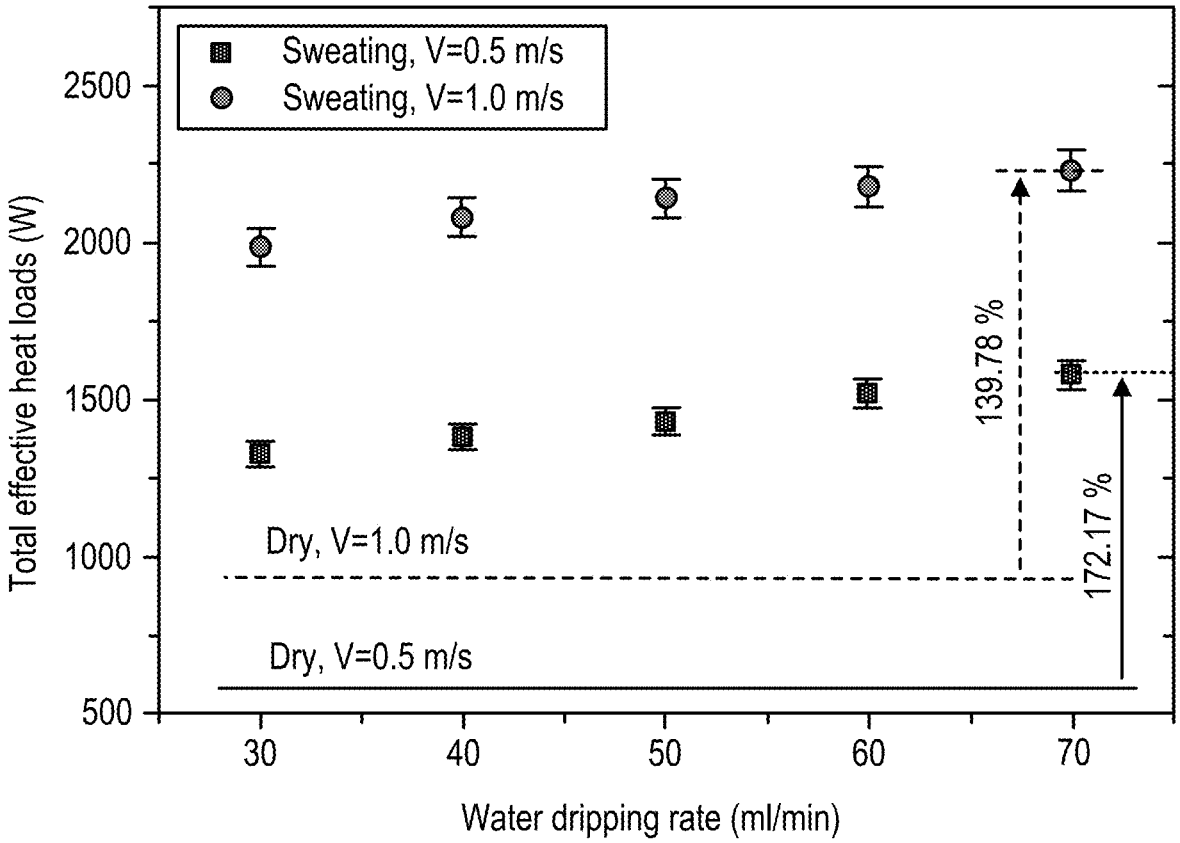
FIG. 35A shows thermal performance of HPACC under sweating-boosted air cooling for total effective heat loads.
Figure 35B:
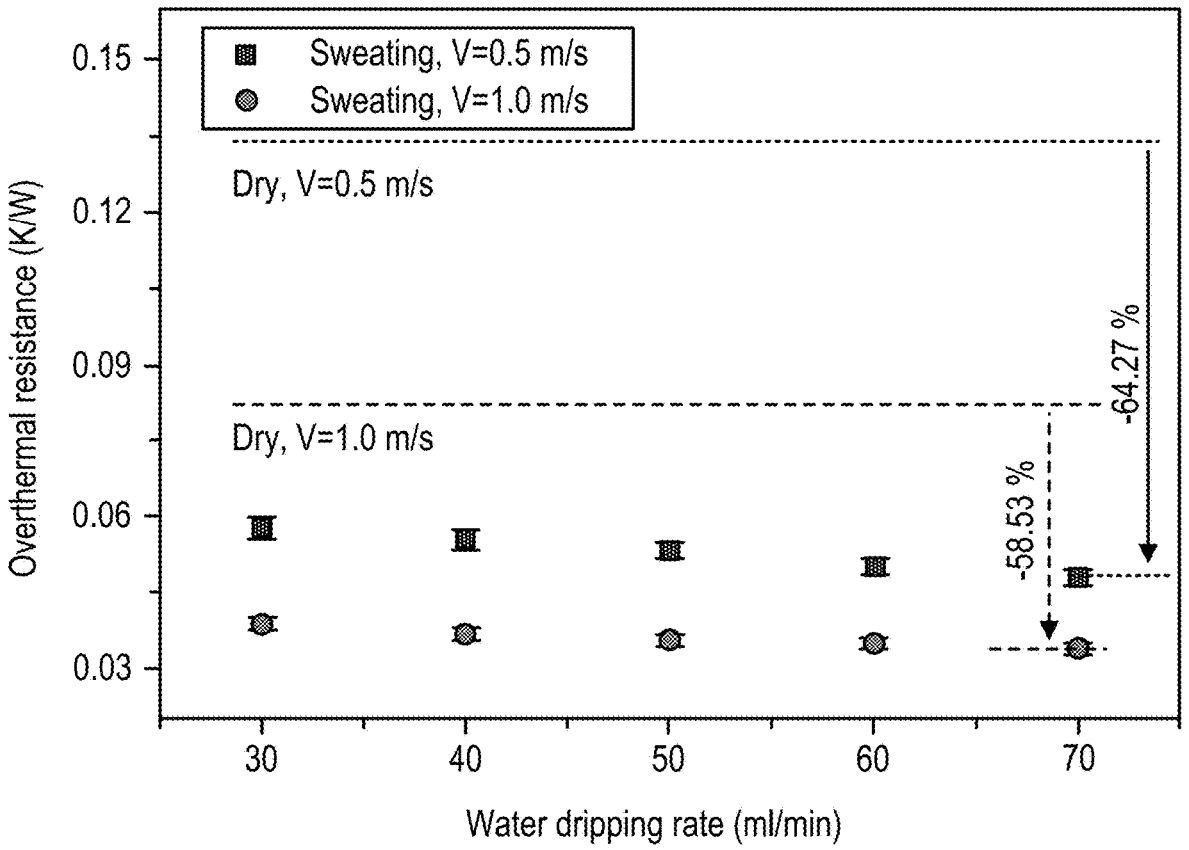
FIG. 35B shows thermal performance of HPACC under sweating-boosted air cooling for overall thermal resistance.
Figure 35C:
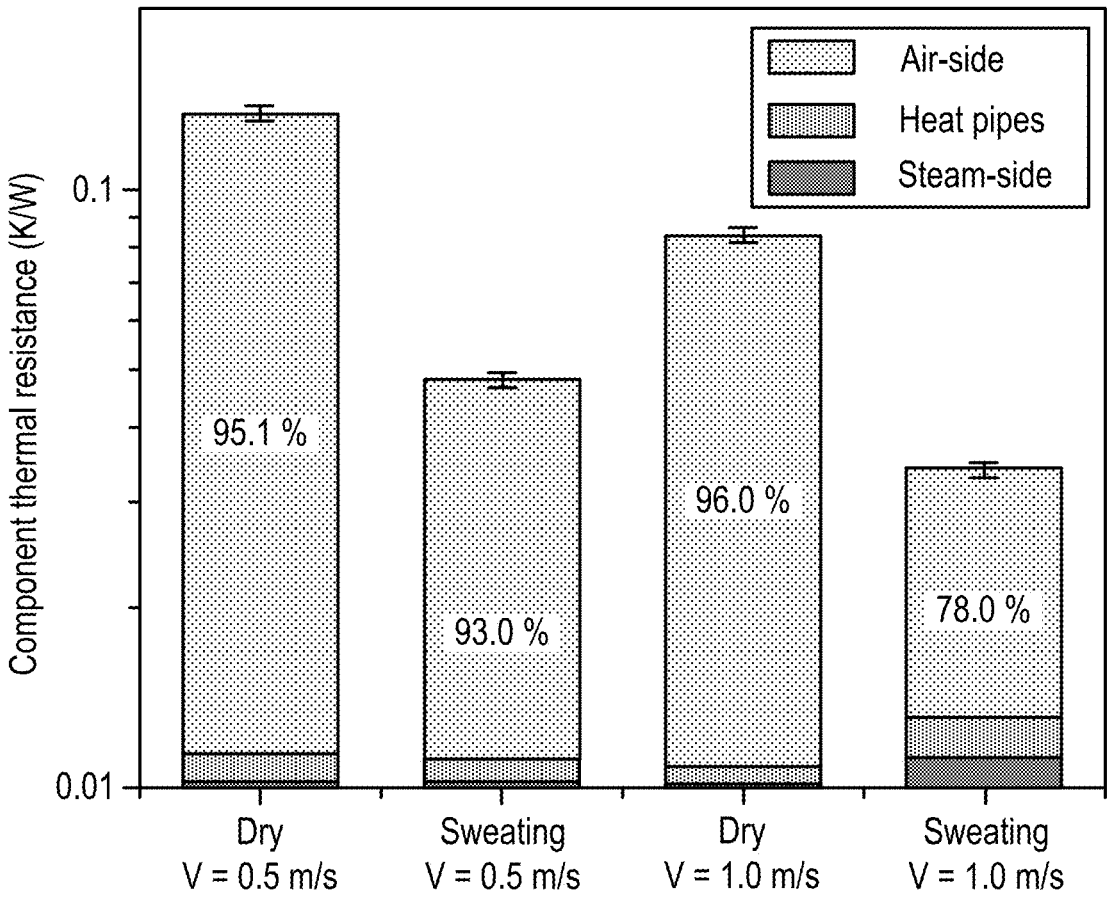
FIG. 35C shows thermal performance of HPACC under sweating-boosted air cooling for component-level thermal resistance (dripping water: 70 ml/min).

The sweating-boosted air-cooling (SBAC) is carried out at low air velocities ranging between 0.5 and 1.0 m/s. The saturated steam condition in the condensation chamber is maintained by keeping the steam temperature in the condensation chamber above 99.6° C. and no excess steam exhausts from the bypass. FIGS. 35A, 35B and 35C show that the thermal performance of HPACC is significantly improved by SBAC. The total effective heat loads are increased by 128.46% and 133.44% for air velocities of 0.5 and 1.0 m/s at a water dripping rate of 30 ml/min, respectively. The heat loads dissipated by HPACC are linearly enhanced with increasing of water dripping rate from 30 to 70 ml/min, owing to the continuous improvement of local wetting conditions within Cu-HDS/NO3 wick structures. Sweating-boost air cooling (SBAC) is promising to dramatically enhance the air-side heat transfer with a high water-efficiency. A superwetting copper hydroxyl nitrate (Cu-HDS/NO3) wicks was developed to improve the thermal performance of SBAC. Cu-HDS/NO3 crystals are directly synthesized on copper substrates using wet chemical oxidization and exhibit a superior wicking rate of 2.16 ml/s and a high thermal stability up to 225° C. SBAC on a finned tube coated with the developed wicks has been experimentally evaluated. We show that Cu-HDS/NO3 wicks enables dramatically enhanced HTCs of SBAC up to 379.9%. Increasing surface temperatures and air velocities can enhance the thermal performance of SBAC, but the effects of air velocities are more significant. The wicking capacity of micro/nanostructures plays a dominant role in deter-mining SBAC performance. We also found that an optimal operation condition exists in terms of the evaporative heat transfer in SBAC. An optimized air velocity needs to be identified in any specific applications of SBAC.

The trend of overall thermal resistance vs. water dripping rates is opposite to that of effective heat loads owing to a constant temperature between two fluid streams in HPACC-SBAC ($\Delta T$=75.33° C.). The highest thermal performance is achieved with a dripping water rate of 70 ml/min in this research. Typically, the total effective heat loads are improved with SBAC by 172.17% and 139.78%, and the overall thermal resistance is reduced by 64.27% and 58.53% at air velocities of 0.5 and 1.0 m/s, respectively. However, the maximum performance of HPACC may not be achieved in this disclosure because the saturated wetting condition has not been reached. Under the saturated wetting condition, the wick structures are fully covered by a thin liquid film, and hence, the sweating-boost air-cooling reaches peak performances (i.e., cannot be further improved by increasing water dripping rates). However, excess dripping water drains between some fins were observed during the experiments at high dripping rates (about 50-70 ml/min). This phenomenon indicated that the current water delivery system was insufficient for the sweating process; further enhancement is needed by improving global water delivery system, such as increasing the numbers of fiberglass wicks.

The sweating-boosted air cooling reduces three component-level thermal resistance, leading to a significant reduction in the overall thermal resistance, as shown in FIG. 35C. For instance, the contribution of air-side thermal resistance to the overall thermal resistance is reduced from 95.07% to 93.04% and from 95.99% to 77.99% for air velocity of 0.5 and 1.0 m/s, respectively. The facts are the effects of sweating-boosted air cooling on surface temperature are weaker than the dry air cooling, owing to the relatively constant temperature during the evaporative process. Therefore, the wall temperature of heat pipes is kept at a higher level, which leads to a smaller temperature difference at high heat loads. The percentage of air-side thermal resistance for sweating cooling at 0.5 and 1.0 m/s are identical. It is due to the trade-off between air velocity and surface temperature of fins. The higher temperature of fined surfaces achieved at lower air velocity would promote the diffusion rate at the water-vapor interface within the sweating process. However, a lower air velocity would weaken the convective mass transportation at the liquid-air interface. The experimental results demonstrated that the thermal performance of HPACC under the sweating-boost air cooling at a low air velocity of 0.5 and 1.0 m/s is compatible with those under dry cooling at much higher air velocities. The overall thermal resistance of HPACC with SBAC is $4.7837\times10^{-2}$ K/W at an air velocity of 0.5 m/s, compared with that of HPACC is $4.2766\times10^{-2}$ K/W without SBAC at an air velocity of 4.0 m/s. This high performance of SBAC at low air velocities is always benefiting in reducing power consumption and noise level of blow fans, which are cubic related to airflow rates. It makes the HPACC with SBAC more attractive in practical applications for thermal power plants and HVAC units. Future research will be carried out to improve the as-developed HPACC by developing the finned surfaces for more effective water transportation and adopting high-performance heat pipes with an optimized filling ratio.

A heat pipe based air-cooled condenser (HPACC) is proposed for green thermal power plants, and a lab-scale HPACC is built and characterized. Five heat pipes are fabricated with inner groves in the evaporator sections and finned surface outside of the condenser sections. A sweating-boost air cooling (SBAC) strategy is implanted by directly dripping distilled water on the fins integrated with copper hydroxyl nitrate wicks ($Cu_2(OH)_3NO_3$). For HPACC under dry cooling, the air-side thermal resistance dominates the overall thermal resistance; air velocity significantly affects the condensation performance of HPACC under dry cooling mode; the overall thermal resistance of HPACC has a minimum limit owing to the air/fin-side heat dissipation, and the steam-side thermal resistance significantly increases with air velocity. The sweating-boosted air cooling reduces three component-level thermal resistance within HPACC, leading to a significant reduction of the overall thermal resistance. The thermal performance of HPACC under the sweating-boost air cooling at a low air velocity is compatible with those under dry cooling at much higher air velocities. It makes the HPACC-SBAC more attractive in reducing operational cost and noise level.

As a summary, HPACC-SBAC combines the traditional heat pipe technology with a unique sweating-boost air cooling strategy for current cooling equipment of thermal power plants. The substantial water saving would help relieve the water crisis facing the world.

The current disclosure also shows that copper oxide (CuO) wicks played a critical role in the thermal performance of SBAC. The current disclosure provides superwetting copper hydroxyl nitrate (Cu-HDS/$NO_3$) wicks to further enhance SBAC on finned copper tubes. Cu-HDS/$NO_3$ crystals are directly synthesized on copper substrates via a three-step wet chemical oxidization process.

The time-dependent surface morphology and crystal structures of Cu-HDS/$NO_3$ are characterized by scanning electron microscope (SEM) and X-ray diffraction (XRD), respectively. The newly developed wicks are superior in spreading water and thermally stable for SBAC under a wide range of working conditions.

The performance of SBAC on a finned copper tube coated with Cu-HDS/NO3 wicks has been experimentally evaluated. The SBAC on as-developed wicks enhances the effective heat transfer coefficient (HTC) by 379.9% and reduces the total thermal resistance by 76.1%. The effects of wall temperature and air velocity on the thermal performance of SBAC are systematically characterized. We have shown that the super wicking capacity well complements the SBAC at low air velocity, hence makes the super wicking Cu-HDS/$NO_3$ more attractive in the practical applications of SBAC. The developed Cu-HDS/$NO_3$ wicks are promising in implementing SBAC strategy over current ACS.

Large-scale cooling systems are extensively used in extracting waste heat to the atmosphere in a wide range of applications including petrochemical industry, thermal power plants, and HVAC systems. They can be classified as water cooling systems (WCS), air cooling systems (ACS), and hybrid wet/dry cooling systems (HCS). WCS prevails owing to its relatively high heat transfer rate, low parasitic power consumption, and low overall cost. WCS accounts more than 99% in cooling thermoelectric plants in the United States and withdrew 133 billion gallons of fresh water per day in 2015, accounting for 41% of total freshwater withdrawal and 3% of total freshwater consumption. A water-efficient or even a dry solution for cooling systems is needed, which make the ACS more competitive. However, the disadvantages of ACS are several fold: large foot print, high capital cost, and susceptibility to the ambient temperature and humidity.

The inherent limitation of air cooling is its low heat transfer coefficient (HTC). Typical values of air/fin-side HTC in ACS for thermal power plants are at 10 W/($m^2$ K), which are two orders of magnitude lower than those in WCS (1 kW/($m^2$ K)). Air cooling performance of HCS can be significantly enhanced using the latent heat of vaporization. A small amount of water is delivered into the air flow of HCS as fine mists via spray nozzles and/or through evaporative media, or directly deluged over the heating surfaces. HCS consumes a significantly smaller amount of water, compared to WCS, but offers a significantly improved performance than ACS, especially on hot days. For example, HCS with surface deluge cooling has been proved to be a more cost-effective option for a 1 MW air-cooled geothermal power plant. However, HCS requires additional peripheral components and operating costs to generate the mists, and/or to eliminate the unevaporated mists to reduce the drift loss.

The surface deluge cooling can be characterized as simultaneous convective and evaporative heat transfer, where the liquid film evaporation plays a dominant role. Similar heat transfer processes have been extensively employed in various systems, such as water film falling along the internal channel walls in air humidifiers, falling film evaporation outside horizon tubes in desalination systems, and falling film of refrigerant in evaporators. The evaporation rates of liquid film are closely related to air properties (e.g., temperature and relative humidity (RH)), air flow conditions (e.g., natural convection, laminar, or turbulent), surface temperatures, and the configuration of liquid film.

Increasing velocity is an obvious way to enhance the liquid film evaporation, but it significantly increases the operating costs. Reducing the liquid film thickness is another option to improve the evaporative heat transfer, because a thinner liquid film leads to higher evaporation temperature and mass concentration at the liquid-air interface. Obtaining a homogeneous thin liquid film is challenging in the practical applications of falling liquid film evaporation. The distribution of liquid film with a small thickness could be more effectively promoted by modifying surface morphology with a porous layer, polypropylene fabric laid, and micro groves, and/or by changing surface wettability with fluorocarbon coatings, and plasma treatment.

Since more efficient evaporative heat transfer in HCS holds promise to address the challenge of ACS, by emulating the primary mechanism of mammals to effective dissipate heat during physical exercise, a sweating-boosted air cooling (SBAC) strategy was proposed and experimentally demonstrated in our previous studies. Water droplets were directly dripped on the surfaces, instead of forming a liquid film by flowing excess water over the heating surfaces. Water spread and formed a thin liquid film within the micro-scale wicks. This near-surface water dripping method significantly reduced the drift loss, compared with traditional HCS. The water usage efficiency was near 100%, as the only water consumption was for evaporation. A relative constant HTC of 180 W/($m^2$ K) was achieved on a grooved copper substrate coated with CuO wicks at thermal loads of 2.9-7.2 kW/$m^2$ and an air velocity of 6.0 m/s. However, the wetting capacity of atomic layer deposited $TiO_2$ thin films and CuO wicks was too weak to spread water globally over a large flat surface (size: 2 by 2 in.), herein microgrooves and/or copper woven meshes were used to promote the water spreading. More effective SBAC requires superwetting wicks that are durable, cost-effective, scalable, and compatible with complex copper surfaces.

Copper hydroxyl salts (Cu-HDS) have gained extensive attention due to their unique crystal structures, which can be taken as a quarter of anionic sites (—OH) in an octahedral unit of $Cu(OH)^2$ are replaced by negative ions, such as $NO_3^-$, $SO_4^{2-}$, and $ClO_4^-$. The presence of —OH groups in Cu-HDS enables a strong affinity to water, while the spaces between weakly bonded 2-D lamellar structures adsorb more water molecules. Among Cu-HDS, copper hydroxyl nitrate (Cu-HDS/$NO_3$) is particularly attractive due to its commercial applications as a precursor for preparing CuO and $Cu(OH)_2$. Traditional methods focus on synthesizing Cu-HDS/$NO_3$ nanoparticles via precipitation, liquid-solid methods, or hydrothermal process. However, applying these nanoparticles as surface coatings would lead to high thermal resistance and poor durability. Directly growth Cu-HDS/$NO_3$ crystals on copper substrates can dramatically reduce the contact thermal resistance, which is critical for the heat dissipation. Few synthesis methods have been reported, such as electrochemical depositions. These methods, however, cannot fabricate the Cu-HDS/$NO_3$ crystals on complex copper surfaces. Recently, copper hydroxyl sulfate (Cu-HDS/$SO_4$) was synthesized on a copper-coated nickel substrate using a wet chemical process. Herein, a similar procedure is developed to directly grow the Cu-HDS/$NO_3$ crystals on finned copper tubes.

The aim of the current disclosure is to develop superwetting wicks on finned copper tubes for SBAC. Cu-HDS/$NO_3$ crystals are directly synthesized on copper substrates using a three-step chemical oxidation process. The surface morphology and crystal components of Cu-HDS/$NO_3$ are characterized with scanning electron microscope (SEM) and X-ray diffraction (XRD), respectively. The wetting capacity and the thermal stability of Cu-HDS/$NO_3$ are characterized by droplet dynamics wetting tests and thermal gravimetric analysis (TGA), respectively. SBAC on finned copper tubes coated with Cu-HDS/NO3 wicks are experimentally evaluated.

The effects of water supply, air velocities, and surface temperature on the SBAC are systematically investigated.

Synthetization and Characterization of the Cu-HDS/$NO_3$ Crystals.

The finned copper tube is ultrasonically soaked in acetone for 10 min to remove the residual of oil/grease, then rinsed with methanol, isopropanol and distilled water consecutively, and dried with nitrogen gas. The sample is immersed into diluted sulfuric acid (10 wt %) to remove native copper oxide, rinsed with distilled water, and dried with nitrogen gas. The primary solution is prepared by dissolving potassium chlorate ($KClO_3$, 0.02 M) in distilled water, and its pH value is adjusted to 3 by adding several drops of diluted sulfuric acid (10 wt %). The cleaned sample is kept in the prepared solution at 60° C. for 12 h, then copper nitrate trihydrate ($Cu(NO_3)_2.3H_2O$, 0.1 M) is added into the primary solution and kept at 60° C. for another 120 h. The as-prepared sample is rinsed with distilled water and dried in a convection oven at 60° C. for 1 h.

Figure 36:
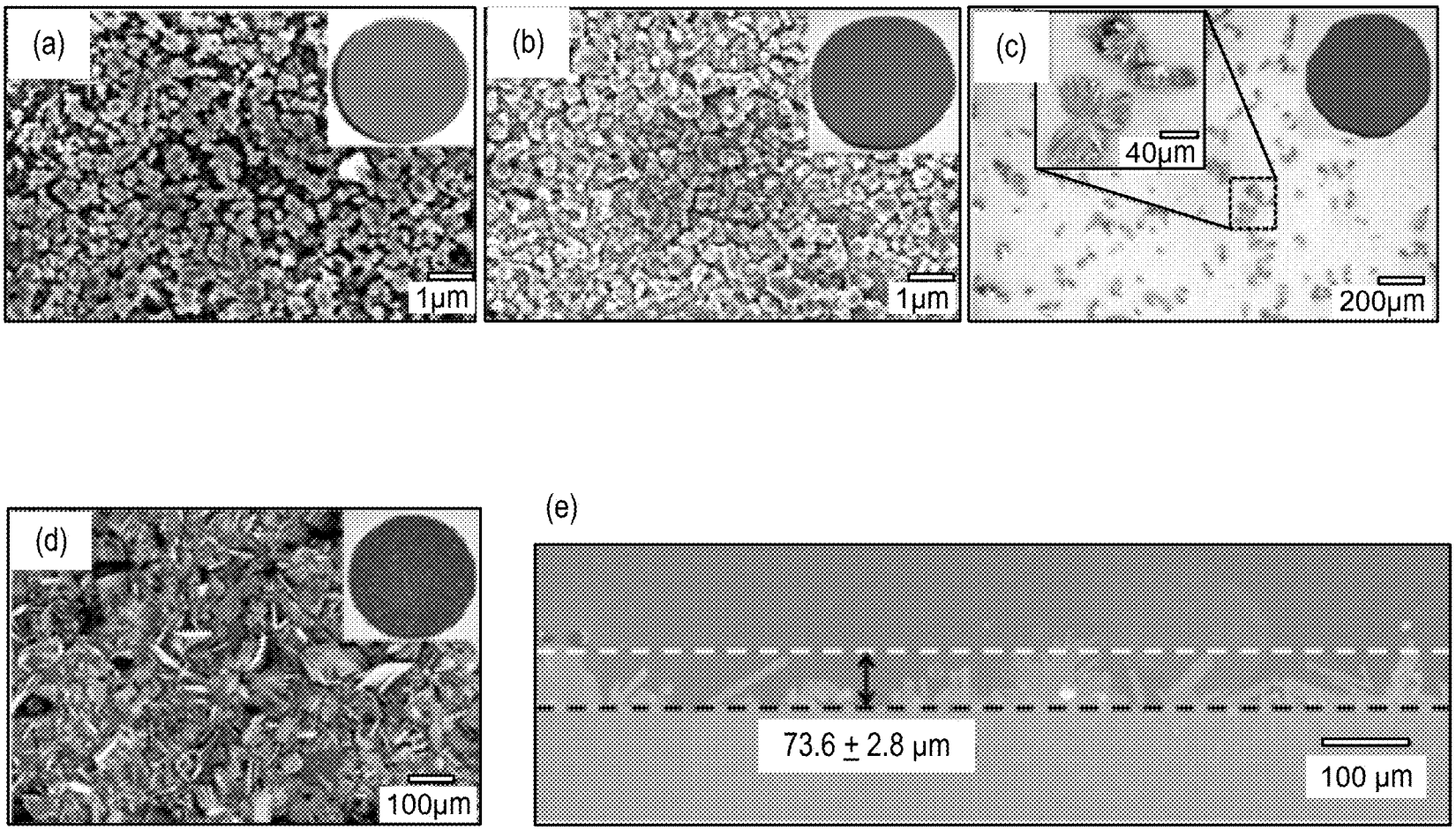
FIG. 36 shows time-dependent evolution of the surface morphology of Cu-HDS/$NO_3$ crystals.
Figure 37:
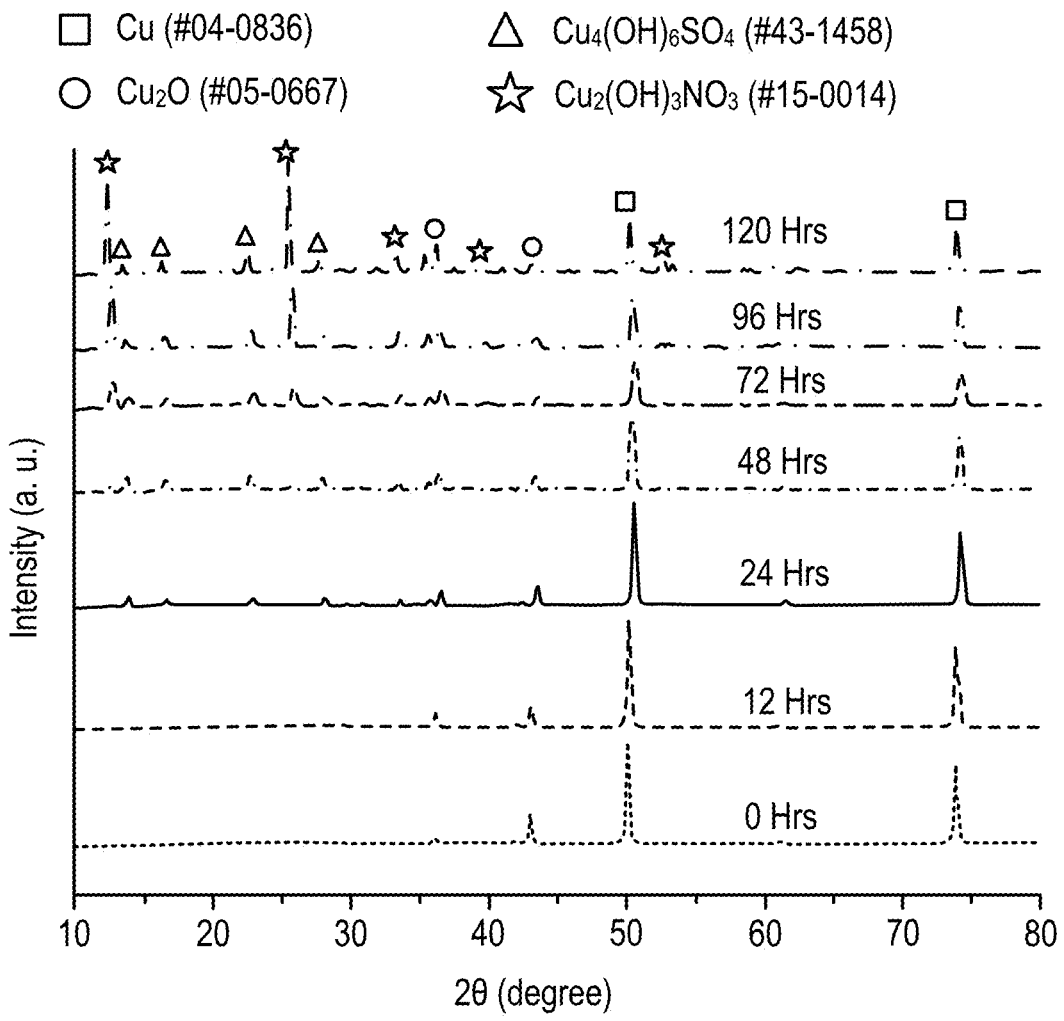
FIG. 37 shows time-dependent evaluation of crystal components characterized by XRD patterns.

The time-dependent evolution of surface morphology and crystal components of Cu-HDS/$NO_3$ wicks, shown in FIGS. 36 and 37, are characterized by SEM (Zeiss Ultra Plus FESEM) and XRD (Rigaku MiniFlex II desktop X-ray Diffractometer), respectively. FIG. 36 shows time-dependent evolution of the surface morphology of Cu-HDS/$NO_3$ crystals: SEM images of samples after reaction times of (a) 0 h (the $Cu_2O$ crystal), (b) 12 h, (c) 24 h, (d) 96 h. The inserts show the photo image of samples at the related times. (e) Cross-section of Cu-HDS/$NO_3$ wicks after a duration of 96 h. FIG. 37 shows Time-dependent evaluation of crystal components characterized by XRD patterns.

After 12 h reaction in the primary solution, the color of sample changes from the reddish brown to the raw umber. Cubic crystal structures of cuprite forms, which is identified from the XRD spectra (Cu2O, marked with d, PDF #05-0667). The chemical reaction in oxidizing copper by KClO3 can be given as $$6Cu+ClO_3^- \rightarrow 3Cu_2O+Cl^- \quad (1)$$

After adding copper nitrate, the grain size of $Cu_2O$ crystal increases, resulting in partially filling of gaps between grains after 12 h, and micro-scale butterfly-like crystals forms randomly after 24 h. The XRD spectrum indicates the monoclinic Brochantite crystal forms firstly ($Cu_4(OH)_6SO_4$, marked with ▲, PDF #43-1458), then the Rouaite follows ($Cu_2(OH)_3NO_3$, marked with w, PDF #15-0014). The involved reaction can be expressed as $$2Cu_2O+SO_4^{2-}+4H_2O \rightarrow Cu_4(OH)_6SO_4+2H^++4e^- \quad (2)$$

$$Cu_2O+NO_3^-+2H_2O \rightarrow Cu_2(OH)_3NO_3+H^++2e^- \quad (3)$$

The reaction in Eq. (3) dominates the synthetization process because the reaction in Eq. (2) is inhibited by a low concentration of $SO_4^{2-}$, which is only used for adjusting the pH value of the primary solution. More crystals germinate and grow with an increasing reaction time, resulting in a color change from the reddish to the blue-green. After 96 h, Cu-HDS/$NO_3$ crystals fully cover the copper substrate with a thickness of 73.6±2.8 mm (see FIG. 36 at (e)).

Liquid Wicking Capacity of the Cu-HDS/$NO_3$ Wicks

Figure 38:
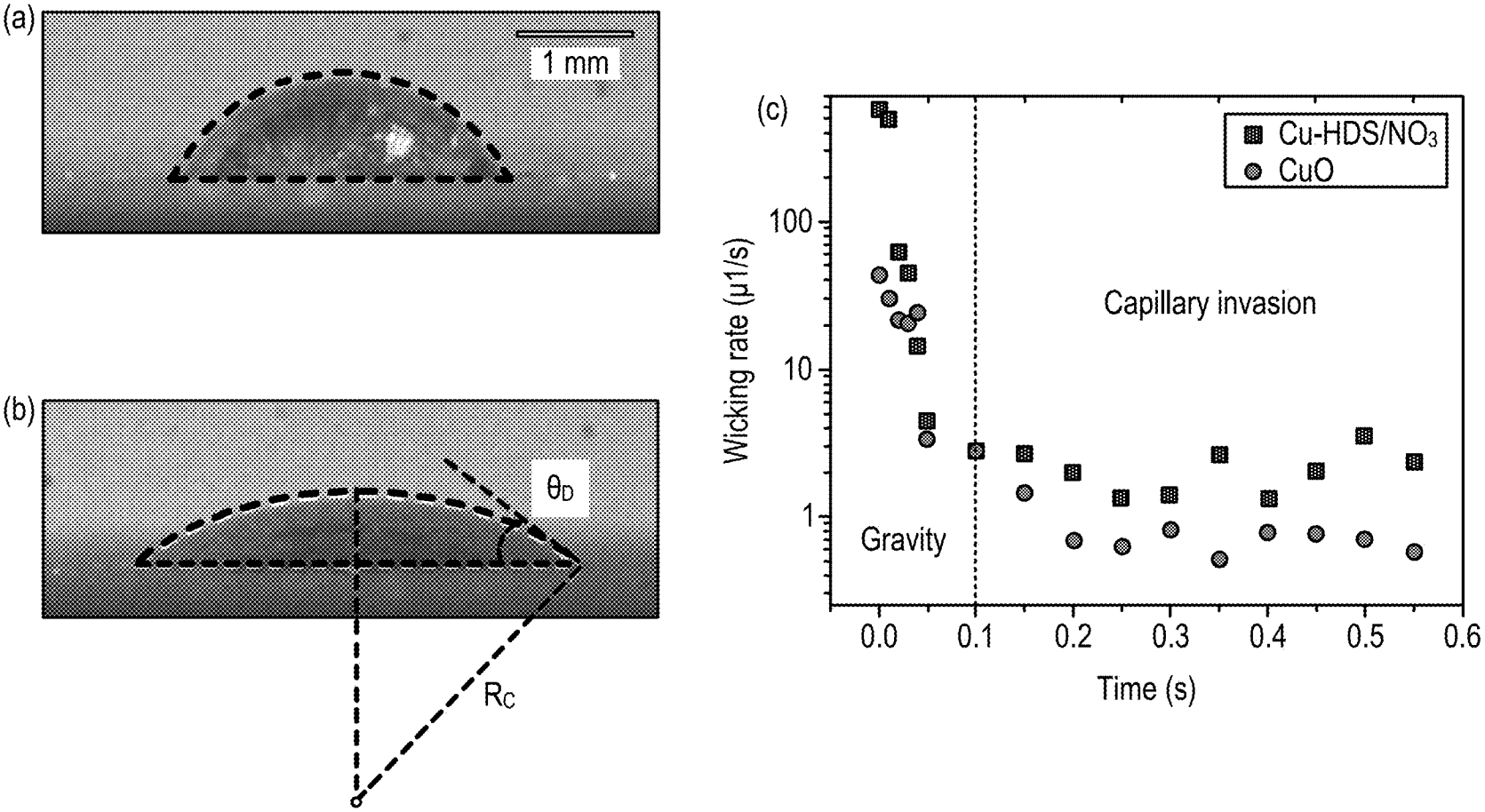
FIG. 38 shows wetting capacity of the u-HDS/$NO_3$ wicks.
Figure 39:
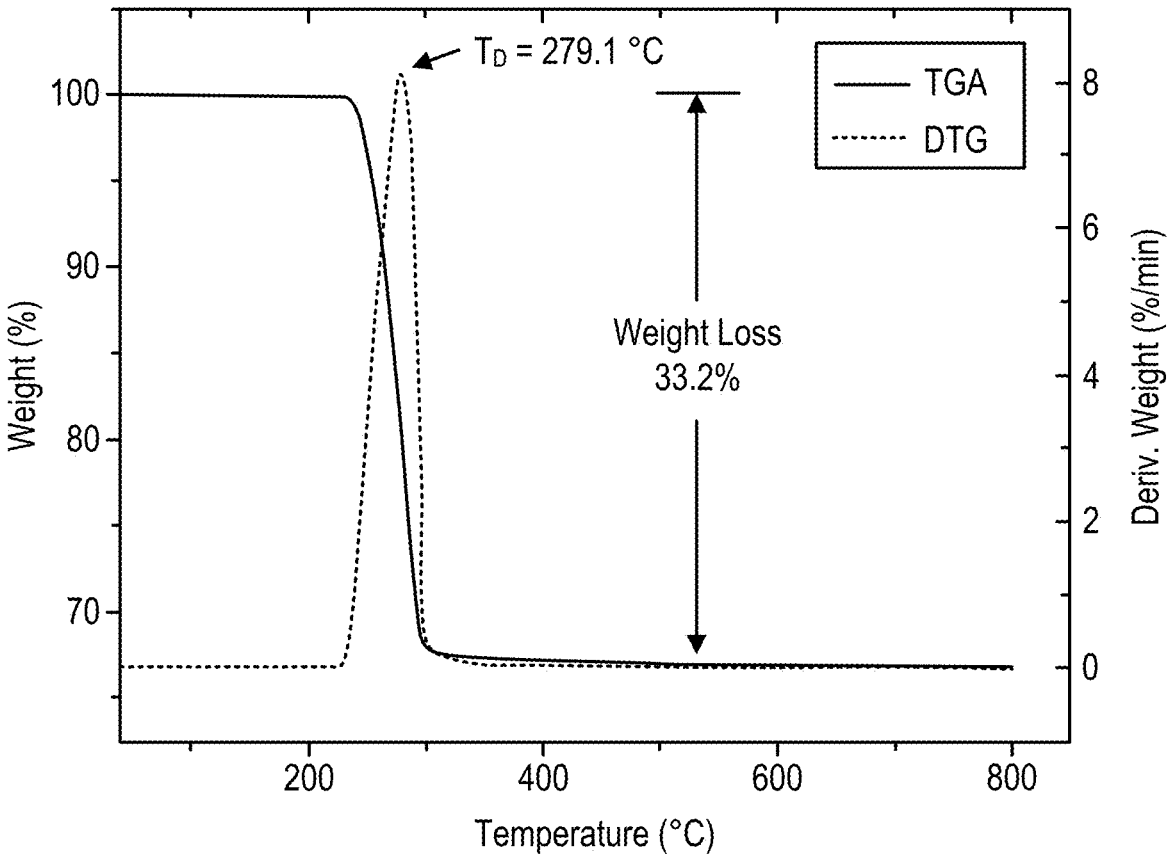
FIG. 39 shows Thermal gravimetric analysis curves of the Cu-HDS/$NO_3$ wicks.

The liquid wicking performance of Cu-HDS/$NO_3$ wicks is evaluated by droplet dynamics wetting tests. A 10 ml water droplet is gently loaded on the wicks, and its volume during the spreading process is recorded by a high-speed camera at 100 fps (Micro-Ex4, Phantom). The wetting process consists of three stages, namely direct impacting, spreading under gravity (FIG. 38 at (a)), and spreading driven by the capillary invasion (FIG. 38 at (b)). FIG. 38 shows wetting capacity of the u-HDS/$NO_3$ wicks. The evolution of water droplet profile during spreading process driven by (a) gravity, and (b) capillary invasion, (c) The water wick in grates on the Cu-HDS/$NO_3$ wicks. FIG. 39 shows thermal gravimetric analysis curves of the Cu-HDS/$NO_3$ wicks. The water wicking rate, U, is obtained from the droplet's volume changing at a given time, given as $$U = \frac{1}{4}\pi r^2\theta_D^3\left(3\theta_D\frac{dr}{dt} + 4r\frac{d\theta_D}{dt}\right) \quad (4)$$

where r and $\theta_D$ are the radius of curvature and the dynamics contact angle of water droplets, respectively, which are determined from the profiles of water droplet as shown in FIG. 38 at (b). The wicking rate reduces significantly at the stage of gravity-driven spreading on the Cu-HDS/$NO_3$ wicks, as shown in FIG. 38 at (c). After 0.1 s, the wicking rate keeps constant (about 2.16 ml/s) when the liquid spreading is driven by the capillary invasion. The time-dependent evaluation of wicking rates on the CuO wicks is similar as that on the Cu-HDS/$NO_3$ wicks, but the wicking rate of CuO is about 0.68 ml/s, accounting for 31.5% of that on the Cu-HDS/$NO_3$ wicks.

Thermal Stability of the Cu-HDS/$NO_3$ Crystals

The thermal stability of as-prepared Cu-HDS/$NO_3$ crystals is evaluated using thermal gravimetric analysis (TGA, Q5000SA, TA Instruments) at a heating rate of 10° C./min in air atmosphere. TGA curve demonstrates a single-step thermal decomposition of Cu-HDS/$NO_3$ at the temperature range of 225-315° C. (see FIG. 39). The total weight loss is 33.2 wt %, which agrees well with the theoretical weight loss of 33.8 wt % and the other's experimental data of 34.7 wt %. The differential thermogravimetric (DTG) curve indicates that the thermal decomposition becomes significant at 279.1° C., which is much higher than the operational temperature of ACC (typically 40-60° C.). Therefore, Cu-HDS/$NO_3$ wicks are highly thermally stable for its application in SBAC.

Experimental System and Data Processing

Figure 40:
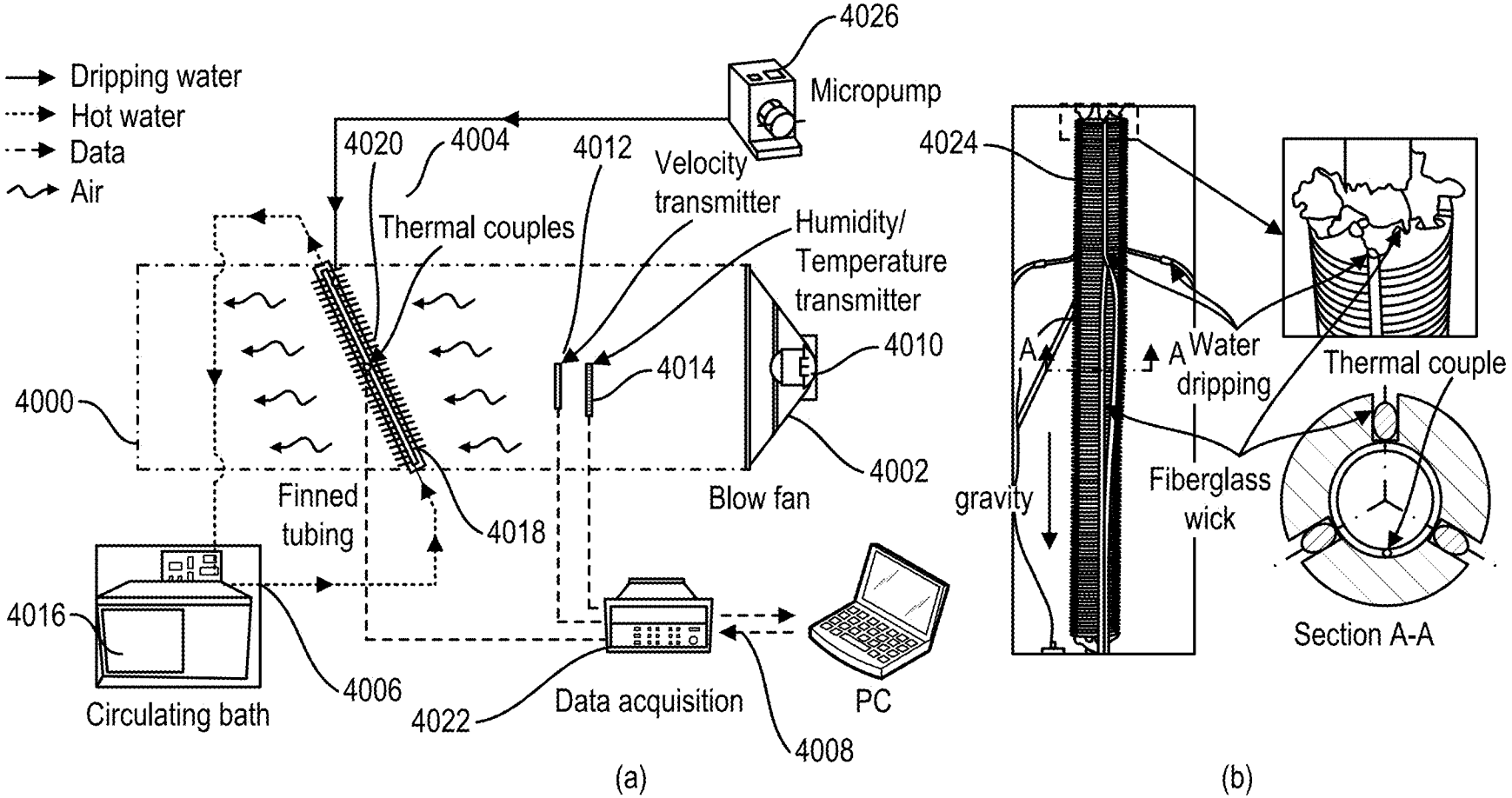
FIG. 40 shows an experimental system for SBAC on a Cu-HDS/$NO_3$ wicks.

An experimental system 4000 is set up to evaluate the thermal performance of SBAC on a finned copper tube coated with Cu-HDS/$NO_3$ wicks (see FIG. 40 at (a) and at (b)). FIG. 40 shows an experimental system for SBAC on a Cu-HDS/NO3 wicks: (a) Experimental system; and at (b) a finned copper tube coated with Cu-HDS/NO3 wicks. The system 4000 comprises four sub-systems: a wind tunnel 4002, a water dripping system 4004, a hot water system 4006, and a data acquisition system 4008. Air flow is driven with a blow fan 4010, controlled by a Variac variable transformer and measured with an air velocity transmitter 4012 (FMA903R-V1, Omega). The temperature (21.0±0.5° C.) and RH (55±3%) of inlet air are measured with a RH/Temp transmitter 4014 (HX-94C, Omega). Hot water, driven with a circulating water bath 4016 (RTE-4DD, Neslab), is used to simulate thermal loads on the finned tube 4018. The inlet/outlet temperatures and flow rates of hot water are measured with T-type thermocouples 4020 and a flow meter (FPR1504, Omega), respectively. The wall temperature of finned tube is measured with T-type thermocouples mounted on the backside of the finned tube. All the data are collected with a data acquisition unit 4022 (34972A, Agilent) and recorded with a LabVIEW program.

The finned tube 4024 is installed vertically in the duct of wind tunnel. The fins are cut with several slots (W=2 mm), which are mounted with fiberglass wicks ($\phi_{fb}$=4 mm) for global liquid transportation, see FIG. 40 at (b). The distilled water, driven with a micropump 4026 (GA-X21, Ismatec), is directly dripped on top of fiberglass, and distributed vertically along the fiberglass wicks. The water further spreads horizontally over the fin surface, which is driven by the capillary pressure within the Cu-HDS/$NO_3$ wicks.

Data Processing and Uncertainty Analysis

The thermal loads dissipated by SBAC are determined from the thermal balance of hot water that flows through a finned tube, $$\Phi=(1-\chi)\dot{Q}\rho C_p(T_{l,in}-T_{l,out}) \quad (5)$$

where Φ is the effective thermal loads dissipated from exposed surfaces; χ is the heat loss of experiment system, $\dot{Q}$ is the volume flow rate of hot water. ρ, $C_p$, $T_{l,in}$, and $T_{l,out}$ are the density, thermal capacity, inlet and outlet temperatures of hot water, respectively.

The effective HTC of SBAC, hSBAC, is determined as $$h_{SBAC}=\Phi/[A(T_S-T_0)] \quad (6)$$

where $T_0$ is the air inlet temperature, and $T_0$=21:0±0:5 C. $T_s$ is the surface temperature of finned tube, which is determined as a linear function of thermal resistance networks under a 1-D assumption.

$$T_s=T_w+\Phi(R_{Cu}+R_{Cu\text{-}HDS}+R_l) \quad (7)$$

where $T_w$ is the measured wall temperature of finned tube. $R_{Cu}$ is the thermal resistance from the location of thermocouples to the bottom of Cu-HDS wicks, $R_{Cu-HDS}$ is the thermal resistance of Cu-HDS/$NO_3$ wicks. $R_l$ is the thermal resistance of the liquid film above the coatings (assumed the thickness 50 mm). The thermal conductivity of Cu-HDS/$NO_3$ is unavailable, herein the thermal conductivity of CuO ($k_{CuO}$=21.43 W/(m·K)) is adopted to evaluate the thermal resistance of Cu-HDS/$NO_3$ wicks.

The A in Eq. (6) is the exposed surface area of a finned tube, and it is calculated as $$A=A_r+\eta_f A_f \tag{8}$$

where $A_r$ is the exposed root area of a finned tube, and $A_f$ is the total surface area of fin. $n_f$ is the fin efficiency for a circular fin, which is given in terms of the modified Bessel functions.

The total thermal resistance of a finned tube coated with Cu-HDS/$NO_3$ wicks, $R_{tot}$, is written as $$R_{tot}=\Delta T_m/\Phi \tag{9}$$

where $\Delta T_m$ is the log mean temperature difference, and given as $$\Delta T_m = \frac{\Delta T_{in} - \Delta T_{out}}{\ln(\Delta T_{in}/\Delta T_{out})} \text{ with } \Delta T_{in} = T_{l,in} - T_0, \Delta T_{out} = T_{l,out} - T_0 \tag{10}$$

The uncertainties of measured parameters are estimated from the specifications of instruments, the uncertainties of derived parameters are calculated using the Kline and McClintock method, the uncertainties are shown in FIG. 41.

Calibration of Experimental System

The biggest uncertainty in evaluating the thermal performance of SBAC primarily originates from the heat loss of experimental system. To estimate the heat loss, the experimental system is calibrated using forced air convection without evaporation over a smooth copper tube ($\phi_{st}$=14.0 mm). The air velocity ranges from 1.0 to 5.0 m/s, corresponding to Reynolds numbers (Re) ranging from 806.1 to 3,972.5. Nusselt number (Nu) for the forced air convection over a circular cylinder can be empirically predicted as $$Nu=0.683Re^{0.466}Pr^{1/3} \text{ for } 40<Re<4{,}000 \tag{11}$$

Figure 42:
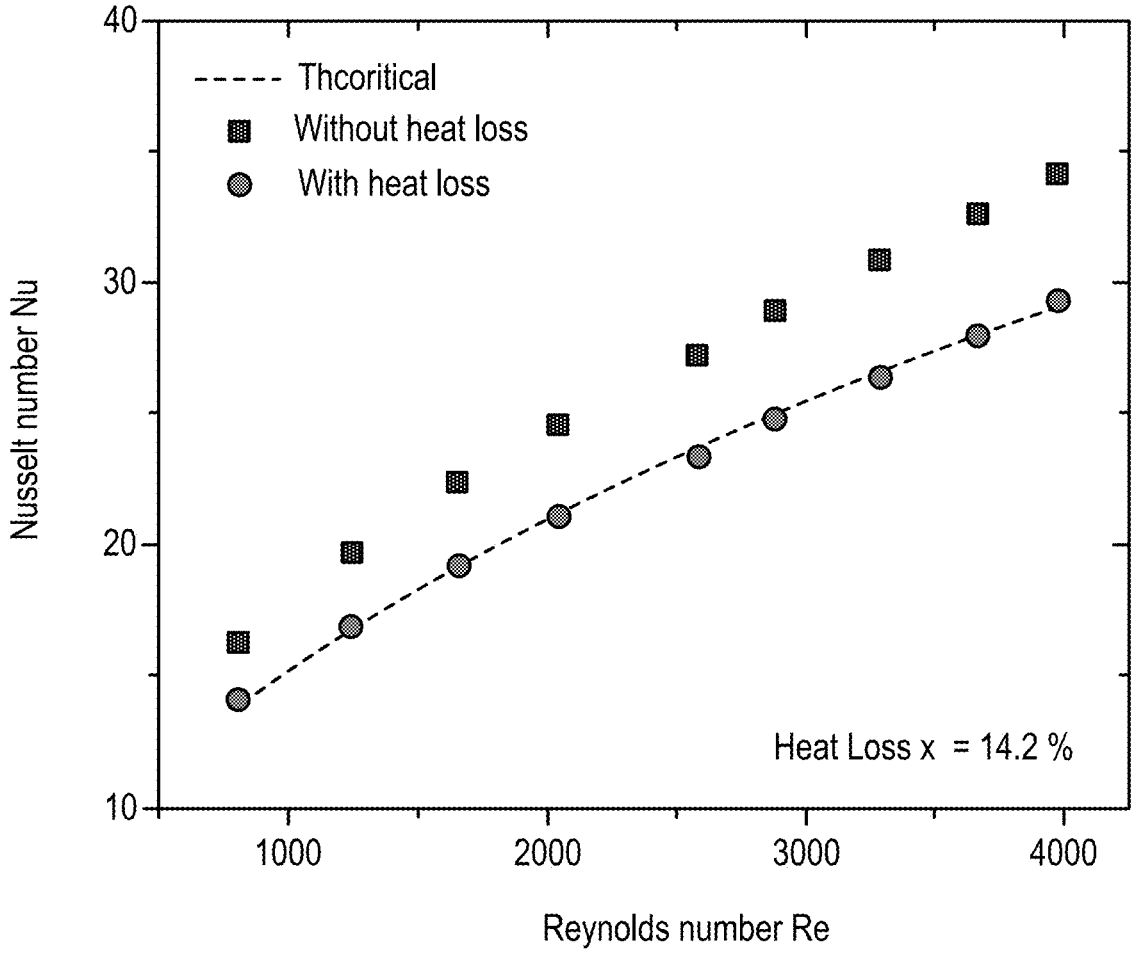
FIG. 42 shows calibration of the experimental system.

The factor of heat loss is applied as a correction factor between the experimental and theoretical data. Curve fitting shows an estimated heat loss of 14.2%, as illustrated in FIG. 42.

Effects of Water Supply

The water supply plays a dominant role in dissipating heat in SBAC because adequate water is required to make up the evaporative loss. Previously, SBAC was carried out on grooved copper surfaces coated with CuO wicks, and three wetting conditions were identified as dry, partial wetted, and flooded. An optimized heat dissipation of SBAC was achieved at the saturated wetted condition, where the heating surface was fully covered by a thin liquid film. In this research, more effective water supply on the finned tube is achieved using fiberglass wicks at global level, and water eventually spread locally by superwetting Cu-HDS/$NO_3$ wicks.

Figure 43:
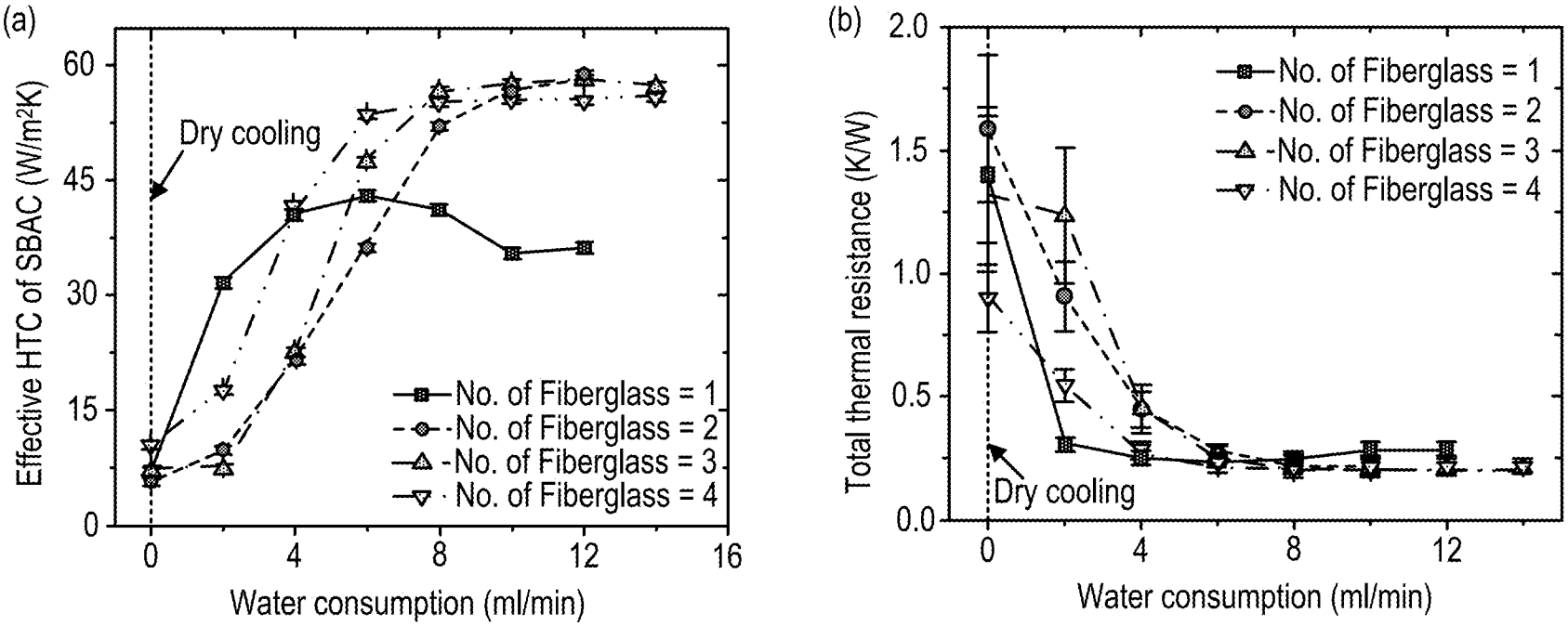
FIG. 43 shows the effects of global water transportation on the SBAC.

The global liquid transportation is provided by vertically mounted fiberglass, where strong water imbibition is driven by gravity and capillary pressure. Various liquid supply routes are achieved by different numbers of fiberglass wicks, and their effects on the thermal performance of SBAC are shown in FIG. 43. FIG. 43 shows the effects of global water transportation on the SBAC at (a) effective HTC of SBAC and at (b) total thermal resistance of finned tubes coated with wicks. (Surface temperature: 49.6±0.2° C., Air velocity: 1.02±0.01 m/s). Under a given water supply condition, both the effective HTC of SBAC and the total thermal resistance of finned tube are linearly improved with increasing water consumption until the fin surfaces are fully covered by water film (i.e., the saturated wetted conditions). Then, a further increase in water supply would not improve the effective HTC or even slightly deteriorate it. Although the actual wetting conditions within wicks are challenging to recognize, the curves of effective HTCs vs. water consumption clearly indicate that the evolution of surface wetting conditions from partial wetted to flooded, which are identical to those on grooved flat surfaces in our previous research.

The performance of SBAC is significantly enhanced when the number of fiberglass wicks increases from 1 to 2. The effective HTCs are 41.0±0.5 and 56.9±0.5 W/($m^2$ K) at the saturated wetted conditions, the thermal loads are 164.5±14.6 and 202.2±13.2 W, and the water consumptions are 6 and 8 ml/min for finned tubes with 1 and 2 fiberglass wicks, respectively. The thermal performance is slightly improved with 3 fiberglass wicks but deteriorates a bit with 4 wicks. A relatively stable performance of SBAC is achieved with an effective HTC about 37.4 W/($m^2$K) and the thermal loads about 210.0 W at surface temperature 49.6±0.2° C. and air velocity 1.02±0.01 m/s. In practical application, more fiberglass wicks require additional costs of fabrication and maintenance, herein the number of fiberglass wicks is recommended as 2 in this research.

Figure 44:
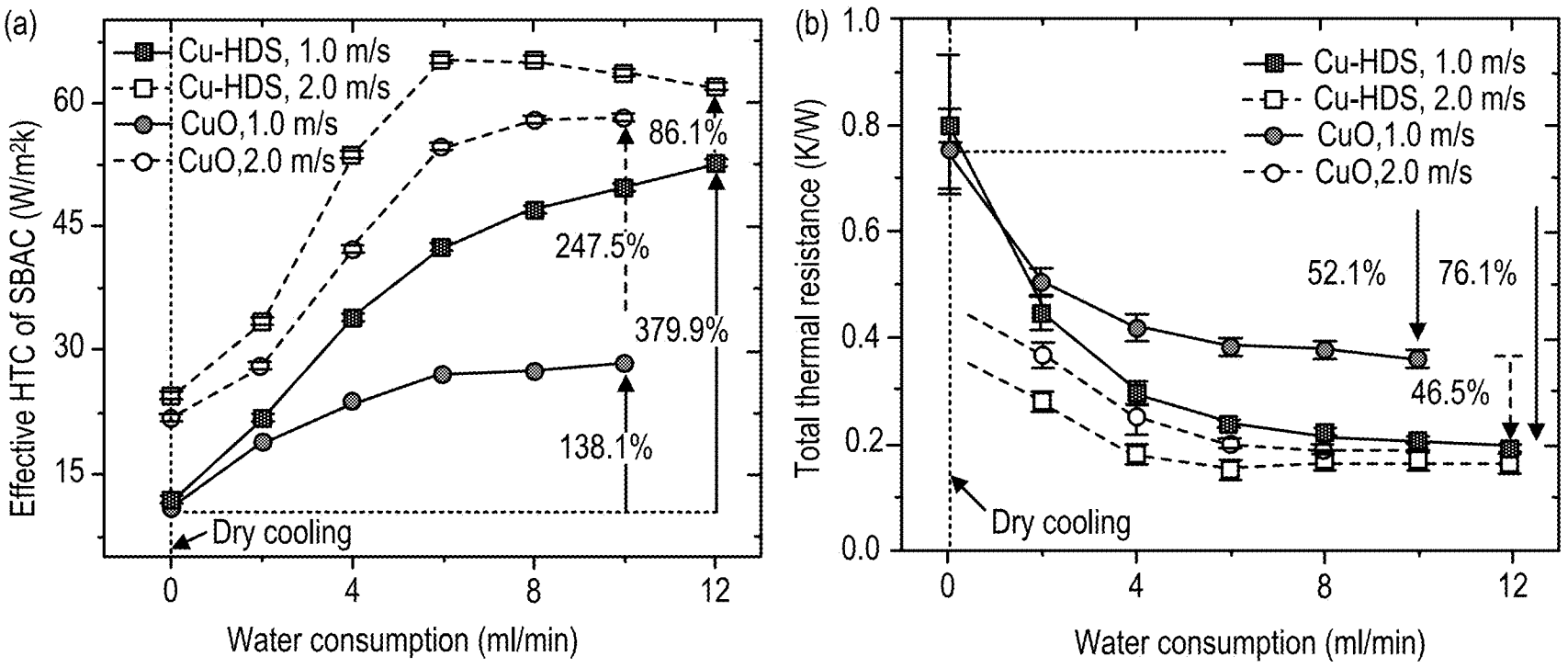
FIG. 44 shows effects of surface coatings on the SBAC.

The effects of local liquid transportation provided by the wick structures of surface coatings, including microscale Cu-HDS/$NO_3$ wicks and nanoscale CuO wicks, are shown in FIG. 44. FIG. 44 shows effects of surface coatings on the SBAC at (a) effective HTC of SBAC and at (b) total thermal resistance of finned tubes coated with wicks. (Number of fiberglass wicks: 2, Surface temperature: 59.5±0.3° C.). The convective heat transfer (i.e., dry cooling without sweating boosted) on the CuO wicks, at wall temperature of 60.0° C. and air velocity of 1.0 m/s, is adopted as a baseline for comparison. The SBAC dramatically improves the air-side heat transfer rates, the effective HTCs of SBAC are enhanced by 379.9% and 138.1%, and the total thermal resistances are reduced by 76.1% and 52.1% on the Cu-HDS/$NO_3$ wicks and the CuO wicks, respectively. The effective HTC of SBAC is improved by 84.0%, and the total thermal resistance is reduced by 46.5%, when the liquid wicking rate increases from 0.68 ml/s, for the CuO wicks, to 2.16 ml/s, for the Cu-HDS/$NO_3$ wicks. The reason is that thinner liquid films can be formed on the superwetting Cu-HDS/$NO_3$ wicks, resulting in a smaller thermal resistance of liquid film. Moreover, liquid meniscuses formed within the microstructures of Cu-HDS/$NO_3$ greatly extend effective evaporation area and intensifies local evaporation.

The current disclosure also shows that the thermal performance of SBAC can be further improved by increasing the air velocity owing to improved liquid spreading over the fin surfaces by a higher shear force. The effective HTC of SBAC is further increased by 247.5% owing to the CuO wicks; while only by 86.1% owning to the Cu-HD S/$NO_3$, when the air velocity increases from 1.0 to 2.0 m/s. It indicates that the super wicking capacity well complements SBAC at low air velocity, making the superwetting Cu-HDS/NO3 wicks more attractive in the practical applications of SBAC. Since higher air velocity accompanies with dramatically increased pressure drop and higher operating costs of ACS.

Effects of Surface Temperature

As a typical convective heat and mass transfer process, the effective HTC of SBAC in Eq. (6) can be rewritten as $$h_{SBAC}=h_{conv}+h_{evap}=h_{conv}+m''h_{fg}/[A(T_s-T_0)] \quad (12)$$

where $h_{conv}$ and $h_{evap}$ are HTCs for the convective and the evaporative heat transfer, respectively. The thermal load dissipated in the evaporative heat transfer is related to the latent heat, $h_{fg}$, and the evaporation rate (i.e., the convective mass transfer rate), $m''$, which is driven by the vapor mass fraction between the water film and the air, given as $$m'' = h_{mass}(Y_s(T_s) - Y_0(T_0, RH)) = \frac{\rho D}{1-Y_s}\frac{dY}{dn}\bigg|_{n=0} \quad (13)$$

where $h_{mass}$ is the mass transfer coefficient, $Y_s$ is the vapor mass fraction at the surface of liquid film. $Y_0$ is the vapor mass fraction in the air, which is related to the temperature and RH. D is the water-vapor mass diffusion coefficient, which is related to the temperature at the liquid-vapor interface. By taking the mean free path and average velocity for water molecules in an ideal gas from the Maxwell-Boltzmann distributions, the diffusion coefficient can be empirically expressed as $$D \sim T_s^{1.685} 0° \text{ C.} < T_S < 100° \text{ C.} \quad (14)$$

Eqs. (13) and (14) indicate that the evaporation rate is related to the mass diffusion coefficient and the gradient of mass fraction at the water-air interface.

Figure 45:
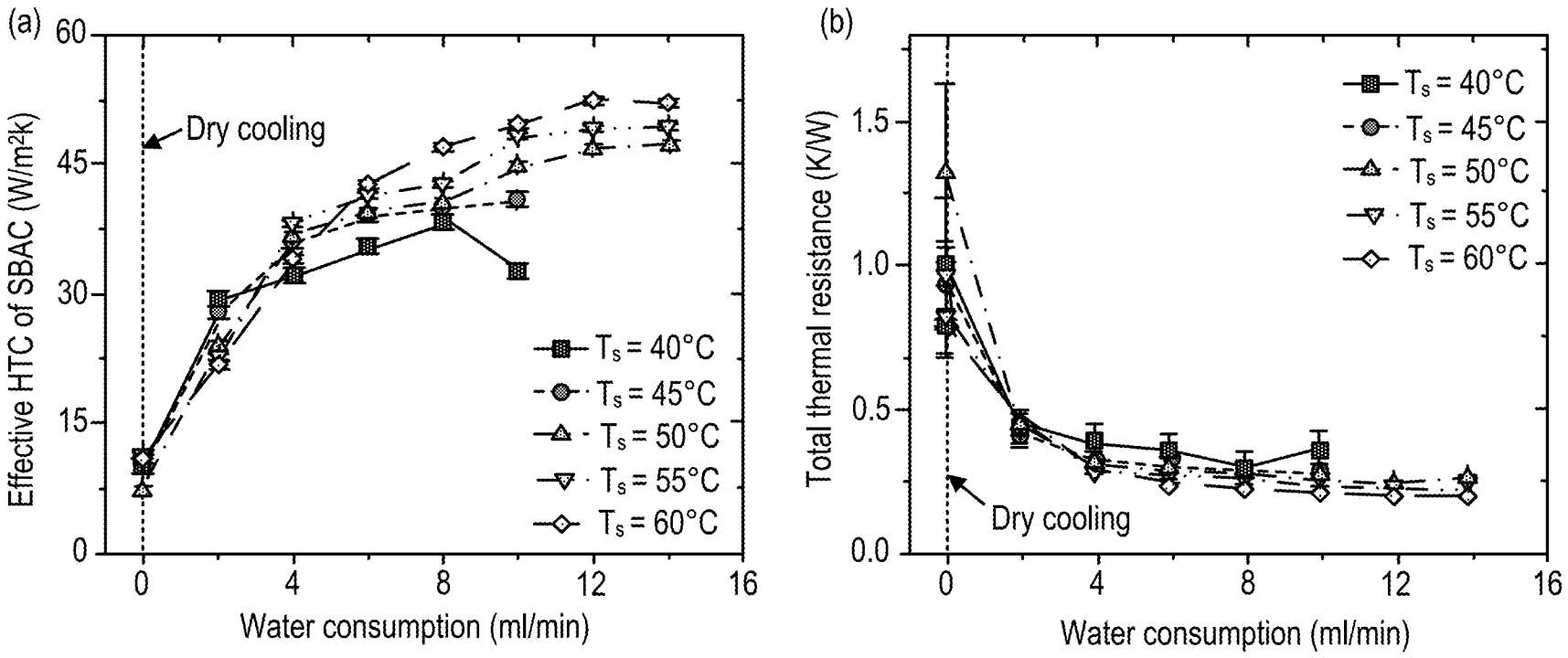
FIG. 45 shows the effects of surface temperature on the SBAC.

The effects of surface temperature on the performance of SBAC at air velocity of 1.0 m/s are shown in FIG. 45. FIG. 45 the effects of surface temperature on the SBAC at (a) effective HTC of SBAC and at (b) total thermal resistance of finned tubes coated with wicks. (Number of fiberglass wicks: 2, Air velocity: 1.01±0.01 m/s). It shows that the heat dissipation performance is continuously improved with an increase in surface temperature, indicating that the evaporative heat transfer plays a dominant role in heat dissipation. The contribution of surface temperature is limited for convective heat transfer because its effects are in terms of thermal properties of air near the heating surfaces, while high surface temperature directly leads to intense water-vapor transportation for evaporative heat transfer, as indicated by Eq. (14). As a result, the effective HTC of SBAC increases from 38.5 to 52.6 W/($m^2$ K), and the total thermal resistance decreases from 0.348 to 0.193 K/W when the surface temperature increases from 40 to 60° C. Moreover, the thermal loads significantly increase from 92.7 to 263.1 W due to a larger temperature difference established between the heating surface and air.

Effects of Air Velocity

Figure 46:
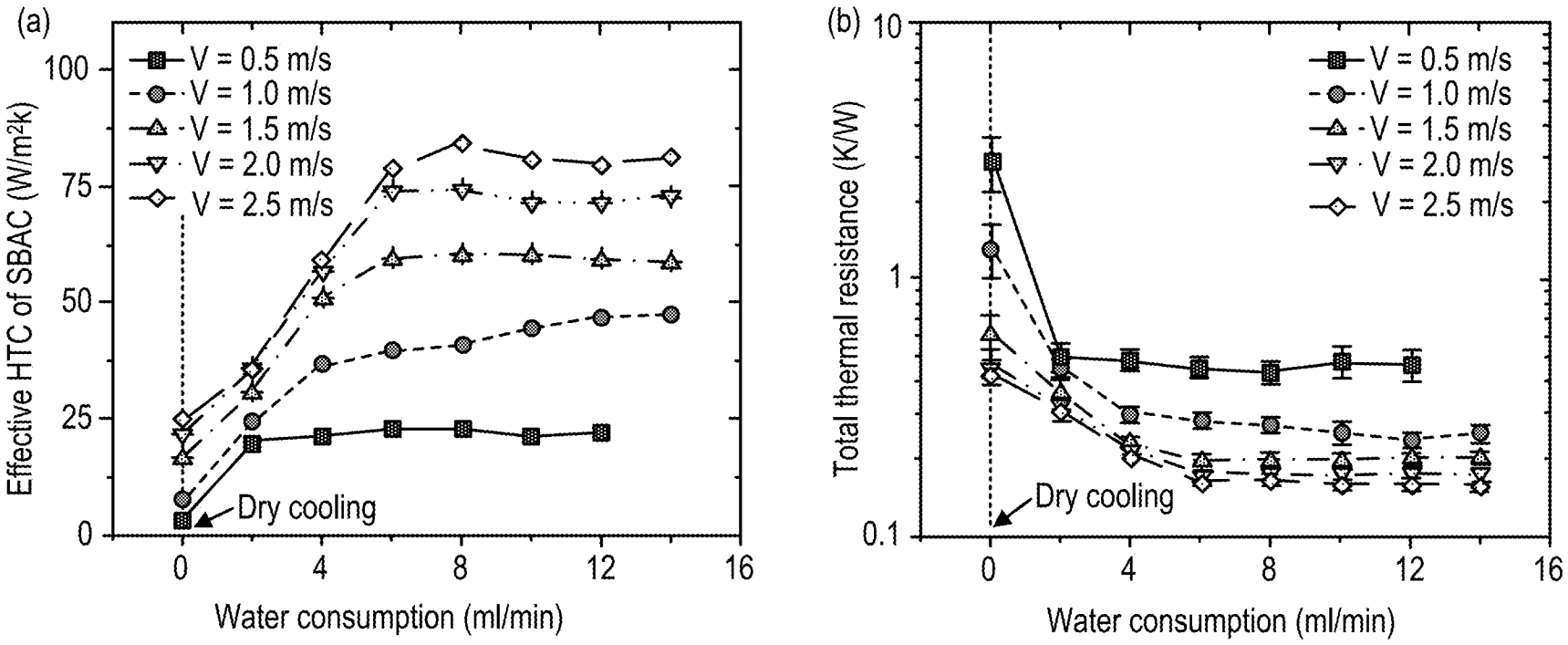
FIG. 46 shows the effects of air velocity on the SBAC.

The effects of air velocity on the performance of SBAC are shown in FIG. 46. FIG. 46 shows the effects of air velocity on the SBAC at (a) effective HTC of SBAC and at (b) total thermal resistance of finned tubes coated with wicks. (Number of fiber glass wicks: 2, Surface temperature: 49.6±0.2° C.). The effective HTC of SBAC is substantially enhanced from 22.9 to 84.4 W/($m^2$ K) and the total thermal resistance decreases from 0.459 to 0.157 K/W with an increase of air velocity from 0.5 to 2.5 m/s. This is consistent with the empirical correlations for the convective heat and mass transfer, which states that the Nusselt number (Nu) and the Sherwood number (Sh) under a forced air convection are proportional to the Reynolds number (Re). At a higher air velocity, the gradient of mass fraction at the water-air interface increases due to the effective transportation of evaporated vapors, which results in an improved evaporation process as described by Eq. (13). The curves of the overall HTC related to the air velocities are similar to those of HTC of SBAC because of a fixed wall temperature (Tw=49.6±0.2° C.).

As a summary, the performance of SBAC can be significantly improved by increasing the surface temperature and the air velocity. In practical applications, thermal load on each finned tube is given, and the surface temperature can be passively changed by the air velocity, i.e., a lower surface temperature accompanies with a higher air velocity. Therefore, an optimal operational condition exists in terms of the evaporative heat transfer in SBAC. An optimized air velocity needs to be identified in any specific applications of SBAC.

Sweating-boost air cooling (SBAC) is promising to dramatically enhance the air-side heat transfer with a high water-efficiency. A superwetting copper hydroxyl nitrate (Cu-HDS/$NO_3$) wicks was developed to improve the thermal performance of SBAC. Cu-HDS/$NO_3$ crystals are directly synthesized on copper substrates using wet chemical oxidization and exhibit a superior wicking rate of 2.16 ml/s and a high thermal stability up to 225° C. SBAC on a finned tube coated with the developed wicks has been experimentally evaluated. We show that Cu-HDS/$NO_3$ wicks enables dramatically enhanced HTCs of SBAC up to 379.9%. Increasing surface temperatures and air velocities can enhance the thermal performance of SBAC, but the effects of air velocities are more significant. The wicking capacity of micro/nanostructures plays a dominant role in determining SBAC performance. The current disclosure also found that an optimal operation condition exists in terms of the evaporative heat transfer in SBAC. An optimized air velocity needs to be identified in any specific applications of SBAC.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A sweating boosted heat dissipation system comprising:

at least one heat pipe comprising:

at least one evaporator section formed from at least one inner grooved tube;

at least one condenser section comprising at least one cooling tube with at least one hybrid wicking fin;

at least one steam supply pipe providing steam to the at least one condenser section;

at least one cold water source for dripping water onto the at least one hybrid wicking fin;

wherein the at least one hybrid wicking fin comprises a partially hydrophilic nanowick coating comprising an inner layer formed by a carbon nanotube and an outer layer formed on the inner layer comprising $TiO_2$ to form an active interface on the partially hydrophilic nanowick configured to decompose organic matter; and wherein the inner layer further comprises a polyurethane organic corrosion protection coating and the outer layer further comprises polyurethane and is configured as a porous layer to promote wicking along the at least one hybrid wicking fin.

2. The sweating boosted heat dissipation system of claim 1, wherein the nanowick coating is self-cleaning.

3. The sweating boosted heat dissipation system of claim 1, wherein the nanowick coating exhibits photo induced superhydrophilic transition.

4. The sweating boosted heat dissipation system of claim 1, wherein the at least one cooling tube is formed from copper.

5. The sweating boosted heat dissipation system of claim 4, wherein a layer of nickel is deposited on an external surface of the at least one cooling tube.

* * * * *